US007293500B2

(12) United States Patent
Futamura et al.

(10) Patent No.: US 7,293,500 B2
(45) Date of Patent: Nov. 13, 2007

(54) PRESS

(75) Inventors: Shoji Futamura, Atsugi (JP); Takeo Matsumoto, Atsugi (JP)

(73) Assignee: Hoden Seimitsu Kako Kenkyusho Co., Ltd. (JP)

( * ) Notice: Subject to any disclaimer, the term of this patent is extended or adjusted under 35 U.S.C. 154(b) by 0 days.

(21) Appl. No.: 10/557,434

(22) PCT Filed: Jul. 8, 2004

(86) PCT No.: PCT/JP2004/009724

§ 371 (c)(1),
(2), (4) Date: Nov. 16, 2005

(87) PCT Pub. No.: WO2005/056280

PCT Pub. Date: Jun. 23, 2005

(65) Prior Publication Data

US 2006/0249038 A1 Nov. 9, 2006

(30) Foreign Application Priority Data

Dec. 12, 2003 (JP) ..... 2003-414580

(51) Int. Cl.
*B30B 15/14* (2006.01)
*B30B 1/18* (2006.01)

(52) U.S. Cl. ..... 100/49; 100/230; 100/289; 100/290; 72/20.1; 72/443; 72/446; 72/454

(58) Field of Classification Search ..... 100/43, 100/48, 50, 51, 52, 280, 287, 288, 289, 290, 100/49; 72/19.8, 20.1, 21.1, 454, 443, 446
See application file for complete search history.

(56) References Cited

U.S. PATENT DOCUMENTS

| | | | | |
|---|---|---|---|---|
| 6,792,788 | B2 * | 9/2004 | Futamura et al. | 72/453.03 |
| 6,871,586 | B2 * | 3/2005 | Teraoka | 100/49 |
| 2005/0204798 | A1 * | 9/2005 | Imaeda | 72/443 |

FOREIGN PATENT DOCUMENTS

| | | |
|---|---|---|
| JP | 2000-176699 | 6/2000 |
| JP | 2000-218395 | 8/2000 |
| JP | 2001-62597 | 3/2001 |
| JP | 2001-71194 | 3/2001 |
| JP | 2001-113393 | 4/2001 |
| JP | 2002-144098 | 5/2002 |

* cited by examiner

*Primary Examiner*—Jimmy Nguyen
(74) *Attorney, Agent, or Firm*—McGlew and Tuttle, P.C.

(57) ABSTRACT

A pressing apparatus using a motor, in which a fast feed drive lowers an upper die to a position immediately before pressing, and a motor for pressing performs a pressing operation. The fast feed drive and the motor for pressing operate cooperatively, and only one position detector, which detects a present position of a slider, is provided for a set of the fast feed drive and the motor for pressing.

20 Claims, 33 Drawing Sheets

PRESS

TECHNICAL FIELD

The present invention relates to a pressing apparatus that is used for thin plate working and the like. In particular, the invention relates to a pressing apparatus that has a simple structure, makes it possible to carry out fixed-stroke press operation, which requires accurate position control, accurately and efficiently and also makes it possible to carry out cooperative operations of a servomotor for fast feed and a servomotor for pressing while using a signal from a position detector.

BACKGROUND ART

The fixed-stroke press operation by an electric press has been used conventionally and it is known that the fixed-stroke press operation is advantageous in preventing occurrence of noise.

According to the electric press for performing the fixed-stroke press operation, it is possible to carry out the fixed-stroke press operation without causing noise. However, the conventional electric press has problems described below. A height dimension up to an pushing member attached to a slide plate lower surface is controlled to be always fixed because of the fixed-stroke press operation. The electric press finally presses a work piece via the pushing member in this position. Therefore, a reaction equivalent to a force of the pushing member always acts on a screw shaft and a nut pressing the pushing member and a slider in identical relative positions.

On the other hand, in the case of the electric press, a slider is generally moved up and down according to a combination of a screw shaft and a nut. Ball screw engagement is used for the screw shaft and the nut in order to perform position control for a ram shaft and an pushing member accurately and precisely. Balls and ball grooves constituting the ball screw engage in line contact or point contact. Therefore, when the reaction acts on the balls and the ball grooves in identical relative positions for a large number of times, the balls and/or the ball grooves are locally worn to decline accuracy and reduce a life. Note that the same problem occurs in the case in which usual screw engagement is used for the screw shaft and the nut.

In order to solve the problems, the applicant has already proposed the pressing apparatuses described in a Patent Document 1 and a Patent Document 2.

FIG. 34 is a main part vertical sectional front view showing an example of the pressing apparatus described in the Patent Document 1. FIG. 35 is a main part sectional plan view along an arrow B-B in FIG. 34.

In the figures, reference numeral 10 denotes a base that is formed in, for example, a rectangular flat shape. Guide columns 20 are provided vertically at four corners of the base 10. At upper ends of the guide columns 20, a support plates 30 formed in a rectangular flat shape is fixed via fastening members 33.

Reference numeral 40 denotes a screw shaft that is supported reversibly rotatably in a central part of the support plate 30 via a bearing 34 and so as to pierce through the support plate 30. Reference numeral 50 denotes a slider that is engaged with the guide columns 20 so as to be movable in an axial direction thereof. Reference numeral 31 denotes a spindle motor. The spindle motor 31 is provided on the support plate 30 and rotates the screw shaft 40 to drive the slider 50. Reference numeral 60 denotes a nut member. A nut section 62 having a brim section 61 and the screw shaft 40 are screwed with each other by ball screw engagement. A differential male screw 64 is provided on an outer peripheral surface of a cylinder section 63 fastening the nut section 62.

Reference numeral 65 denotes a differential member that is formed in a hollow cylindrical shape and a differential female screw 66 to be screwed with the differential male screw 64 is provided on an inner peripheral surface thereof. Reference numeral 67 denotes a worm wheel that is fastened integrally with the differential member 65 and formed to engage with a worm gear 68.

A worm shaft is inserted through and fastened to a central part of the worm gear 68 and is provided to be rotatable at both ends thereof by a bearing provided in the slider 50.

Reference numeral 91 denotes an pushing member that is provided detachably attachable on a central part lower surface of the slider 50. Note that the spindle motor 31 and a motor 69 are applied with predetermined signals via not-shown control means and can be controlled to be driven.

According to the structure described above, when a predetermined signal is supplied to the spindle motor 31 to actuate the spindle motor 31, the screw shaft 40 rotates, the slider 50 including the nut member 60 falls, and the pushing member 91 falls from an initial height (an upper limit standby position) H0 to a machining height (a contact position) H to come into abutment against a work piece W. The pushing member 91 further falls in order to press the work piece W mounted on a table 92 of the base 10. Consequently, the fixed-stroke press operation is applied to the work piece W with a pressing force set in advance. After the machining ends, the slider 50 rises according to reverse rotation of the spindle motor 31 and the pushing member 91 returns to the position of the initial height H0. Note that values of H0 and H are measured by not-shown measuring means and a re controllable in a relation with the spindle motor 31.

When the fixed-stroke press operation reaches the number of times set in advance, the operation of the spindle motor 31 is stopped in the position shown in FIG. 34, that is, the position of the initial height H0 of the pushing member 91 and a signal set in advance is supplied to the motor 69 for rotating the differential member 65. Consequently, the motor 69 rotates by a predetermined angle and the differential member 65 moves rotationally by the predetermined angle via the worm gear 68 and the worm wheel 67. According to the rotational movement of the differential member 65, the nut member 60 stops and the differential female screw 66 moves rotationally relatively to the locked or stopped differential male screw 64. Thus, the slider 50 is displaced.

According to the displacement of the slider 50, the initial height H0 of the pushing member 91 naturally changes. However, when the screw shaft 40 is rotated continuously, predetermined fixed-stroke press operation cannot be performed. Therefore, next, a controlled slight signal is supplied to the spindle motor 31 to slightly move the screw shaft 40 rotationally, offset the displacement of the slider 50 and the pushing member 91, and keep the initial height H0 of the pushing member 91 constant.

According to the rotational movement of the screw shaft 40, the relative positions of the screw shaft 40 and the nut section 62 change. In other words, it is possible to change the relative positions of the balls and the ball grooves formed to be engaged in the ball screw engagement and it is possible to prevent local wear of the balls and/or the ball grooves while securing the fixed-stroke press operation.

FIG. 36 is a main part sectional front view of another pressing apparatus described in the Patent Document 2.

Components identical with those in FIGS. 34 and 35 are denoted by the identical reference numerals and signs.

In FIG. 36, reference numeral 50 denotes a slider that is in slide engagement with the guide columns 20 and provided to be movable up and down. The pushing member 91 is fastened to a lower part of the slider 50. Reference numeral 92 denotes a table that is provided on the base 10, and the work piece W is mounted on the table 92. Reference numeral 59 denotes a movable body.

The movable body 59 is divided by a surface crossing a movement direction of the movable body 59 (an up to down direction in FIG. 36), for example, a horizontal surface and is formed by a first movable body 53 and a second movable body 54 that are arranged to be opposed to each other. Note that the first movable body 53 is fastened to a ball screw nut 52 and the second movable body 54 is fastened to the slider 50. Reference numeral 72 denotes a differential member. The differential member 72 is formed in a wedge shape and couples the first movable member 53 and the second movable member 541. The differential member 72 functions as described later.

Reference numeral 73 denotes a motor that is provided on the slider 50 via a support member 74 and drives the differential member 72 in a direction orthogonal to the movement direction of the movable body 59 (a left to right direction in FIG. 36). In other words, a screw shaft 75 is coupled to a rotation shaft of the motor 73 and formed to be screwed with a nut member (not shown) provided in the differential member 72. Reference numeral 76 denotes a guide plate. For example, a pair of guide plates 76 are provided on both sides of the first movable body 53 and the second movable body 54. A lower end thereof is fixed to the second movable body 54 and the vicinity of an upper end thereof is formed to be capable of engaging with the first movable body 53 slidingly.

According to the structure described above, in FIG. 36, when a predetermined signal is supplied to the spindle motor 31 to actuate the spindle motor 31, the screw shaft 40 rotates, the movable body 59 consisting of the first movable body 53, the second movable body 54, the differential member 72 coupling the movable bodies, and the like falls. The pushing member 91, which is the same as that shown in FIG. 34, falls from the initial height (the upper standby position) H0 to the machining height (the contact position) H and further falls in order to press the work piece W mounted on the table 92 of the base 10, whereby the fixed-stroke press operation is applied to the work piece W. After the machining ends, the movable body 59 rises according to reverse rotation of the spindle motor 31 and the pushing member 91 returns to the position of the initial height H0.

When the fixed-stroke press operation reaches the number of times set in advance or every time the fixed-stroke press operation is performed, the operation of the spindle motor 31 is stopped in the position of the initial height H0 of the pushing member 91 and a signal set in advance is supplied to the motor 73. Consequently, the motor 73 rotates by a predetermined angle and the differential member 72 moves slightly in the horizontal direction via the screw shaft 75. According to the movement of the differential member 72, the first movable body 53 and the second movable body 54 move relatively in the up to down direction and the movable body 59 is displaced. Correction operation for offsetting this displacement is performed according to supply of a signal to the spindle motor 31 and the initial height H0 of the pushing member 91 is kept constant.

According to the rotational movement of the screw shaft 40 involved in the correction, the relative positions of the screw shaft 40 and the ball screw nut 52 change. It is possible to change the relative positions of the balls and the ball grooves formed to be engaged in the ball screw engagement. Thus, it is possible to prevent local wear of the balls and/or the ball grooves while securing the fixed-stroke press operation. After that, it is possible to perform the fixed-stroke press operation continuously.

Note that, it is needless to mention that the operation for offsetting the displacement of the movable body 59 (by the spindle motor 31), which is explained with reference to FIGS. 34 and 36, only has to be performed under a condition of no load in which pressing by the pushing member 91 is not performed.

As described above, in the pressing apparatuses described in the Patent Document 1 and the Patent Document 2, it is possible to change the relative positions of the balls and the ball grooves, which are in ball screw engagement, every time molding is performed several times. Thus, it is possible to prevent local wear of the balls and the ball grooves. However, in the pressing apparatus described in the Patent Document 1, since the differential member 65, the motor 69 for moving the differential member, and the driving mechanism for the motor 69 are provided in the slider, the slider is heavy and large. Moreover, in the pressing apparatus described in the Patent Document 2, since the movable body is divided into the first and the second movable bodies and the movable bodies and the guide plate are integrated in the differential mechanism, the entire slider is also large. Since the slider is large and heavy in this way, an unnecessary load is applied to the motor for driving the slider and a load is also applied to the ball screw when the slider is lifted. In addition, since the slider is heavy and has a large inertia, a large torque is required and temporal loss is caused when the slider is moved to control a position.

In the pressing apparatuses described in the Patent Document 1 and the Patent Document 2, press working is performed according to the rotation of the motor 31. However, since a large force is required in the press working, a falling velocity at the time of press working for the entire slider is inevitably reduced. Thus, a velocity of fall from the initial height H0 to the contact position H in FIG. 34 is also reduced. In other words, in performing the fixed-stroke press operation by electronic press, a large pressing force is required while a work piece is subjected to press working. Thus, for example, it is necessary to design the spindle motor 31 to have a sufficiently large capacity, which makes the apparatus expensive as a whole. In solving this problem, it is considered to significantly reduce the rotation of the spindle motor 31 to make it possible to generate a large pressing force.

However, in this case, a problem described below occurs. When the rotation of the spindle motor 31 is significantly reduced to press the work piece W, desirably long time is required for the pushing member 91 to fall from the position of the initial height H0 to the position of the height H in contact with the work piece W.

In order to solve this problem, it is desired to lower the pushing member 91 at high speed from the height H0 to the height H and perform the press working with a large force only when the machining is performed from the height H. Therefore, it is desirable to provide driving means for lowering the pushing member 91 at high speed and pressing means for performing the press working separately and reduce time required for one cycle of the press working.

Therefore, the applicant has proposed the pressing apparatus described in a Patent Document 3. In the pressing apparatus, in order to lower an pushing member to a position of the work piece W, a reciprocating drive apparatus like a link mechanism is driven by a motor for fast feed and rotation of a motor for pressing is reduced to press the work piece. Note that this structure is a premise of an embodiment of the invention shown in FIG. 32 to be described later.

Naturally, instead of the form of driving the reciprocating drive apparatus like the link mechanism with the motor for fast feed, it is considered to lower the pushing member to the position of the work piece W rapidly with the motor for fast feed and, then, press the work piece W with the motor for pressing, rotation of which is reduced. The applicant has proposed this structure in a Patent Document 4. In the Patent Document 4, a first slider is lowered using a motor for fast feed, a second slider is lowered using a motor for pressing mounted on the first slider, and the work piece W is pressed using an pushing member attached to the second slider. This structure is a premise of an embodiment of the invention shown in FIG. 24 to be described later.

Note that, in a pressing apparatus disclosed in the Patent Document 4, the structure including the two motors and the two sliders is adopted and a single position detecting device for detecting a position of the second slider is provided (a single position detecting device is provided in association with the set of the two motors).

The embodiment of the invention shown in FIG. 24 solves a problem that is found in realizing the structure described in the Patent Document 4. In other words, the pressing apparatus includes means for locking rotation of the motor for fast feed relatively to the first slider when a work piece is actually pressed.

The invention has been devised in view of the points described above and it is an object of the invention to provide a pressing apparatus that is capable of changing relative positions of balls and ball grooves, which are in ball screw engagement, every time molding is performed a number of times set in advance and is capable of reducing time required for one cycle of press working.

Patent Document 1: Japanese Patent Application Laid-Open No. 2000-218395

Patent Document 2: Japanese Patent Application Laid-Open No. 2002-144098

Patent Document 3: Japanese Patent Application Laid-Open No. 2001-113393

Patent Document 4: Japanese Patent Application Laid-Open No. 2001-62597

DISCLOSURE OF THE INVENTION

Therefore, the pressing apparatus of the invention is a pressing apparatus including: a base; a support plate that is held in parallel to the base via plural guide columns vertically provided on the base; a slider that can slide on the guide columns to move up and down between the base and the support plate; a first motor for fast feed that is attached to the support plate and drives the slider up and down fast; and a second motor for pressing that moves the slider up and down to press a work piece, characterized in that:

the pressing apparatus includes: an encoder for the first motor that detects rotation of the first motor; an encoder for the second motor that detects rotation of the second motor; and a position detector, which measures movement of the slider, provided for a set of the first motor and the second motor, the first motor is controlled by a servo module for the first motor that calculates a speed instruction based on position information giving a position where the first motor should be placed according to elapse of time and a servo driver for the first motor that drives the first motor according to an instruction from the servo module for the first motor and a signal from the encoder for the first motor, the second motor is controlled by a servo module for the second motor that calculates an instruction based on position information giving a position where the second motor should be placed according to elapse of time and a servo driver for the second motor that drives the second motor according to an instruction from the servo module for the second motor and a signal from the encoder for the second motor, and in the position detector, information giving a position of the slider, which is obtained from a signal from the single position detector during a period from start of the first motor until start of the second motor, is reset and information giving a position of the slider at the time of start of the second motor is set as a starting point value.

A specific structure of the pressing apparatus is as described below.

A pressing apparatus is characterized by including: a base; a support plate that is held in parallel to the base via plural guide columns vertically provided on the base; a slider that can slide the guide columns and move up and down between the base and the support plate; a first motor attached to the support plate; a screw shaft that is attached to a rotation shaft of the first motor and drives the slider relatively to the base according to rotation of the first motor; and a differential mechanism that moves the screw shaft up and down relatively to the support plate according to drive by a drive source, and further including:

a ball screw nut that is screwed with a ball screw section provided in the screw shaft;

a lock device that integrates the screw shaft and the support plate;

a slider moving mechanism that includes an input shaft and makes the ball screw nut reversibly rotatable relatively to the screw shaft at a rotation torque inputted from the input shaft when the screw shaft and the support plate are fixed by the lock device and makes the ball screw nut fixable to the slider;

a second motor capable of rotating in forward and reversely that gives a rotation torque to the slider moving mechanism via the input shaft; and a position detector provided for a set of the first motor and the second motor, the position detector detecting a position of the slider.

DESCRIPTION OF SYMBOLS

Figure 1:
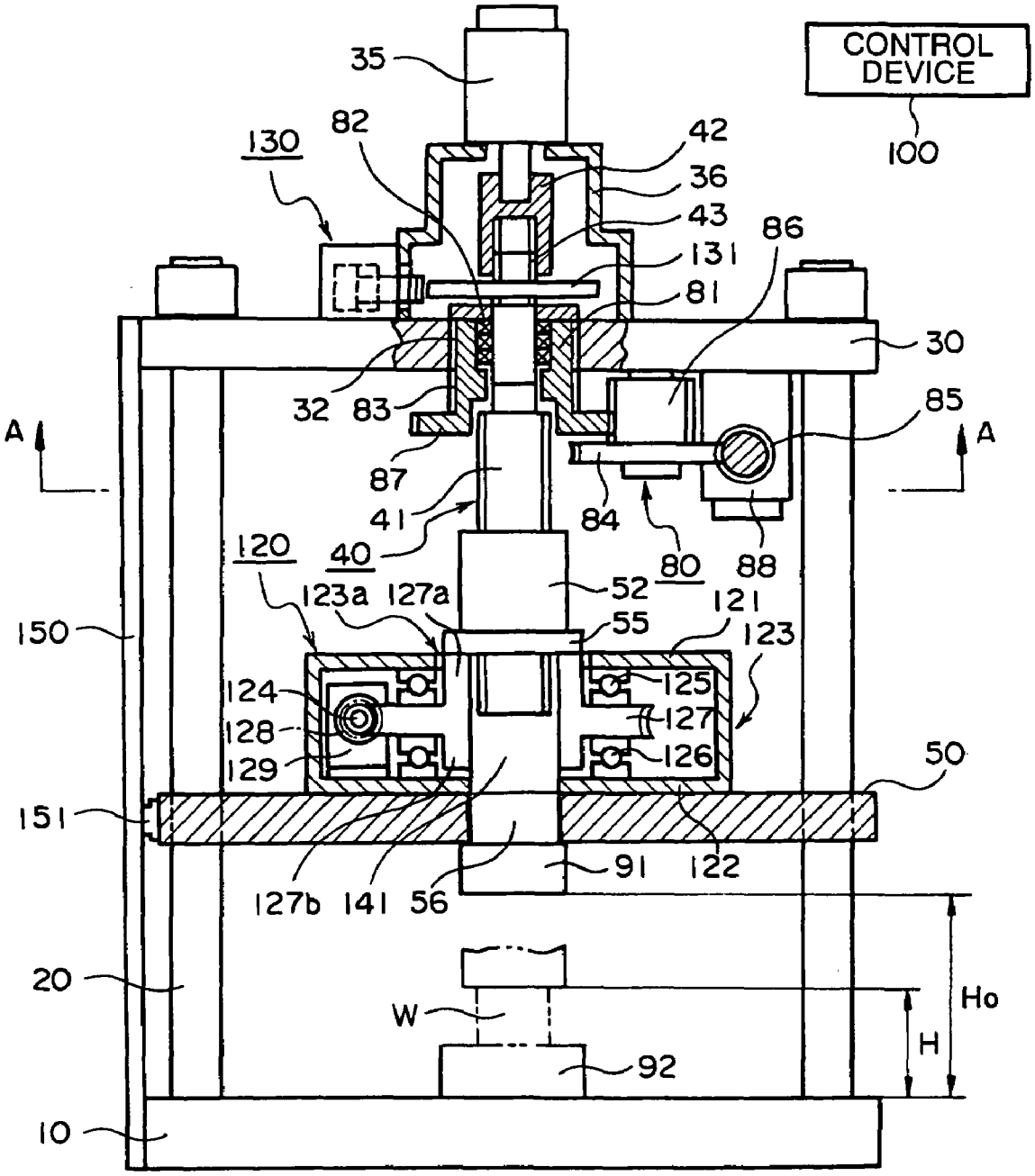
FIG. 1 is a front view of an embodiment in which a part of a main part of a pressing apparatus according to the invention is shown in section.

30 Support plate
35 Servomotor for fast feed
50 Slider
129 Servomotor for pressing
150 Pulse scale
151 Position detector
200 NC (Numerical Control) device
201 Touch panel
210 Servo module for servomotor M#1 (SM#1)
220 Servo driver for servomotor M#1 (SD#1)
230 Encoder measuring an amount of rotation for servomotor M#1
240 Servo module for servomotor M#2 (SM#2)
250 Servo driver for servomotor M#2 (SD#2)
260 Encoder measuring an amount of rotation for servomotor M#2

BEST MODE FOR CARRYING OUT THE INVENTION

Figure 2:
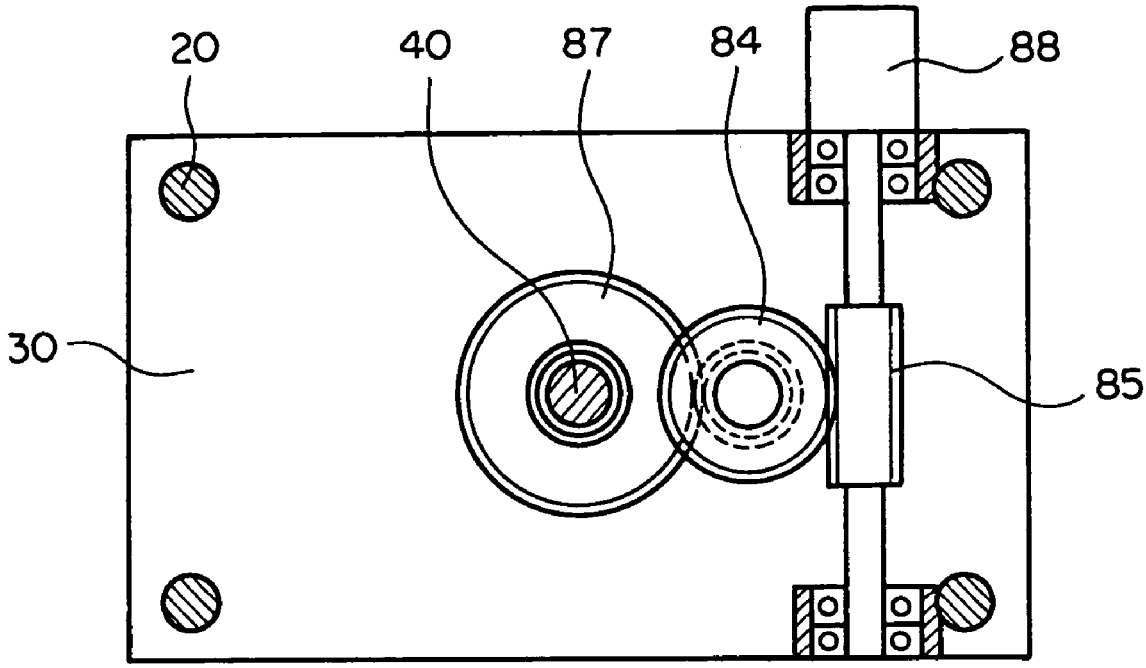
FIG. 2 is a main part sectional view along an arrow A-A in FIG. 1.
Figure 34:
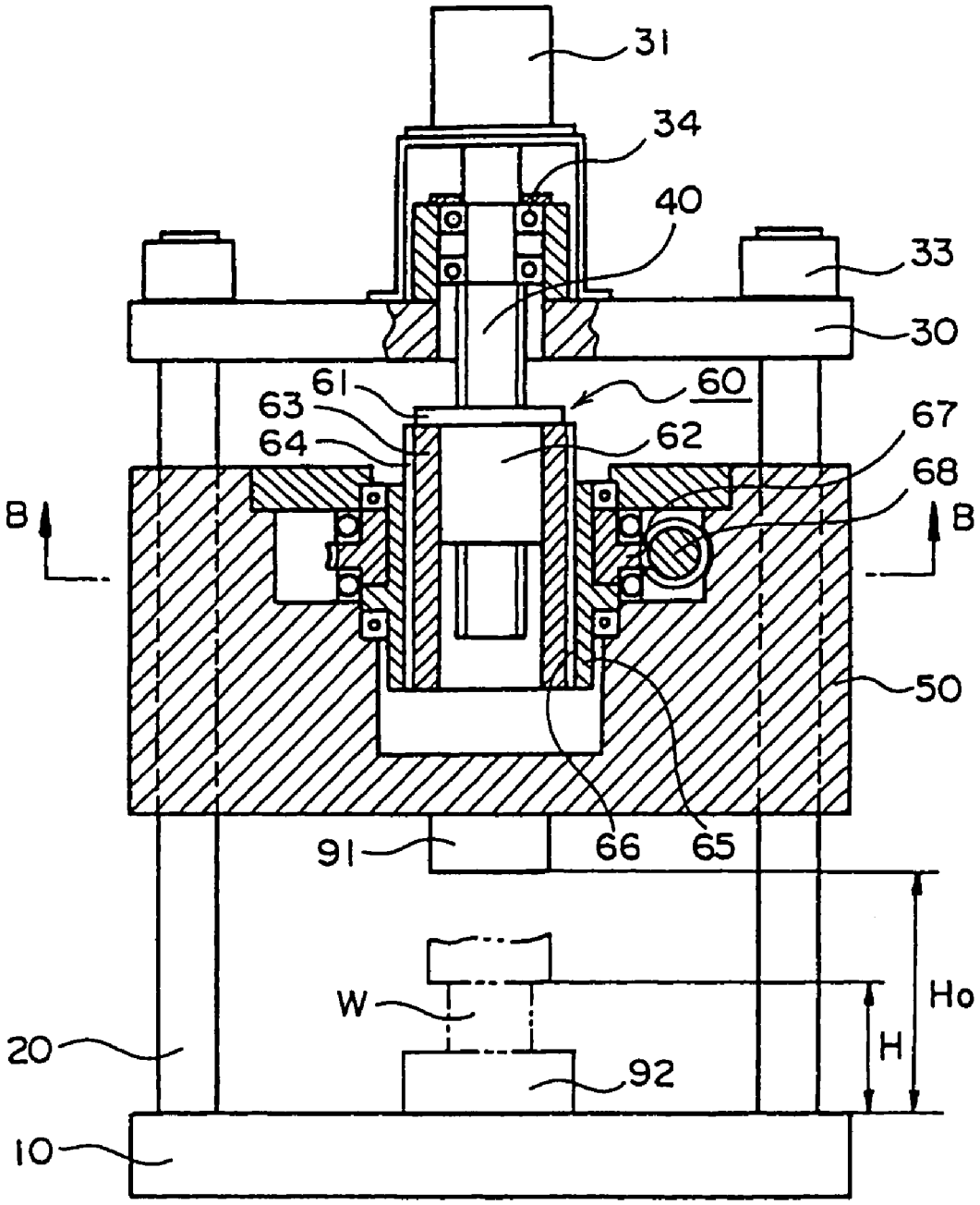
FIG. 34 PRIOR ART
FIG. 34 is a main part vertical sectional front view showing an example of a pressing apparatus described in the Patent Document 1.
Figure 35:
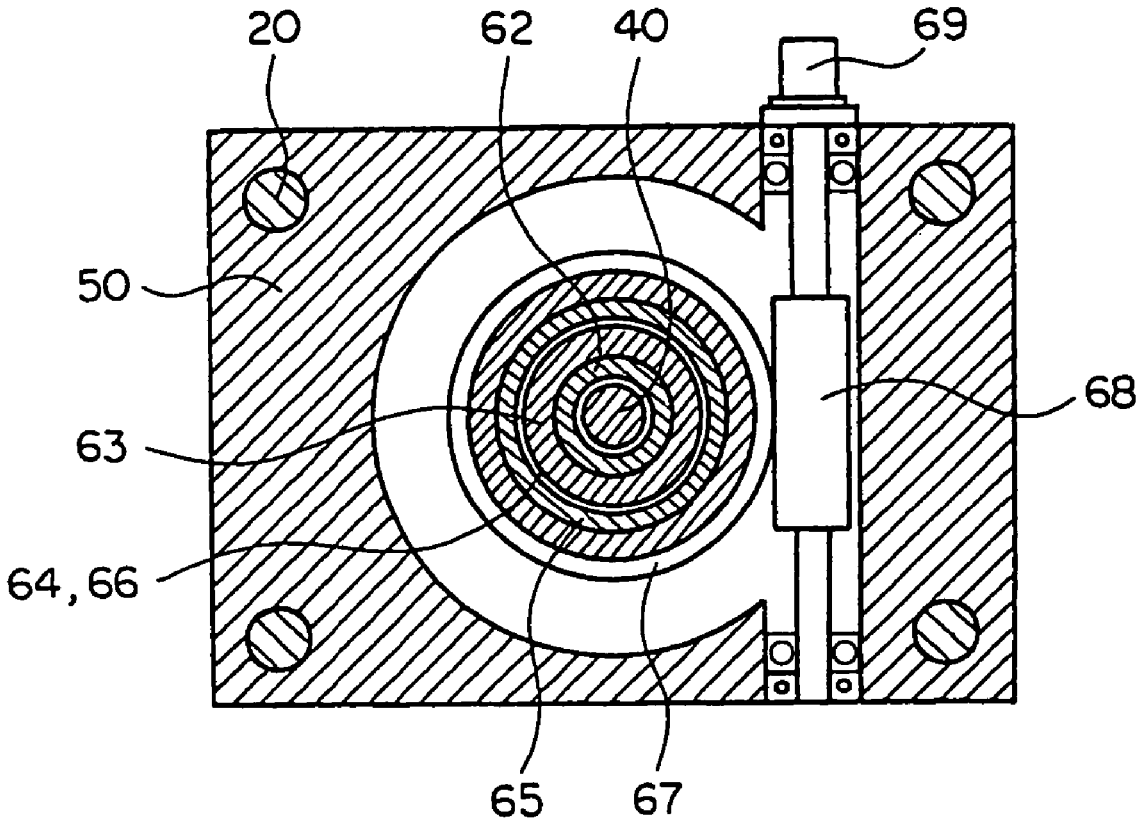
FIG. 35 PRIOR ART
FIG. 35 is a main part sectional plan view along an arrow B-B in FIG. 34.
Figure 36:
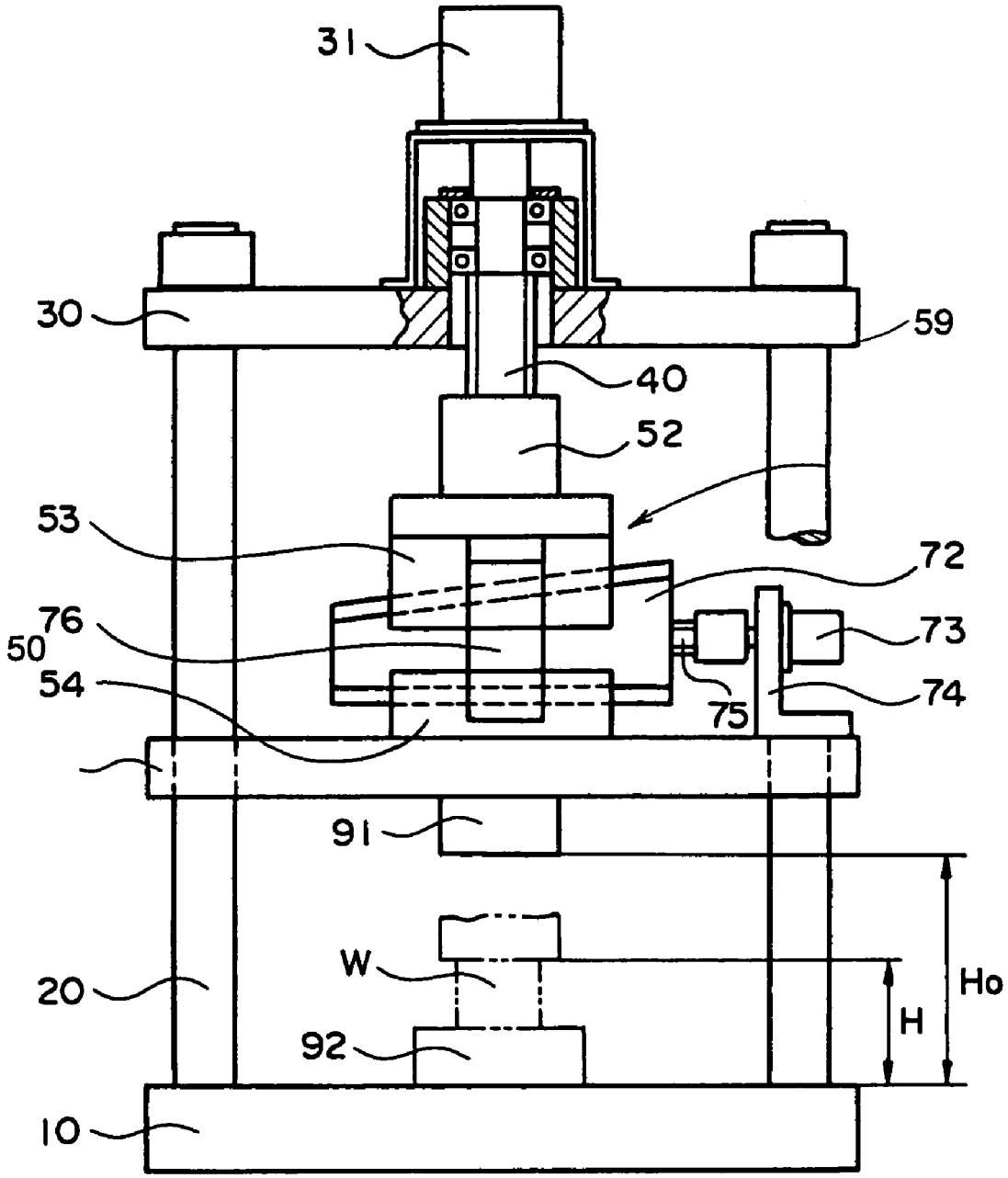
FIG. 36 PRIOR ART
FIG. 36 is a main part sectional front view of another pressing apparatus described in the Patent Document 2.

FIG. 1 is a front view of an embodiment in which a part of a main part of a pressing apparatus according to the invention is shown in section. FIG. 2 is a main part sectional view along an arrow A-A in FIG. 1. In these figures, components identical with those in FIGS. 34 and 36 are denoted by the identical reference numerals and signs.

The pressing apparatus includes a rectangular base 10, guide columns 20 erected at four corners of the base 10, and a support plate 30 supported by the guide columns 20 in parallel to the base 10. Further, a slider 50 (which also serves as a slide plate in this context) is provided between the base 10 and the support plate 30 to be guided by the guide columns 20 and move up and down freely along the guide columns 20.

A servomotor (a first motor) for fast feed 35 incorporating an encoder is attached to the support plate 30 via an attachment stand 36. A screw shaft 40 extending from a rotation shaft of the servomotor for fast feed 35 pierces through the support plate 30. A ball screw section 41 is provided from a central part to a lower end of the screw shaft 40 as shown in FIG. 1.

The screw shaft 40 extending from the servomotor for fast feed 35 is held rotatably by a differential cylinder 81 that is attached to a through hole opened in the support plate 30 coaxially with the screw shaft 40. A thrust bearing 82 is attached to a through hole of the differential cylinder 81 to support the screw shaft 40 rotatably. A first screw 83 (e.g., a male screw) is provided in an outer peripheral surface of the differential cylinder 81 coaxially with the through hole. The first screw 83 is screwed with a second screw 32 (e.g., a female screw) provided in the support plate 30 to hold the differential cylinder 81 in the second screw 32 of the support plate 30. It is possible to move the differential cylinder 81 up and down together with the screw shaft 40 relatively to the support plate 30 by turning the differential cylinder 81 around the shaft.

A spline groove is cut in a lower half of a coupling 42 fastened to a rotation shaft of the servomotor for fast feed 35. On the other hand, a spline is cut at an upper end of the screw shaft 40. The upper end of the screw shaft 40 is fit in the spline groove and coupled by a spline engaging section 43. Since the screw shaft 40 is mechanically coupled to the rotation shaft of the servomotor for fast feed 35 by the coupling 42, rotation of the servomotor for fast feed 35 is transmitted to the screw shaft 40, whereby the slider 50 can be driven. However, even if the differential cylinder 81 is rotated relatively to the support plate 30 to move the screw shaft 40 up and down, the movement is absorbed by the part of the spline engaging section 43. Thus, the servomotor for fast feed 35 is not affected and can rotate the differential cylinder 81 to move the screw shaft 40 up and down.

In addition, a drive source for bearing position adjustment (a servomotor is used as the drive source but a drive source having a latchet mechanism or the like may be used) 88 for rotating the differential cylinder 81 is attached to the support plate 30. A worm gear 85 is attached to a rotation axis of the drive source for bearing position adjustment 88. The worm gear 85 transmits rotation of the drive source for bearing position adjustment 88 to a gear 87, which is formed integrally with the differential cylinder 81, via a worm wheel 84 fasted to the identical shaft and an intermediate gear 86 provided in the shaft.

From the above explanation, as it is clearly seen with reference to FIG. 2, a differential mechanism 80 is constituted by the drive source for bearing position adjustment 88, the worm gear 85, the worm wheel 84, the intermediate gear 86, the gear 87, the differential cylinder 81, and screw coupling of the first screw 83 and the second screw 32 provided in the differential cylinder 81 and the support plate 30. The differential mechanism 80 is attached to the support plate 30. It is needless to mention that the differential mechanism 80 may be provided above the support plate 30.

Figure 3:
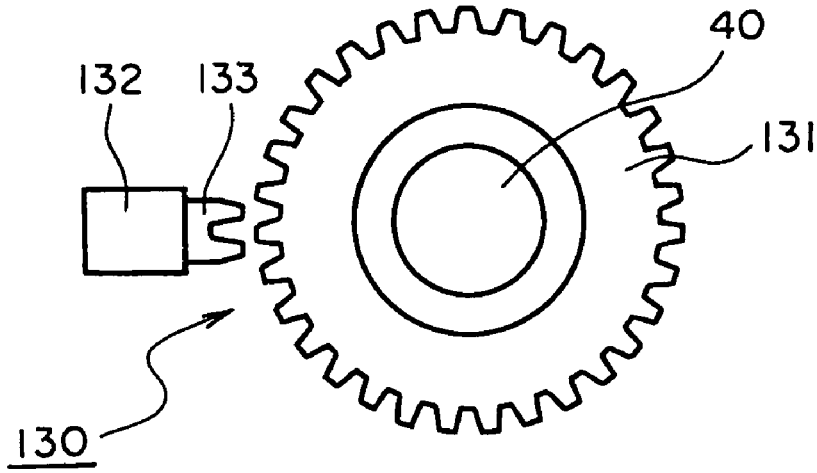
FIG. 3 is an explanatory view of a structure of an embodiment of a lock device.

A lock device 130 is provided in the support plate 30. As shown in FIG. 3, this lock device 130 includes a gear 131 fastened to the screw shaft 40 and a gear piece 133 attached to a plunger of a solenoid 132 fixed to the support plate 30.

When an electric current is applied to an electromagnetic coil of the solenoid 132, the gear piece 133 attached to the plunger of the solenoid 132 projects to mesh with the gear 131. Since the solenoid 132 is attached to the support plate 30, the screw shaft 40 is integrated with the support plate 30 via the solenoid 132.

When the application of an electric current to the solenoid 132 is cut, the projected gear piece 133 attached to the plunger of the solenoid 132 is retracted by an elastic force of a spring provided inside the solenoid 132 and disengaged from the gear 131 fastened to the screw shaft 40 and the integration of the screw shaft 40 and the support plate 30 is released.

As this lock device 130, other than the structure shown in FIG. 3, it is also possible to use an electromagnetic or mechanical clutch that integrates the screw shaft 40 and the support plate 30. It is also possible to use a brake device. In the invention, these devices are collectively referred to as a lock device.

The ball screw section 41 provided from the central part to the lower end of the screw shaft 40 is fit in and engaged with the ball screw nut 52 that includes the balls and the ball grooves and comes into ball screw engagement with the ball screw section 41. A slider moving mechanism 120 is disposed between the ball screw nut 52 and the slider 50.

The slider moving mechanism 120 roughly has two functions, namely, a function for freely rotating the ball screw nut 52 forward and reversely relatively to the screw shaft 40 so as to move the slider 50 up and down when the screw shaft 40 and the support plate 30 are integrated by the lock device 130 and in a torque application mode (this torque application mode will be explained later) and a function of fixing the ball screw nut 52 to the slider 50.

The slider moving mechanism 120 is constituted as follows. A support frame 123 with a hole 123*a* formed in central parts of a top plate 121 and a bottom plate 122 thereof is fastened to an upper surface of the slider 50.

(i) two thrust bearings 125 and 126 fastened to the top plate 121 and the bottom plate 122, respectively;

(ii) a worm wheel 127 that is nipped by the two bearings 125 and 126, includes a through hole 141, which is enough for freely rotating and moving up and down the ball screw section 41, in a central part thereof, and has cylindrical axial sections 127*a* and 127*b* formed in an upper part and a lower part, respectively;

(iii) a worm gear 128 that meshes with the worm wheel 127; and (iv) an input shaft 124 that fastens the worm gear 128 are disposed in the support frame 123. In the case of FIG. 1, a servomotor (a second motor) for pressing 129 incorporating an encoder, which is capable of freely rotating the worm wheel 127 forward and reversely, is coupled to the input shaft 124 of the slider moving mechanism 120 and housed in the slider moving mechanism 120.

The worm wheel 127 is fastened to a flange section 55 provided at a lower end of the ball screw nut 52 via the cylindrical axial section 127*a* provided in the worm wheel 127 in a state in which the worm wheel 127 is fit in the hole 123*a* formed in the support frame 123.

As explained above, the worm wheel 127 has the through hole 141, which is enough for freely rotating and moving up and down the ball screw section 41, in the central part and is held to rotate freely in a form with the ball screw section 41 as an axis by the two thrust bearings 125 and 126 nipping the worm wheel 127. The cylindrical axial section 127*a* of the worm wheel 127 is fastened to the flange section 55 provided at the lower end of the ball screw nut 52. Thus, the slider moving mechanism 120 can carry out the two functions.

Since the slider moving mechanism 120 has such a structure, when the screw shaft 40 and the support plate 30 are integrated and fixed by application of an electric current to the lock device 130, the ball screw nut 52 is rotated relatively to the screw shaft 40 according to forward and reverse rotation of the servomotor for pressing 129 that is capable of freely rotating forward and reversely to allow the slider 50 to move up and down in the torque application mode by the servomotor for pressing 129 (it is needless to mention that, even in a state in which the screw shaft 40 and the support plate 30 are not integrated and fixed, if the screw shaft 40 and the nut 52 rotate relatively to each other, the slider 50 moves up and down relatively to the support plate 30). In addition, when the servomotor for pressing 129 is stopped and the lock device 130 is in an opened state, the ball screw nut 52 is integrated with and fixed to the slider 50 via meshing engagement with the worm gear 128 and the worm wheel 127. Thus, it is possible to move the slider 50 up and down when the screw shaft 40 is rotated according to forward and reverse rotation of the servomotor for fast feed 35 that is capable of freely rotating forward and reversely.

A through hole 56, which is enough for freely rotating and moving up and down the ball screw section 41, is provided in substantially the center of the slider 50 in the same manner as the through hole 141 provided in the slider moving mechanism 120.

As described above, the ball screw nut 52 of the slider 50 and the ball screw section 41 of the screw shaft 40 engage with each other according to meshing engagement of the worm gear 128 and the worm wheel 127 fastened to the servomotor for pressing 129. By rotating the servomotor for fast feed 35 forward or reversely and further rotating the servomotor for pressing 129 forward and reversely according to the rotation of the servomotor for fast feed 35, it is possible to lift or lower the slider 50 more rapidly. It is possible to reduce time required for up and down reciprocating movement of one cycle of the slider 50 required for press working. However, such rapid lifting and rapid lowering should be performed under a state in which a press load is not applied.

The pushing member 91 or a mold (hereinafter represented by pushing member 91) is attached to a lower surface of the slider 50. In addition, the work piece W, which should be molded, is mounted on the table 92 of the base 10. A pulse scale 150, which detects a position of the slider 50, is attached along the guide columns 20 between the base 10 and the support plate 30 such that a position of the slider 50 is detected by a position detector 151. Note that, for example, the pulse scale 150 is fastened to the base 10 at a lower end thereof and is attached to the support plate 30 or the like at an upper end thereof such that the pulse scale 150 is not affected by extension due to heat of the guide columns 20. As described later, the pulse scale 150 detects a contact position (a fixed-stroke press operation height) H of the pushing member 91 provided on the lower surface of the slider 50 and the work piece W set on the base 10 or a position immediately before the contact position H and detects an upper limit standby position of the pushing member 91 (an initial position of the pushing member 91) H0 or a lower limit position thereof.

A control device 100 controls rotation velocities including rotating directions of the servomotor for fast feed 35 and the servomotor for pressing 129 and rotation torques thereof and controls the lock device 130 or the like that fixes the screw shaft 40 to the support plate 30 (locks the screw shaft 40) or releases the lock. Various set values are inputted to the control device 100 in advance. In addition, basis on a position signal detected by the position detector 151 for detecting a position of the slider 50, that is, detecting a position of the pushing member 91, the control device 100 performs the following control.

(i) Up to a point when the pushing member 91 in the upper limit standby position H0 comes into contact with the work piece mounted on the table 92 (the contact position H) or a point (a position) immediately before the contact, the control device 100 rapidly lowers the pushing member 91 via the slider 50 lowered by the servomotor for fast feed 35.

(ii) After the servomotor for fast feed 35 is stopped, the control device 100 locks the lock device 130, and from a point when the pushing member 91 comes into contact with the work piece W or a point immediately before the contact to a point when the pushing member 91 falls to a lower limit falling position set in advance, in a state in which the fall of the pushing member 91 is decelerated with respect to a rapid fall velocity by the servomotor for fast feed 35 via the slider 50 lowered by the servomotor for pressing 129, the control device 100 changes the servomotor for pressing 129 to the torque application mode to cause the pushing member 91 to press the work piece W mounted on the table 92 and mold the work piece W into a predetermined shape.

(iii) After the pushing member 91 reaches the lower limit falling position, the control device 100 unlocks the lock device 130 and rises the slider 50 rapidly, that is, rises the pushing member 91 rapidly according to a cooperative drive form in which the servomotor for fast feed 35 and the servomotor for pressing 129 are driven, respectively (in the case of the first control method).

In the above explanation, up to the point when the pushing member 91 in the upper limit standby position H0 comes into contact with the work piece W mounted on the table 92 (the contact position H) or the point (the position) immediately before the contact, the control device 100 performs control to lower the pushing member 91 rapidly with the servomotor for fast feed 35 alone. However, the control device 100 may perform control to also rotate the servomotor for pressing 129 in the direction of lowering the pushing member 91 and cause the servomotor for fast feed 35 and the servomotor for pressing 129 to perform a cooperative operation according to parallel drive to thereby fall the slider 50 more rapidly (in the case of the second control method).

When the control device 100 performs the control of the second control method, the servomotor for fast feed 35 is completely stopped by the point immediately before the pushing member 91 comes into contact with the work piece W and, then, the lock device 130 is brought into the locked state. Then, the servomotor for pressing 129 enters the torque application mode. In other words, at the point when the pushing member 91 comes into contact with the work piece W, the control device 100 is required to perform control such that the control device 100 is in a control state of the torque application mode in which the servomotor for pressing 129 is in the torque application mode, the pushing member 91 presses the work piece W mounted on the table 92, and the work piece W is molded into a predetermined shape.

The servomotor for fast feed 35 is completely stopped by the point immediately before the pushing member 91 comes into contact with the work piece W and the lock device 130 is locked to fix the screw shaft 40 to the support plate 30. This is because, even if a force for moving the slider 50 upward via the ball screw nut 52, the screw shaft 40 (the ball screw section 41), the differential mechanism 80, and the like acts on the slider 50 because of a reaction that is caused when the pushing member 91 presses the work piece W mounted on the table 92, since rotation of the screw shaft 40 based on the reaction is prevented by the integration of the screw shaft 40 and the support plate 30 explained above, the slider 50 is prevented from moving upward. In other words, this is because a predetermined press load is given to the work piece W from the pushing member 91 surely.

In the first and the second control methods, up to the point (the position) immediately before the pushing member 91 comes into contact with the work piece W mounted on the table 92, the control device 100 causes the pushing member 91 in the upper limit standby position H0 to cooperate with the servomotor for fast feed 35 and the servomotor for pressing 129. However, after the pushing member 91 reaches the lower limit falling position, the control device 100 can perform control described below. In short, after the pushing member 91 reaches the lower limit falling position, the control device 100 may perform control to cause the servomotor for fast feed 35 and the servomotor 129 for pressing to operate independently from each other and lift the pushing member 91 to the original upper limit standby position H0 (the case of the third control method).

Even when the control of the third control method is performed, by the point immediately before the pushing member 91 comes into contact with the work piece W, the control device 100 stops the servomotor for fast feed 35 completely and, then, brings the lock device 130 into the locked state. It is needless to mention that, at the point (the position) when the pushing member 91 comes into contact with the work piece W or the point immediately before the contact, it is required to perform contact such that the servomotor for pressing 129 is in the torque application mode, the pushing member 91 presses the work piece W mounted on the table 92, and the control device 100 is in a control state for molding the work piece into a predetermined shape.

It is needless to mention that, other than the first to the third control methods, the control device 100 can control to cause the servomotor for fast feed 35 and the servomotor for pressing 129 to operate independently from each other.

An operation of the pressing apparatus of the invention constituted as described above will be explained with reference to a cycle diagram of an embodiment in an automatic operation of the pressing apparatus according to the invention in FIG. 6.

Figure 6:
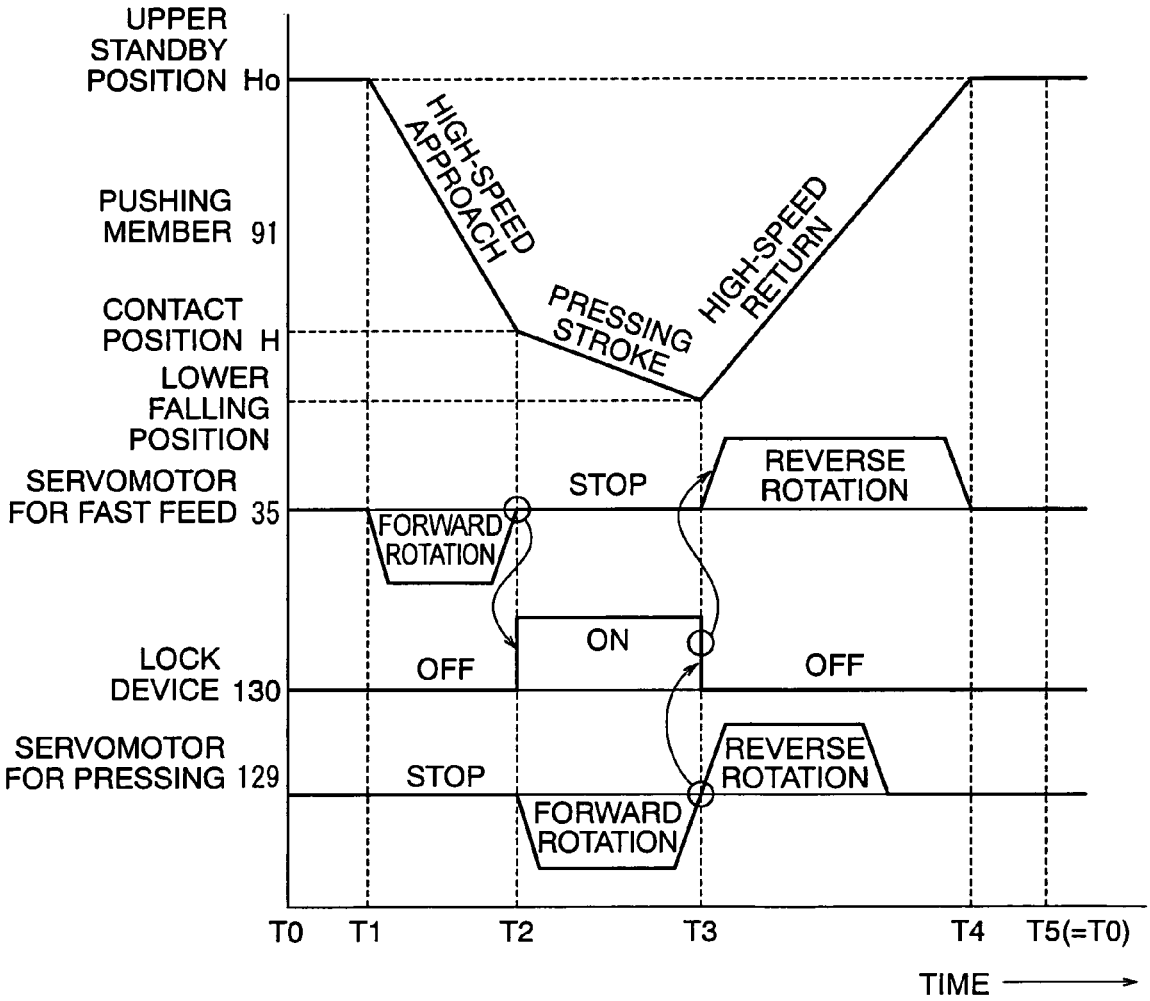
FIG. 6 is a cycle diagram of an embodiment in automatic operation of the pressing apparatus according to the invention.

In FIG. 6, a vertical axis indicates operations of the pushing member 91, the servomotor for fast feed 35, the lock device 130, and the servomotor for pressing 129 in order from above and a horizontal axis indicates time. A solid line at the top indicates a locus of the pushing member 91. Note that, in parts of the figure corresponding to the servomotor for fast feed 35 and the servomotor for pressing 129, heights from a base line of parts indicated as "forward rotation" and heights from the base line (a zero level line) of parts indicated as "reverse rotation" are the same.

T0 to T1 on the time axis represents a cycle start point in a state in which the servomotor for fast feed 35, the lock device 130, and the servomotor for pressing 129 are in an OFF state and the pushing member 91 is in the upper limit standby position H0.

Time T1 to T2 represent a fall period (a high-speed approach period) of the pushing member 91 in which an electric current is applied to rotate the servomotor for fast feed 35 forward, the slider 50 starts falling, and the pushing member 91 falls following the fall of the slider 50.

T2 on the time axis represents a point when the pushing member 91 comes into contact with the work piece W mounted on the table 92 of the base 10 and also represents a point when the screw shaft 40 and the support plate 30 are integrated and an electric current is applied to rotate the servomotor for pressing 129 forward according to stop of the rotation of the servomotor for fast feed 35 and the lock of the lock device 130 immediately after the stop of the rotation and the slider, that is, the pushing member 91 starts falling.

In other words, the time T1 to T2 is a non-press period until the pushing member 91 in the upper limit standby position H0 comes into contact with the work piece W mounted on the table 92. In the time T1 to T2, the pushing member 91 is lowered rapidly according to rapid rotation of the screw shaft 40 by the servomotor for fast feed 35.

Time T2 to T3 represents a press period (a press stroke period) in which the servomotor for pressing 129 comes into the torque application mode and the pushing member 91 press-molding the work piece W mounted on the table 92 of the base 10 via the slider 50.

T3 on the time axis represents a point set in advance when the pushing member 91 reaches the lower limit falling position and indicates that the integration of the screw shaft 40 and the support plate 30 is released and an electric current is applied to rotate the servomotor for fast feed 35 and the servomotor for pressing 129 reversely according to unlock of the lock device 130 immediately after the point.

Time T3 to T4 represents a rising period (a high-speed return period) in which, under the release of the integration of the screw shaft 40 and the support plate 30, the servomotor for fast feed 35 and the servomotor for pressing 129 rotate reversely to lift the slider 50 and the pushing member 91 rises rapidly from the lower limit falling position to return to the upper limit standby position H0.

T4 on the time axis represents a point when the reverse rotation of the servomotor for fast feed 35 stops, the slider 50 returns to the original position at the time of start of the fall, and the pushing member 91 reaches the upper limit stand by position H0. Note that the reverse rotation of the servomotor for pressing 129 stops before T4 on the time axis.

T5 on the time axis represents a time when one cycle is completed. In this way, in the non-press period of the time T1 to T2 and the time T3 to T4, the pushing member 91 is lowered and lifted rapidly, whereby time required for one cycle of molding is reduced.

Figure 7:
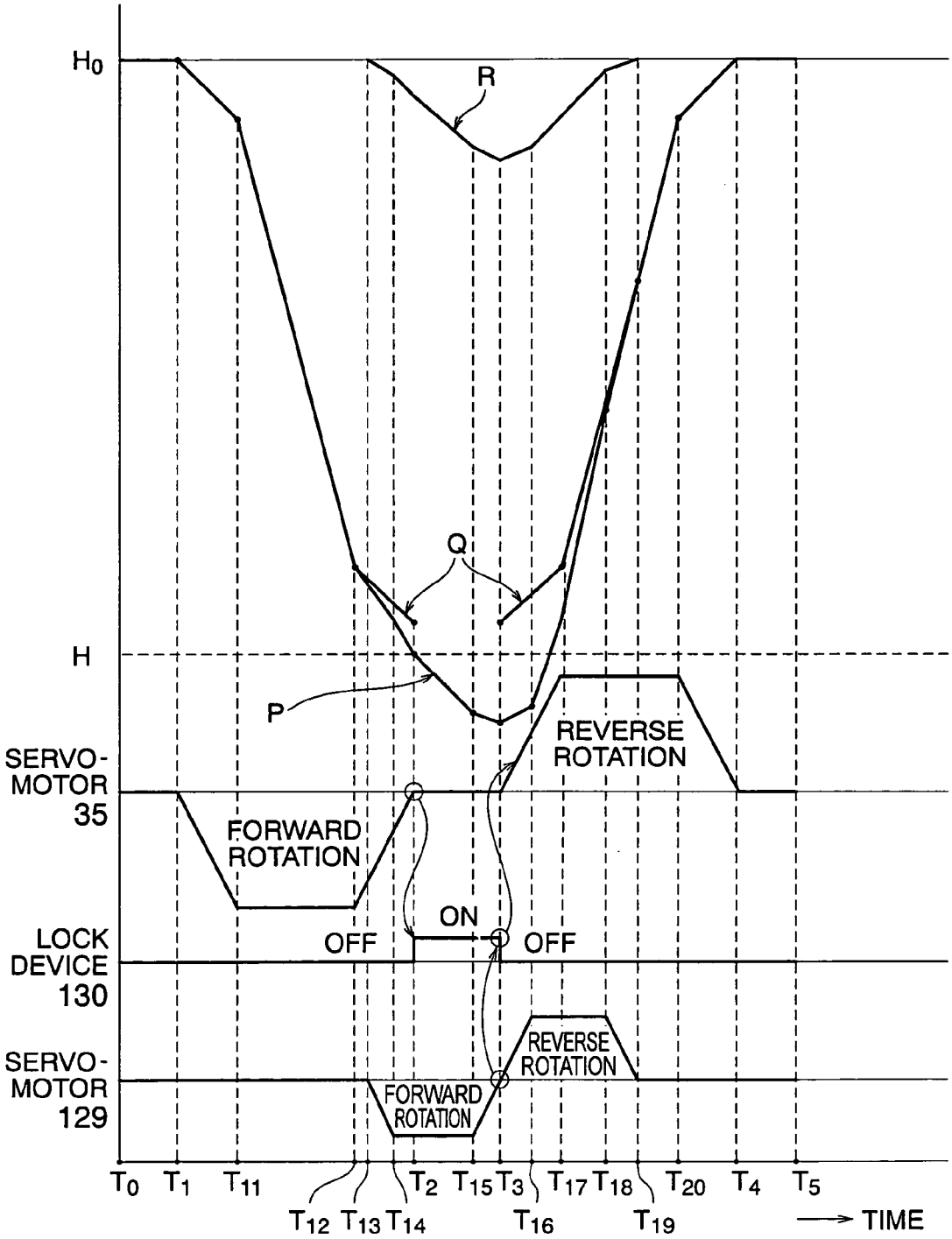
FIG. 7 is a cycle diagram corresponding to a second control method and a third control method.

FIG. 7 is a cycle diagram corresponding to the second control method and the third control method. A state shown in the figure is the same as the case of FIG. 6. However, in the case of FIG. 7, compared with the case of FIG. 6, the servomotor for pressing 129 is started at time T13 that is before the time T2 when the servomotor for fast feed 35 stops rotation. In addition, in the case shown in FIG. 7, the servomotor for pressing 129 already reaches a predetermined rotation state before the time T2 when the servomotor for fast feed 35 stops rotation.

At the time T2 when the servomotor for fast feed 35 stops rotation, the lock device 130 comes into the lock state and the pressing apparatus enters the press period (the machining stroke period) in which the servomotor for pressing 129 comes into the torque application mode and the work piece W is press-molded. As in the case of FIG. 6, at the time T3, the pushing member 91 reaches the lower limit falling position. Operations at the time T3 and the subsequent time are the same as the case of FIG. 6.

Note that, in FIG. 7, time T11 is time when the servomotor for fast feed 35 reaches a predetermined rotation state, time T12 is time when the servomotor for fast feed 35 comes into a brake state, time T13 is time when the servomotor for pressing 129 is started, time T14 is time when the servomotor for pressing reaches a predetermined rotation state, and time T15 is time when the servomotor for pressing 129 comes into a brake state. In addition, time T16 is time when the servomotor for pressing 129 reaches the predetermined rotation state in a reverse rotation direction, time T17 is time when the servomotor for fast feed 35 reaches the predetermined rotation state in a reverse rotation direction, time T18 is time when the servomotor for pressing 129 comes into the brake state, time T19 is time when the servomotor for pressing 129 reaches a rotation stop state, and time T20 is time when the servomotor for fast feed 35 comes into the brake state.

A curve Q shown in FIG. 7 represents fall and rise of the pushing member 91 only by the servomotor for fast feed 35 and a curve R represents fall and rise of the pushing member 91 only by the servomotor for pressing 129. In addition, a curve P represents fall and rise of the pushing member 91 according to a result of combining the curve Q and the curve R.

Here, an operation of the differential mechanism 80 will be explained. When the number of cycles reaches the number of times set in advance, the control device 100 applies a drive signal for rotating the servomotor for ball bearing position adjustment 88 by an angle set in advance to the servomotor for ball bearing position adjustment 88. Consequently, the differential cylinder 81 slightly rotates by a predetermined angle via the worm gear 85, the worm wheel 84, the intermediate gear 86, and the gear 87. According to the rotation of the differential cylinder 81 by the predetermined angle, the differential cylinder 81 is moved by a predetermined distance in an upward or downward direction with respect to the support plate 30 and the slider 50 is dislocated in the upward or downward direction by this predetermined distance.

After the slider 50 is dislocated in the upward or downward direction by the predetermined distance, the initial height H0 of the pushing member 91 changes by this predetermined distance. Thus, in an attempt to offset the predetermined distance to perform the fixed-stroke press operation, the control device 100 applies a correction control signal to the servomotor for fast feed 35 or the servomotor for pressing 129.

In a cycle of press working after the application of the correction control signal, the initial height H0 of the pushing member 91 is the same as that in a cycle of press working before the application of the correction control signal. However, a relative position of the ball grooves or the ball grooves of the ball screw section 41 to the balls inside the ball screw nut 52 fastened to the cylindrical axial section 127*a* formed in the worm wheel 127 of the slider moving mechanism 120 is different from the previous relative position in the machining mode by the servomotor for pressing 129. In other words, the relative position of the ball grooves or the ball grooves of the ball screw section to the balls inside the ball screw nut 52 changes. Therefore, it is possible to prevent local wear of the balls and the ball grooves. It is possible to change the relative position of the ball grooves or the ball grooves of the ball screw section 41 to the balls inside the ball screw nut 52 to prevent local wear of the balls inside the ball screw nut 52 and the ball grooves or the ball grooves of the ball thread groove 41 while performing fixed-stroke press operation. Thus, it is possible to hold the same accuracy of the press working as before and extend a life of the pressing apparatus.

Figure 8:
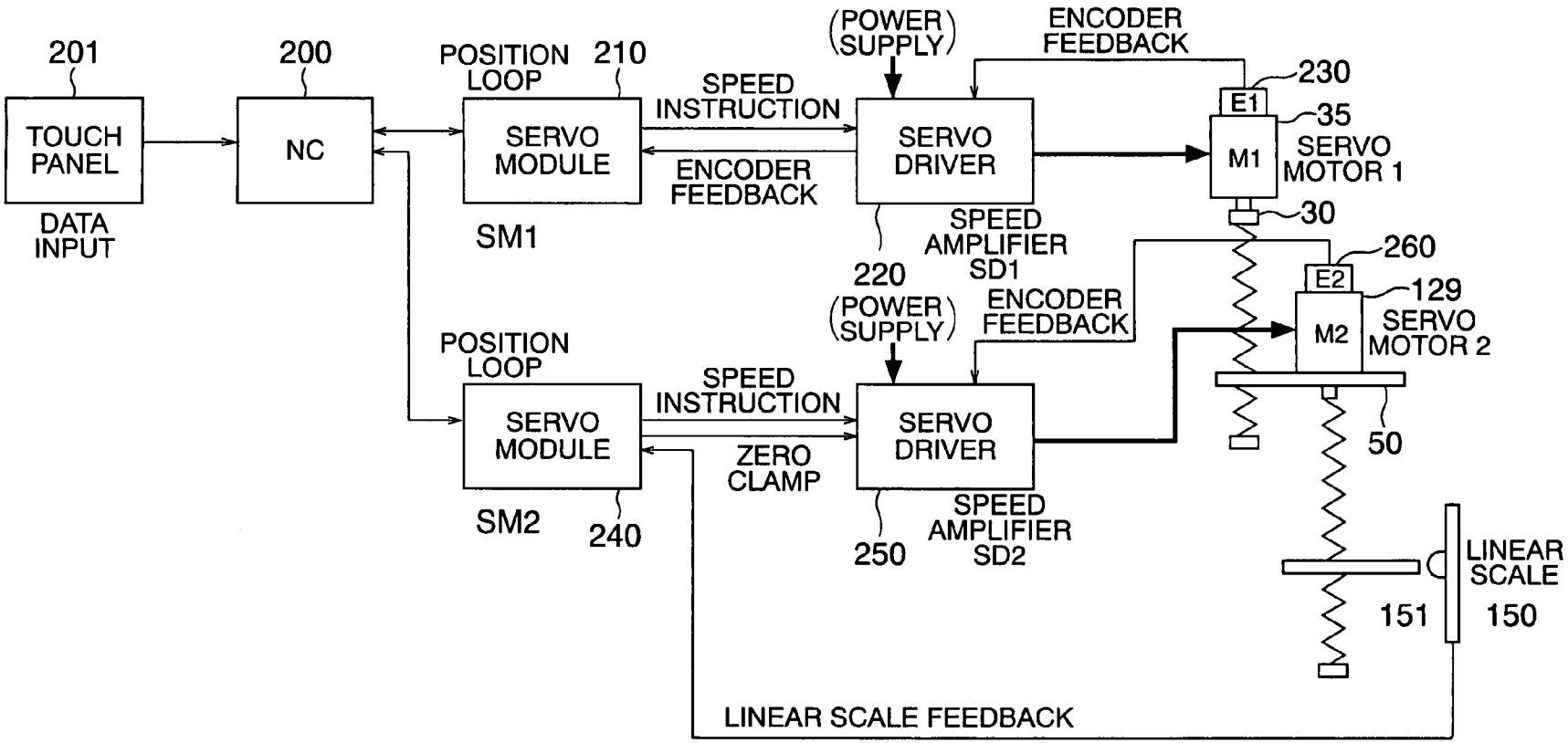
FIG. 8 is a diagram showing a structure of an embodiment of a control device shown in FIG. 1.

FIG. 8 shows a structure of an embodiment of the control device shown in FIG. 1. However, in FIG. 8, control for the lock device 130 and control for the differential mechanism 80 are not shown.

Reference numerals 30, 35, 50, 129, 150, and 151 in the figure correspond to those in FIG. 1. Reference numeral 200 denotes an NC (Numerical Control) device; 201, a touch panel; 210, servo module for the servomotor M#1 (the servomotor for fast feed 35) (SM#1); 220, a servo driver for the servomotor M#1 (the servomotor for fast feed 35) (SD#1); 230, an encoder measuring an amount of rotation for the servomotor M#1 (the servomotor for fast feed 35); 240, a servo module for the servomotor M#2 (the servomotor for pressing 129) (SM#2); 250, a servo driver for the servomotor M#2 (the servomotor for pressing 129) (SD#2); and 260, an encoder measuring an amount of rotation for the servomotor M#2 (the servomotor for pressing 129).

As described later, the servo module SM#1 (210) and the servo module SM#2 (240) are given desirable position patterns of operations by the servomotor M#1 (35) and the servomotor M#2 (129) corresponding the servo modules, respectively, and issue speed instructions to the servomotor M#1 (35) and the servomotor M#2 (129) under the control by the NC device 200.

In addition, as described later, the servo driver SD#1 (220) and the servo driver SD#2 (250) receives the speed instructions, respectively, and then receives encoder feedback signals from the encoder #1 (230) and the encoder #2 (260) corresponding to the servo drivers, respectively, to drive the servomotor M#1 (35) and the servomotor M#2 (129).

Note that, the servo module SM#2 (240) receives linear scale feedback signals from the pulse scale 150 and the position detector 151 shown in FIG. 1. As described later, the servo module SM#2 (240) issues a zero clamp signal and issues a speed instruction to the servo driver SD#2 (250) in a predetermined period. However, the servo driver SD#2 (250) sets the servomotor M#2 (129) in a zero clamp state in the predetermined period (although power is supplied to the servomotor M#2 (129), the servomotor M#2 (129) is clamped in a zero position so as not to rotate).

Figure 9:
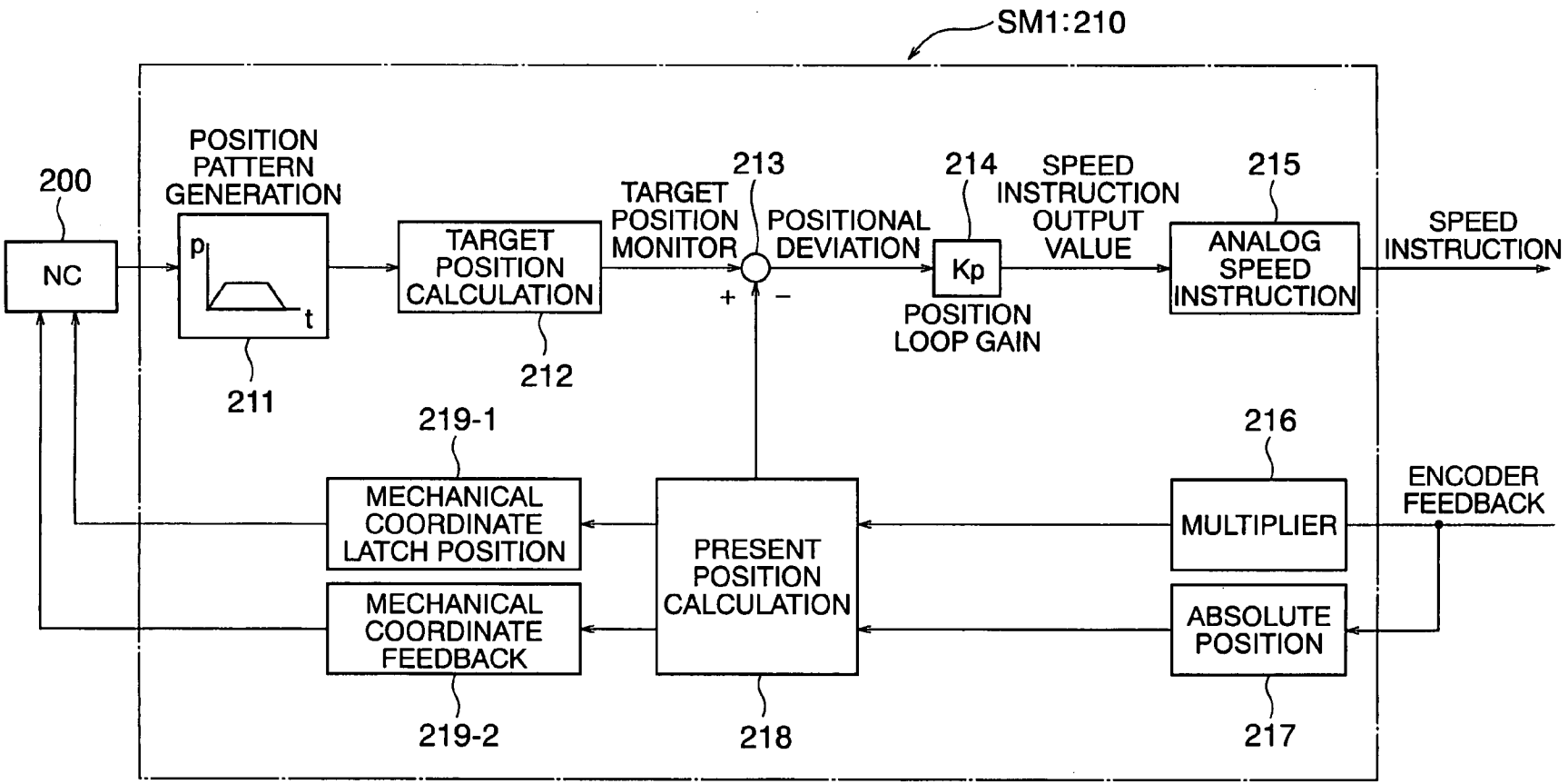
FIG. 9 is a detailed diagram of a servo module SM#1.

FIG. 9 is a detailed diagram of the servo module SM#1. Reference numeral 211 in the figure denotes a position pattern generating unit that gives a position pattern formed by the rotation of the servomotor M#1 (35); 212, a target position calculating unit that issues a target position monitor signal at every moment; 213, an adder; 214, a multiplier of a position loop gain KP that issues a speed instruction output value signal; and 215, an analog speed instructing unit that issues a speed instruction.

Reference numeral 216 denotes a multiplier that receives an encoder feedback signal (a pulse signal) from the encoder 230 shown in FIG. 8 and multiplies the encoder feedback signal and 217 denotes an absolute position detecting unit that accumulates encoder feedback signals and detects an absolute position generated by the rotation of the servomotor M#1 (35).

Reference numeral 218 denotes a present position calculating unit that calculates a present position of the servomotor M#1 (35) and supplies the present position to the adder 213. Reference numeral 219-1 denotes a machine coordinate latch position judging unit and 219-2 denotes a machine coordinate feedback generating unit.

In the servo module SM#1 (210), the analog speed instructing unit 215 issues a speed instruction according to a difference (a positional deviation) between the target position monitor signal, which is issued on the basis of the position pattern generating unit 211, and the present position, which is calculated in the present position calculating unit 218 on the basis of the encoder feedback signal from the encoder 230 shown in FIG. 8.

Figure 10:
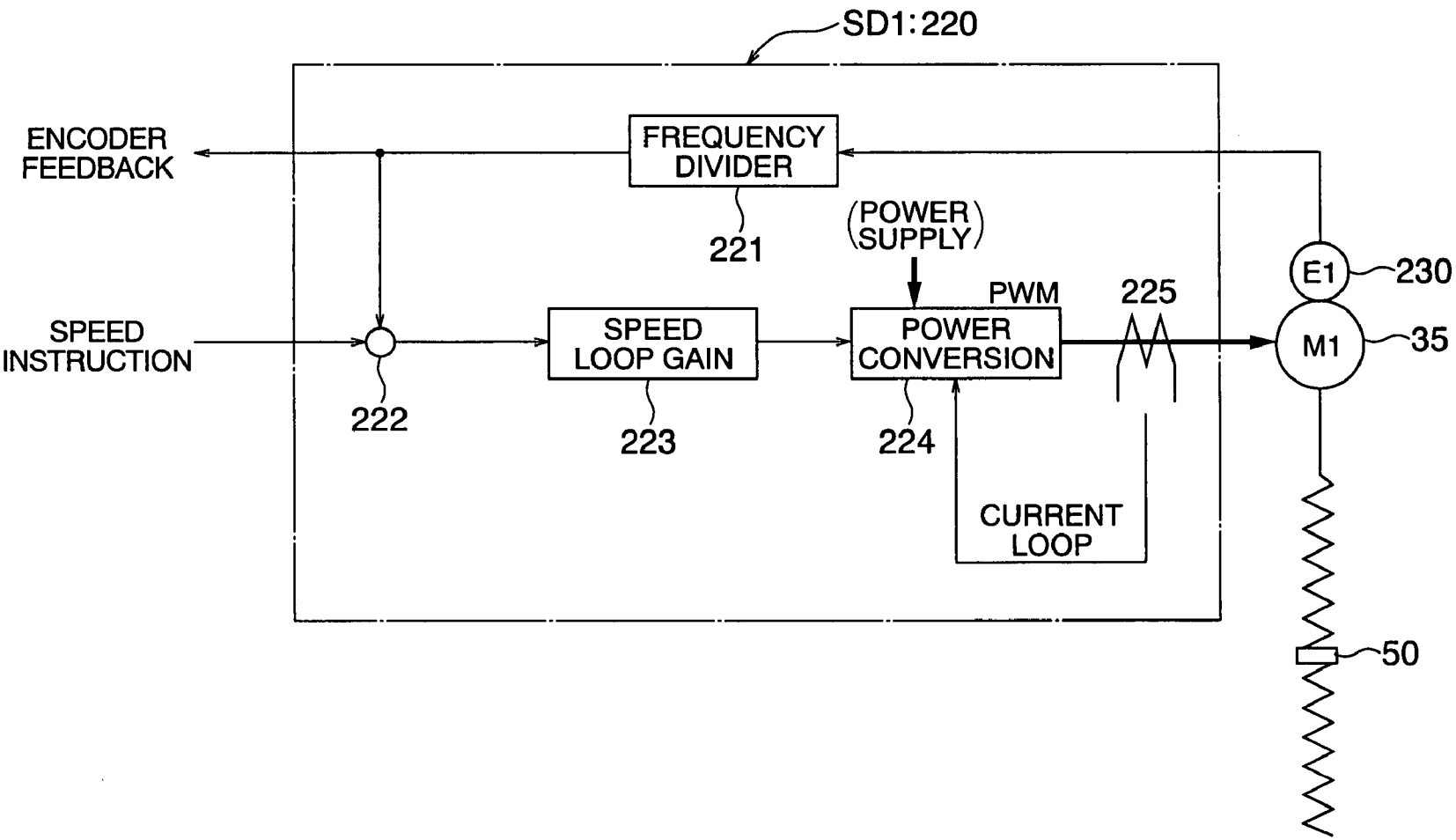
FIG. 10 is a detailed diagram of a servo driver SD#1.

FIG. 10 is a detailed diagram of the servo driver SD#1. Reference numerals 35, 50, and 230 correspond to those in FIG. 8. Reference numeral 221 denotes a frequency divider that divides a pulse from the encoder 230 and obtains an encoder feedback signal; 222, an adder; 223, a unit that gives a speed loop gain; 224, a power converting unit that supplies power such that the servomotor M#1 (35) rotates at desired velocity; and 225, a current detecting unit that detects a current value supplied to the servomotor M#1 (35) and feeds back the current value to the power converting unit 224.

The servo driver SD#1 (220) supplies the encoder feedback signal to the servo module SM#1 (210) shown in FIG. 8 and receives the speed instruction from the servo module SM#1 (210).

The adder 222 obtains a deviation between the encoder feedback signal obtained by the frequency divider 221 and the speed instruction, multiplies the deviation by the speed loop gain 223, and then drives the servomotor M#1 (35) via the power converting unit 224.

Figure 11:
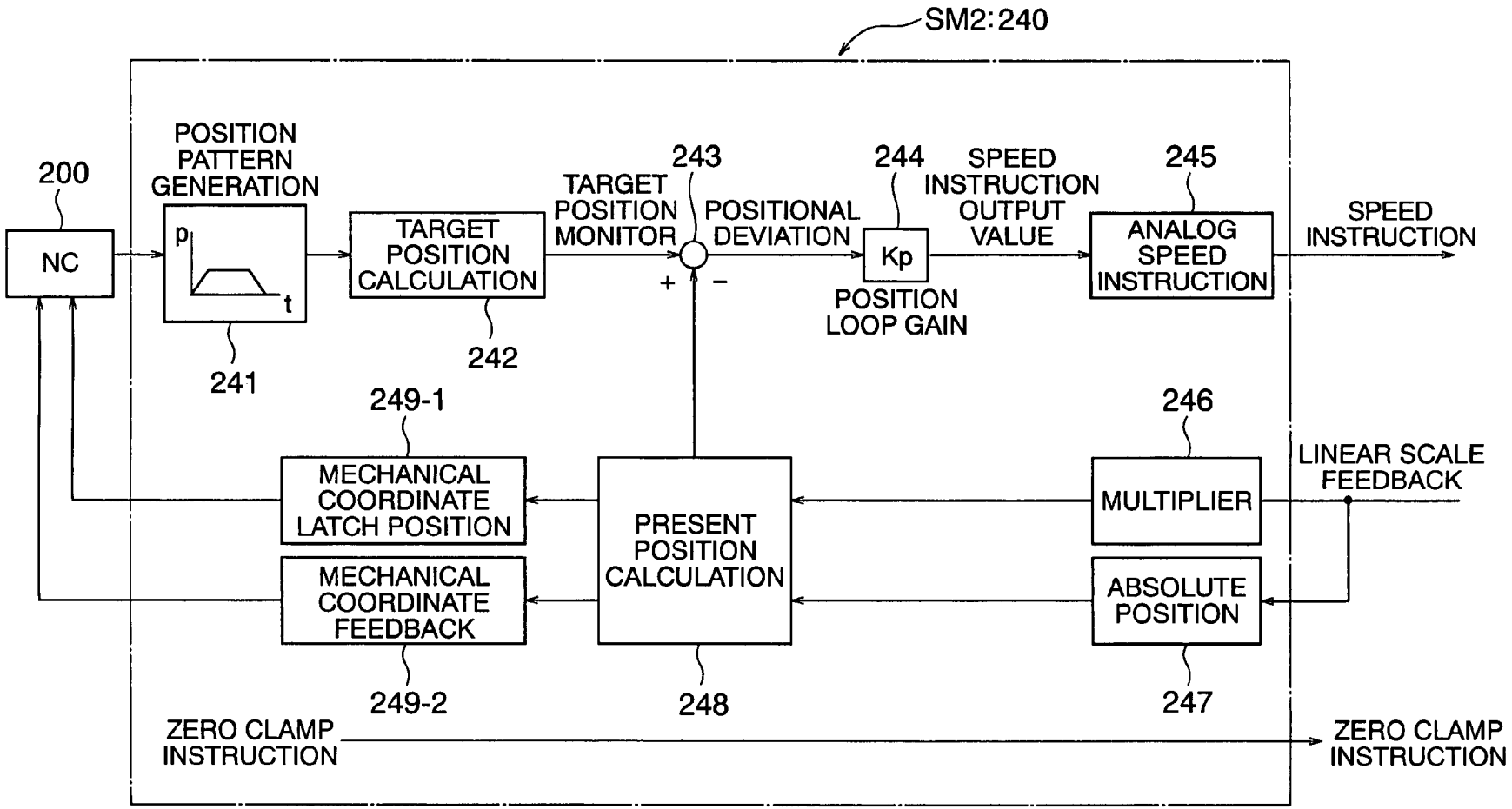
FIG. 11 is a detailed diagram of a servo module SM#2.

FIG. 11 is a detailed diagram of the serve module SM#2. Reference numerals 200 and 240 in the figure correspond to those in FIG. 8. Reference numeral 241 denotes a position pattern generating unit that gives a desirable position pattern according to the rotation of the servomotor M#2 (129); 242, a target position calculating unit that issues a target position monitor signal at every moment; 243*m*, an adder; 244, a multiplier for a position loop gain Kp that issues a speed instruction output value signal; and 245, an analog speed instructing unit that issues a speed instruction.

Reference numeral 246 is a multiplier that receives a linear scale feedback signal (a pulse signal) from the linear scale (the position detector) 151 and multiplies the linear scale feedback signal. Reference numeral 247 denotes an absolute position detecting unit that accumulates linear scale feedback signals and detects an absolute position generated by the movement of the slider 50 shown in FIG. 1.

Reference numeral 248 is a present position calculating unit that calculates a present position of the slider 50 and supplies the present position to the adder 243. Reference numeral 249-1 denotes a machine coordinate latch position judging unit and 249-2 denotes a machine coordinate feedback generating unit.

The servo module SM#2 (240) prepares a zero clamp signal and supplies the zero clamp signal to the servo driver SD#2 (250). As describe later with reference to FIG. 12, during a period in which the servo motor M#2 (129) is not in a started state, the zero clamp instruction applies power supply energy to the servomotor M#2 (129) but holds the servomotor M#2 (129) in a zero position (the servomotor M#2 (129) is applied with the power supply energy but is substantially put in a non-rotation state, that is, a state in which a forward rotation state and a reverse rotation state are repeated at extremely short time).

In the servo module SM#2 (240), the analog speed instructing unit 245 issues a speed instruction according to a difference (a positional deviation) between the target position monitor signal, which is issued on the basis of the position pattern generating unit 241, and the present position, which is calculated in the present position calculating unit 248 on the basis of the linear scale feedback signal from the linear scale (the position detector) 151 shown in FIG. 8.

Figure 12:
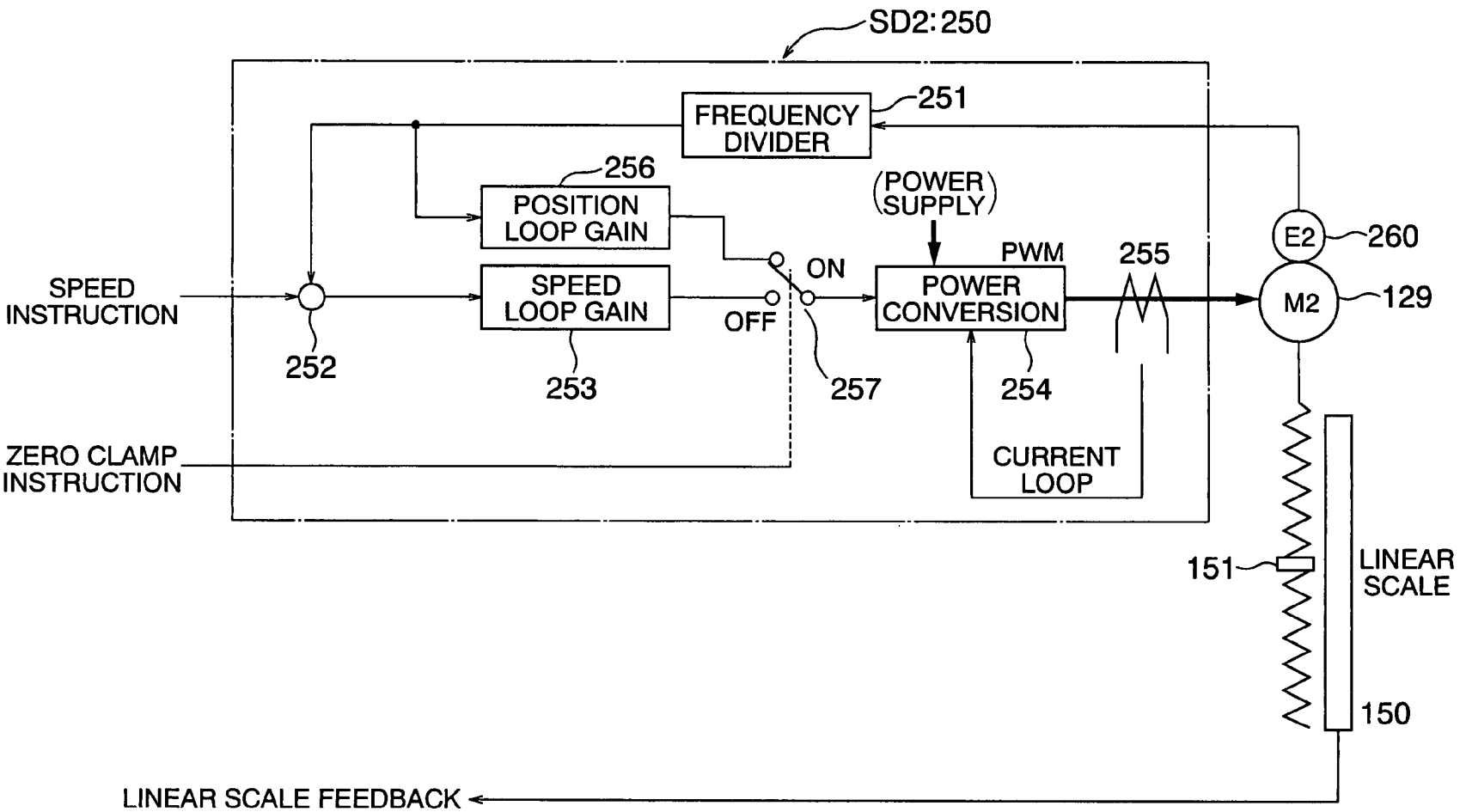
FIG. 12 is a detailed diagram of a servo driver SD#2.

FIG. 12 is a detailed diagram of the servo driver SD#2. Reference numerals 129, 150, 151, 250, and 260 correspond to those in FIG. 8. Reference numeral 251 denotes a frequency divider that divides a pulse from the encoder 260 and obtains an encoder feedback signal; 252, an adder; 253, a unit that gives a speed loop gain; 254, a power converting unit that supplies power such that the servomotor M#2 (129) rotates at a desired velocity; and 255, a current detecting unit that detects a current value supplied to the servomotor M#2 (129) and feeds back the current value to the power converting unit 254.

Reference numeral 256 denotes a unit that gives a position loop gain. Reference numeral 257 denotes a signal switch (which is shown as a form of a mechanical switch but is actually constituted by an electronic circuit). The signal switch 257 switches a signal supplied to the power converting unit 254 from a "position instruction" signal to a "speed instruction" signal on the basis of a zero clamp signal (instruction).

In FIG. 12, operations of the frequency divider 251, the adder 252, and the speed loop gain 253 are the same as the operations of the frequency divider 221, the adder 222, and the speed loop gain 223 shown in FIG. 10. An output signal from the speed loop gain 253 is a signal for obtaining a velocity proportionate to a velocity, at which the servomotor M#2 (129) should rotate, in association with a deviation between the speed instruction from the analog speed instructing unit 245 shown in FIG. 11 and the encoder feedback signal from the frequency divider 251 shown in FIG. 12. After the signal switch 257 is switched (after the signal switch 257 is switched to the side of an OFF position shown in the figure) according to the zero clamp instruction, the output signal from the speed loop gain 253 is supplied to the power converting unit 254. In other words, after the servomotor M#2 (129) is instructed to act to move (lower or lift) the slider 50 shown in FIG. 1, the servomotor M#2 (129) enters control for complying with the position pattern generating unit 241 shown in FIG. 11.

However, in the servo driver 250, during a period until the signal switch 257 is switched according to the zero clamp signal (instruction), the signal switch 257 is placed in an ON position shown in the figure and the power converting unit 254 receives the output signal from the position loop gain 256 to operate the servomotor M#2 (129). In other words, when it is assumed that the servomotor M#2 slightly rotates forward and the encoder 260 outputs generation of the forward rotation state of the servomotor M#2, the power converting unit 254 operates the servomotor M#2 such that the servomotor M#2 slightly rotates reversely to cancel the forward rotation of the servomotor M#2. In other words, the servomotor M#2 (129) is supplied with power supply energy but is controlled to keep a so-called zero position. Further, the servomotor M#2 (129) applies a brake such that the ball screw nut 52 shown in FIG. 1 does not move rotationally undesirably during this period. The ball screw nut 52 is allowed to move rotationally relatively to the screw shaft 40 for the first time in a stage in which the signal switch 257 is switched and the power converting unit 254 receives a signal from the speed loop gain 253 side.

Note that, importantly, when the servomotor M#1 (35) is started under the control from the NC device 200 shown in FIG. 8, the linear scale (the position detector) 151 detects fall of the slider 50. A target position monitor signal (a target position monitor signal of the servomotor M#2 (129)) outputted from the position pattern generating unit 241 shown in FIG. 11 is also outputted under the control of the NC device 200. However, a target position of the servomotor M#2 should maintain the zero position until the signal switch 257 is switched according to the zero clamp signal (instruction). This shift of control is sequentially or collectively corrected during the zero clamp. Then, the servomotor M#2 is started correctly, so to speak, the zero position at a point when the signal switch 257 is switched to the speed instruction side.

FIGS. 13 to 17 show a modification of the control device shown in FIGS. 8 to 12. The control device shown in FIGS. 13 to 17 is generally different from the control device shown in FIGS. 8 to 12 in the following points.

In FIGS. 8 to 12, the control device calculates deviations between target positions for both the servomotor for fast feed 35 and the servomotor for pressing 129 based on the position pattern generating units 211 and 241 during machining and present positions from the present position calculating units 218 and 248 shown in the figure and drives both the servomotors on the basis of the deviation. In other words, the control device performs press working while performing feedback control.

On the other hand, in FIGS. 13 to 17, in performing press working, prior to a real machining stage in which real machining is performed, the control device acquires the target position information in the real machining stage by performing so-called teaching (which is referred to as teaching stage). In other words in the real machining stage, the control device performs the press working in, so to speak, feed forward control based on the target position information acquired in the teaching state without performing the feedback control.

Note that it is needless to mention that, in performing the press working, it is desired that the slider 50 shown in FIG. 1 is lowered while precisely keeping a horizontal state at every moment in the press working. In particular, it is important to prepare plural sets of servomotors for fast feed and servomotors for pressing and, when the single slider 50 is lowered, cause the slider 50 to keep the horizontal state.

However, in the press working, a reaction generated from a work piece changes at every moment during the press working in association with a shape of the work piece. A form of desirable drive control for, in particular, the servomotor for pressing 129 is different between the case in which the press working is performed extremely slowly and the case in which the press working is performed rapidly.

Therefore, in the teaching stage, the control device performs the press working extremely slowly to acquire information on condition that the slider 50 is kept horizontally in a first step. Next, the control device increases machining speed of the press working to acquire information on condition that the slider 50 is kept horizontally after taking into account the acquired information. While repeating such teaching, the control device acquires information that makes it possible to keep the slider 50 strictly horizontally at machining speed proportionate to the real machining stage. Keeping such acquired information proportionate to the real machining stage, the press working in the real machining stage is executed without feedback control on the basis of the acquired information. However, as required, it is likely that a desirable position of the slider 50 and a present actual position of the slider 50 is different exceeding a threshold value due to some cause during the press working in the real machining stage. It is desired to prepare an error detecting unit.

Figure 13:
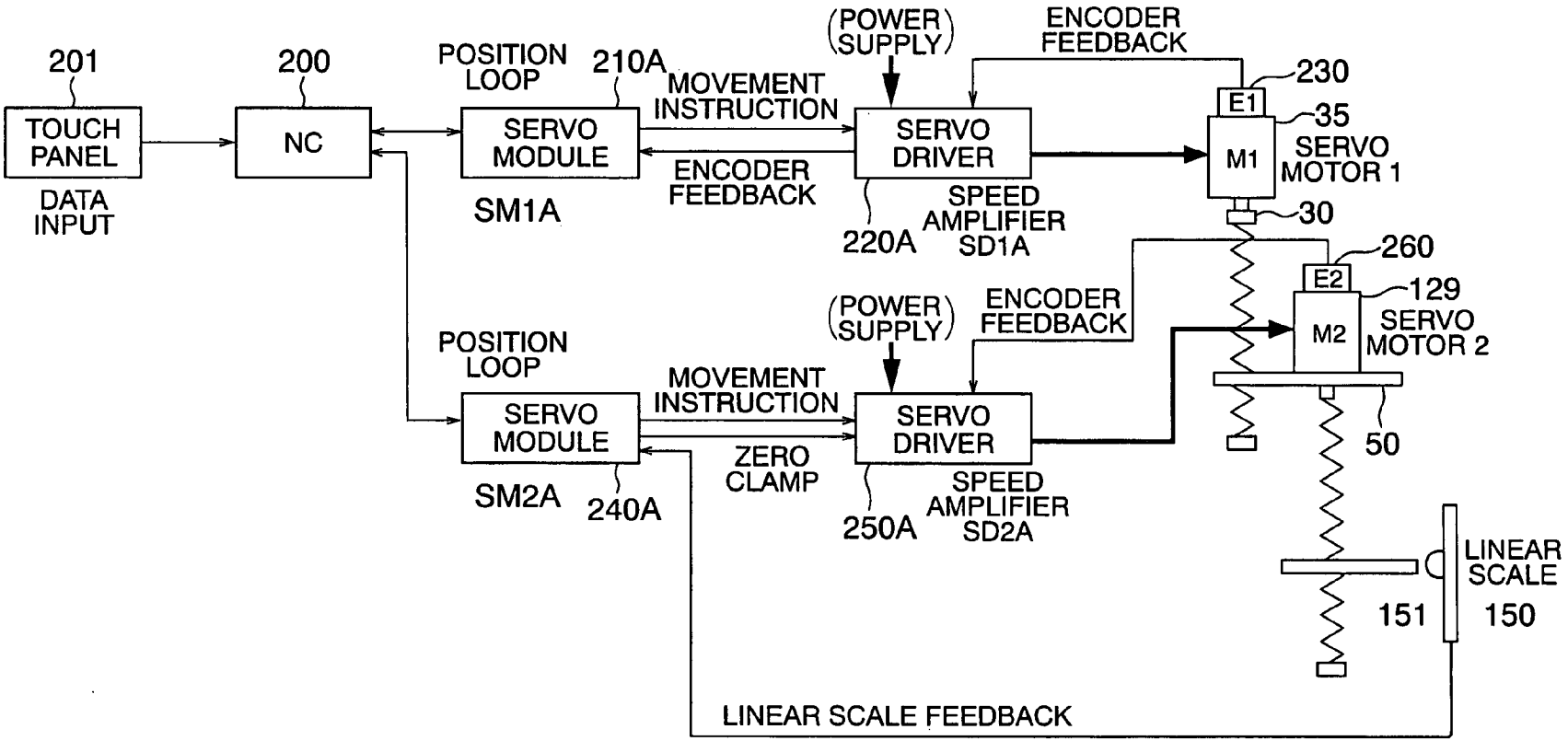
FIG. 13 is a diagram showing a structure of another embodiment of the control device shown in FIG. 1.

FIG. 13 shows a structure of another embodiment of the control device shown in FIG. 1. However, in FIG. 13, again, control for the lock device 130 and control for the differential mechanism 80 are not shown in the figure.

Reference numerals 30, 35, 50, 129, 150, and 151 in the figure correspond to those in FIG. 1. Reference numeral 200 denotes an NC (Numerical Control) device; 201, a touch panel; 210A, servo module for the servomotor M#1 (the servomotor for fast feed 35) (SM#1A); 220A, a servo driver for the servomotor M#1 (the servomotor for fast feed 35) (SD#1A); 230, an encoder measuring an amount of rotation for the servomotor M#1 (the servomotor for fast feed 35); 240A, a servo module for the servomotor M#2 (the servomotor for pressing 129) (SM#2A); 250A, a servo driver for the servomotor M#2 (the servomotor for pressing 129) (SD#2A); and 260, an encoder measuring an amount of rotation for the servomotor M#2 (the servomotor for pressing 129).

As described later, the servo module SM#1A (210A) and the servo module SM#2A (240A) are given desirable position patterns of operations by the servomotor M#1 (35) and the servomotor M#2 (129) corresponding the servo modules, respectively, and issue speed instructions to the servomotor M#1 (35) and the servomotor M#2 (129) under the control by the NC device 200.

In addition, as described later, the servo driver SD#1A (220A) and the servo driver SD#2A (250A) receives the speed instructions, respectively, and then receives encoder feedback signals from the encoder #1 (230) and the encoder #2 (260) corresponding to the servo drivers, respectively, to drive the servomotor M#1 (35) and the servomotor M#2 (129).

Note that, the servo module SM#2A (240A) receives linear scale feedback signals from the pulse scale 150 and the position detector 151 shown in FIG. 1. As described later, the servo module SM#2A (240A) issues a zero clamp signal and issues a speed instruction to the servo driver SD#2A (250A) in a predetermined period. However, the servo driver SD#2A (250A) sets the servomotor M#2 (129) in a zero clamp state in the predetermined period (although power is supplied to the servomotor M#2 (129), the servomotor M#2 (129) is clamped in a zero position so as not to rotate).

Figure 14:
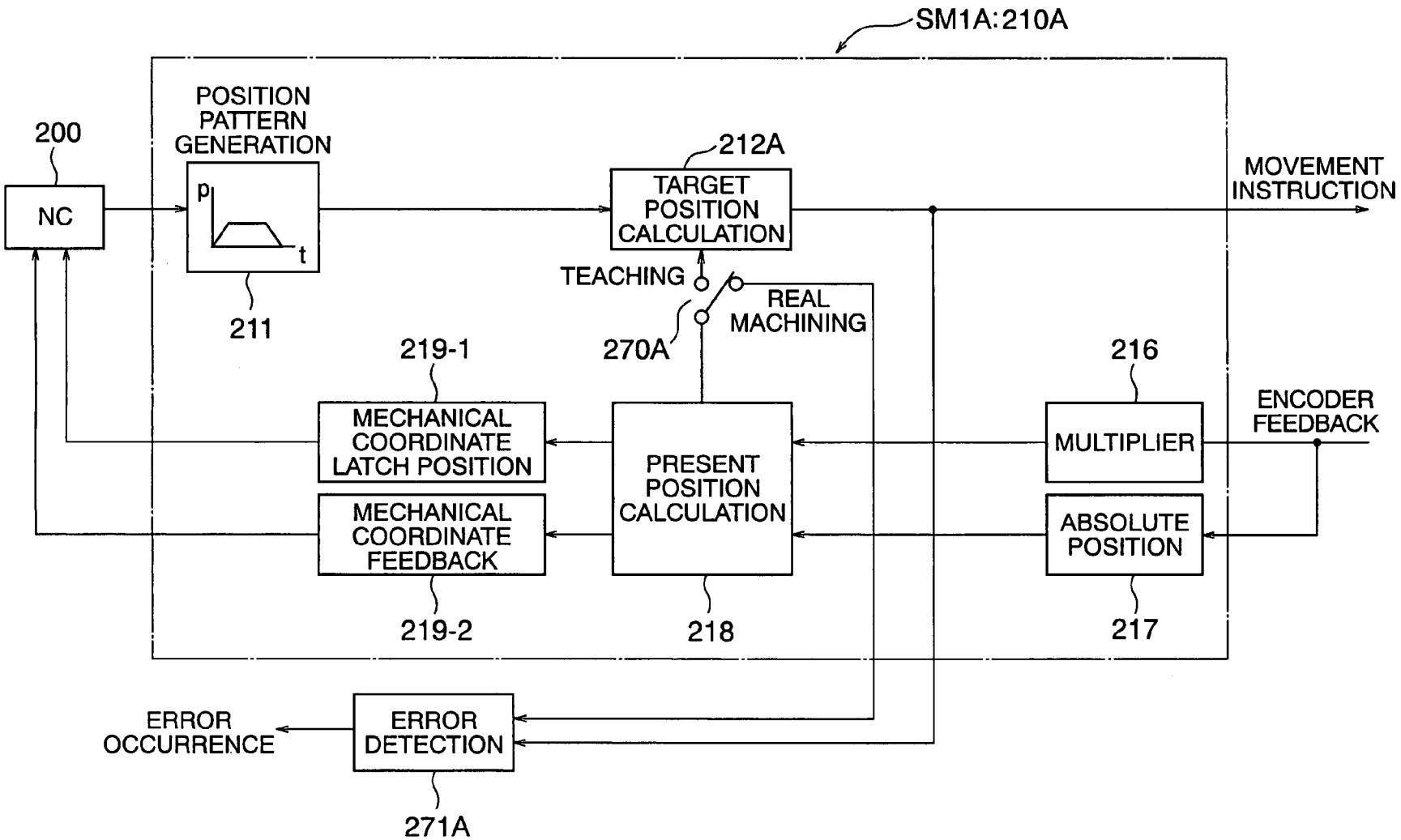
FIG. 14 is a detailed diagram of a servo module SM#1A.

FIG. 14 is a detailed diagram of the servo module SM#1A. Reference numeral 211 in the figure denotes a position pattern generating unit that gives a position pattern formed by the rotation of the servomotor M#1 (35); 212A, a target position calculating unit that issues a movement instruction in association with a target position at every moment.

Reference numeral 216 denotes a multiplier that receives an encoder feedback signal (a pulse signal) from the encoder 230 shown in FIG. 13 and multiplies the encoder feedback signal and 217 denotes an absolute position detecting unit that accumulates encoder feedback signals and detects an absolute position generated by the rotation of the servomotor M#1 (35).

Reference numeral 218 denotes a present position calculating unit that calculates a present position of the servomotor M#1 (35). Reference numeral 219-1 denotes a machine coordinate latch position judging unit and 219-2 denotes a machine coordinate feedback generating unit.

Reference numeral 270A denotes a switching unit that is shown in the figure in a form of a mechanical switch. The switching unit 270A performs switching such that the present position information calculated in the present position calculating unit 218 is supplied to the target position calculating unit 212A in a so-called teaching stage before real press working is performed and the present position information is supplied to an error detecting unit 271A described later in a real machining stage in which the real press working is performed. Note that the switching is instructed by the NC (Numerical Control) device 200 corresponding to the control device 100 shown in FIG. 1.

Reference numeral 271A denotes an error detecting unit that issues an error occurrence signal and warns a user when some abnormal state occurs in the real machining stage and a positional deviation exceeding a threshold value occurs between a value of present position information corresponding to a movement instruction from the target position calculating unit 212A (instructed present target position information) and a value of actual present position information that is obtained from the present position calculating unit 218 on the basis of an encoder feedback position.

The target position calculating unit 212A shown in FIG. 14 operates as described below.

In the teaching stage, the target position calculating unit 212A receives the actual present position information from the present position calculating unit 218 as described before. Then, the target position calculating unit 212A extracts a deviation between a value of the instructed present target position information at every moment supplied from the position pattern generating unit 211 and a value of the actual present position information from the present position calculating unit 218 to hold the deviation (a series of deviation values held by the target position calculating unit 212A is referred to as held deviation information) and issues a movement instruction in a form corresponding to the deviation.

On the other hand, in the real machining stage, the target position calculating unit 212A reads out the held deviation information, which is acquired and held in the teaching stage, according to progress of the machining, considers the held deviation information, and changes the held deviation information to a movement instruction.

Figure 15:
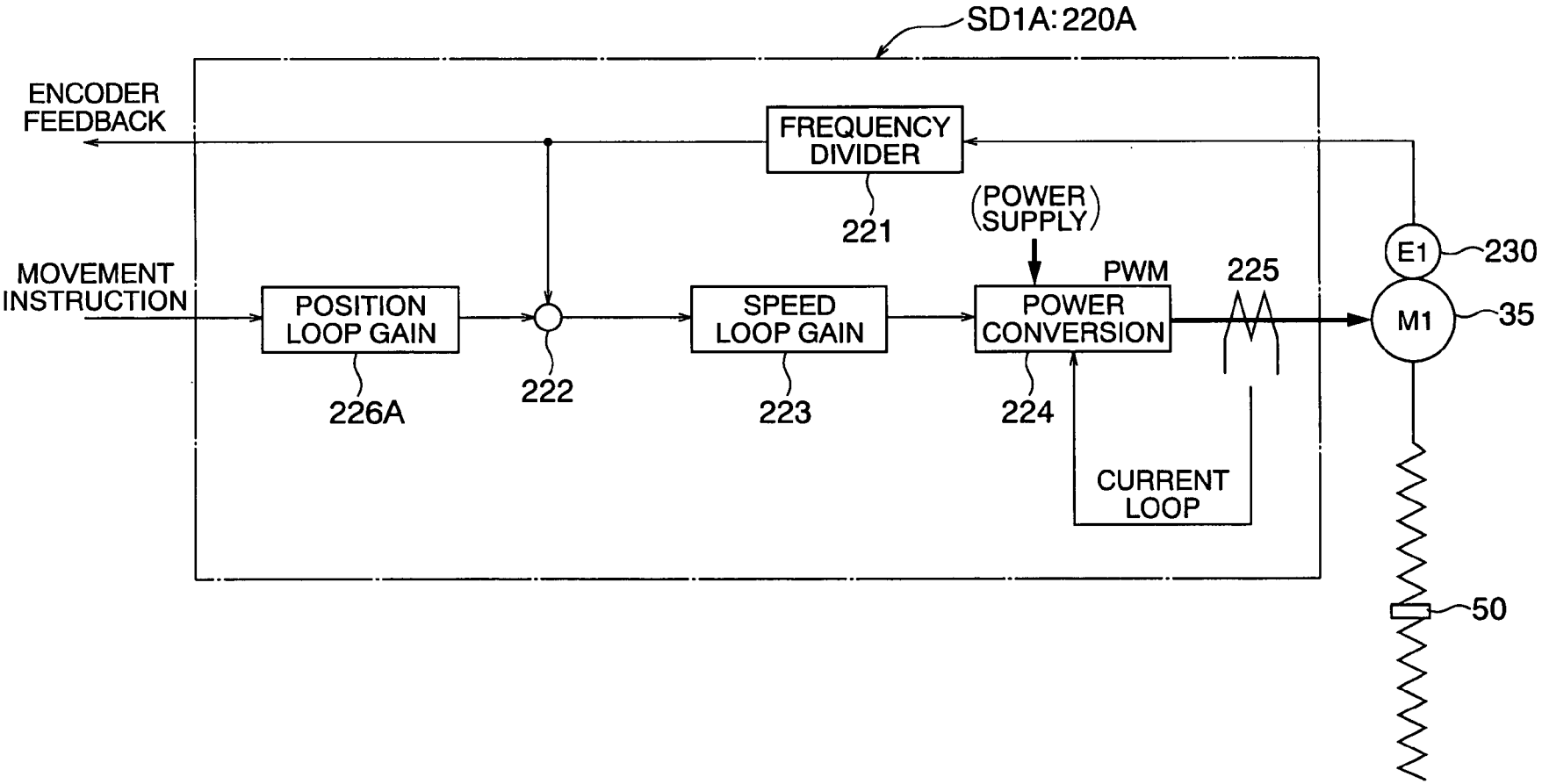
FIG. 15 is a detailed diagram of a servo driver SD#1A.

FIG. 15 is a detailed diagram of the servo driver SD#1A. Reference numerals 35, 50, and 230 correspond to those in FIG. 13. Reference numeral 221 denotes a frequency divider that divides a pulse from the encoder 230 and obtains an encoder feedback signal; 222, an adder; 223, a unit that gives a speed loop gain; 224, a power converting unit that supplies power such that the servomotor M#1 (35) rotates at a desired velocity; 225, a current detecting unit that detects a current value supplied to the servomotor M#1 (35) and feeds back the current value to the power converting unit 224; and 226A is a unit that gives a position loop gain.

The servo driver SD#1A (220A) supplies the encoder feedback signal to the servo module SM#1A (210A) shown in FIG. 13 and receives the movement instruction from the servo module SM#1A (210A). The unit 226A multiplies the movement instruction by the position loop gain.

Since an operation of the servo driver SD#1A shown in FIG. 15 is basically the same as that shown in FIG. 10, an explanation of the operation is omitted.

Figure 16:
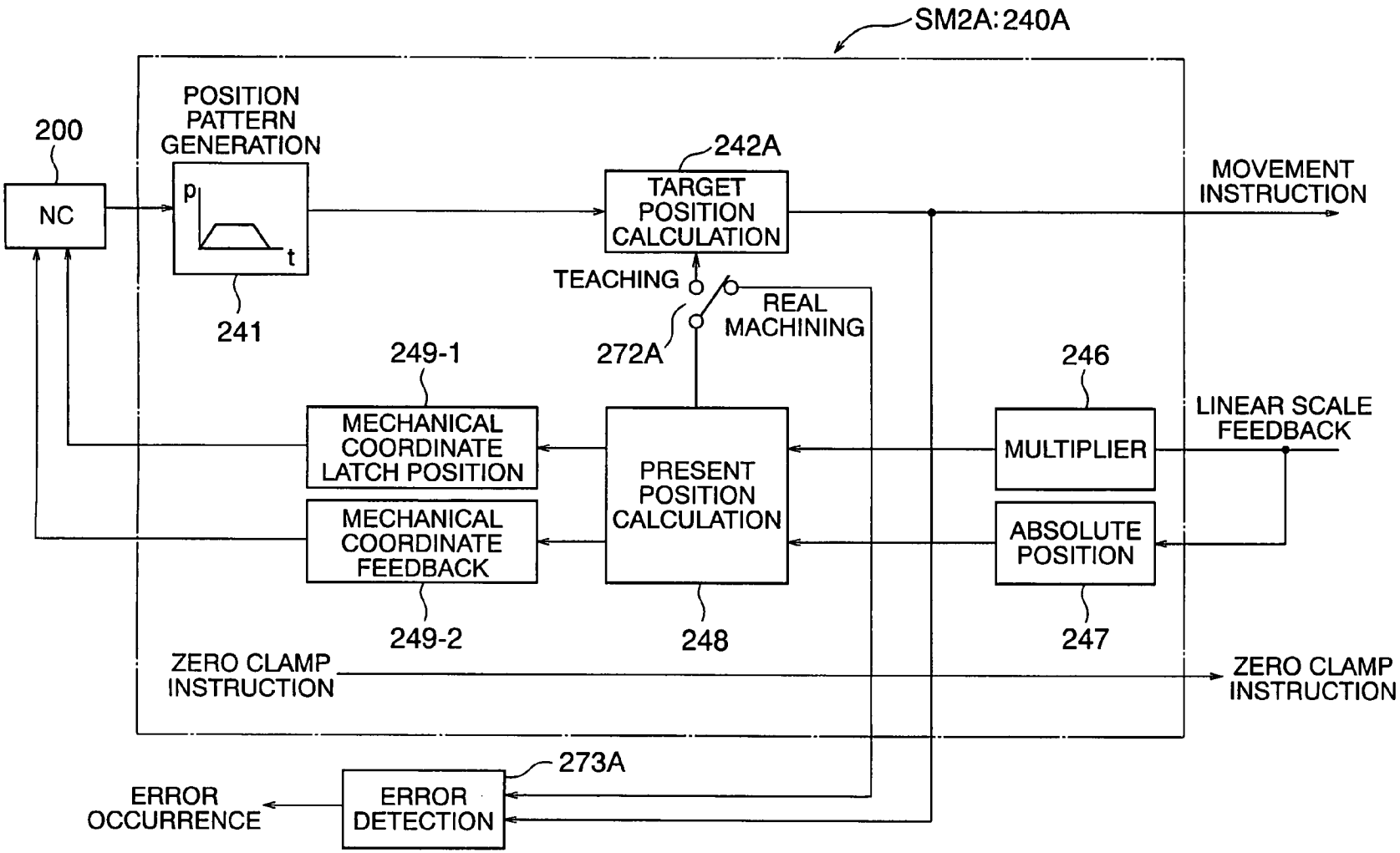
FIG. 16 is a detailed diagram of a servo module SM#2A.

FIG. 16 is a detailed diagram of the servo module SM#2A. Reference numeral 200 in the figure corresponds to that in FIG. 13. Reference numeral 241 denotes a position pattern generating unit that gives a position pattern according to the rotation of the servomotor M#2 (129). Reference numeral 242A denotes a target position calculating unit that issues a movement instruction at every moment.

Reference numeral 246 is a unit that receives a linear scale feedback signal (a pulse signal) from the linear scale (the position detector) 151 shown in FIG. 13 and multiplies the linear scale feedback signal. Reference numeral 247 denotes an absolute position detecting unit that accumulates linear scale feedback signals and detects an absolute position generated by the movement of the slider 50 shown in FIG. 1.

Reference numeral 248 is a present position calculating unit that calculates a present position of the slider 50. Reference numeral 249-1 denotes a machine coordinate latch position judging unit and 249-2 denotes a machine coordinate feedback generating unit.

Reference numeral 272A denotes a switching unit that is shown in the figure in a form of a mechanical switch. The switching unit 270A performs switching such that the present position information calculated in the present position calculating unit 248 is supplied to the target position calculating unit 242A in a so-called teaching stage before real press working is performed and the present position information is supplied to an error detecting unit 273A described later in a real machining stage in which the real press working is performed. Note that the switching is instructed by the NC (Numerical Control) device 200 corresponding to the control device 100 shown in FIG. 1.

Reference numeral 273A denotes an error detecting unit that issues an error occurrence signal and warns a user when some abnormal state occurs in the real machining stage and a positional deviation exceeding a threshold value occurs between a value of present position information corresponding to a movement instruction from the target position calculating unit 242A (instructed present target position information) and a value of actual present position information that is obtained from the present position calculating unit 248 on the basis of an encoder feedback position.

The target position calculating unit 242A shown in FIG. 16 operates as described below.

In the teaching stage, the target position calculating unit 242A receives the actual present position information from the present position calculating unit 248 as described before. Then, the target position calculating unit 242A extracts a deviation between a value of the present target position information at every moment supplied from the position pattern generating unit 241 and a value of the actual present position information from the present position calculating unit 248 to hold the deviation (a series of deviation values held by the target position calculating unit 242A is referred to as held deviation information) and issues a movement instruction in a form corresponding to the deviation.

On the other hand, in the real machining stage, the target position calculating unit 242A reads out the held deviation information, which is acquired and held in the teaching stage, according to progress of the machining and changes the held deviation information to a movement instruction.

The servo module SM#2A (240A) prepares a zero clamp signal and supplies the zero clamp signal to the servo driver SD#2A (250A). As describe later with reference to FIG. 17, during a period in which the servo motor M#2 (129) is not in a started state, the zero clamp instruction applies power supply energy to the servomotor M#2 (129) but holds the servomotor M#2 (129) in a zero position (the servomotor M#2 (129) is applied with the power supply energy but is substantially put in a non-rotation state, that is, a state in which a forward rotation state and a reverse rotation state are repeated at extremely short time).

The servo module SM#2A (240A) issues a movement instruction to the servo module SM#2A according to a difference (a positional deviation) between the present position, which is issued on the basis of the position pattern generating unit 241, and the actual present position, which is calculated in the present position calculating unit 248 on the basis of the linear scale feedback signal from the linear scale (the position detector) 151 shown in FIG. 8. During that period, the servo module SM#2A acquires and saves the positional deviation on, for example, a memory and uses the positional deviation when a movement instruction is issued in the real machining stage. In addition, the servo module SM#2A is adopted to issue an error occurrence signal from the error detecting unit 273A when undesired positional deviation which may occur because of some cause in the real machining stage.

Figure 17:
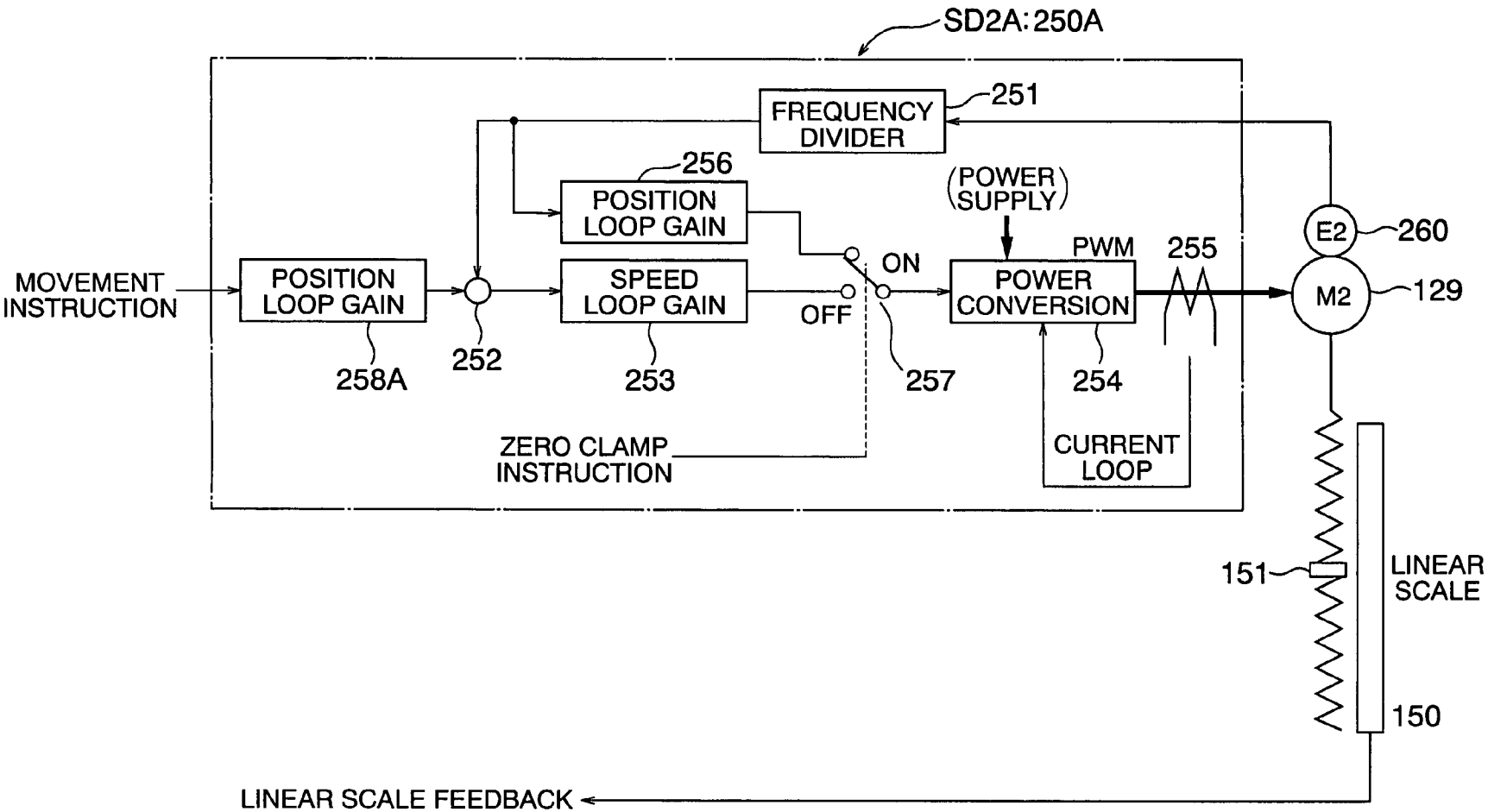
FIG. 17 is a detailed diagram of a servo driver SD#2A.

FIG. 17 is a detailed diagram of the servo driver SD#2A. Reference numerals 129, 150, 151, 250A, and 260 correspond to those in FIG. 13. Reference numeral 251 denotes a frequency divider that divides a pulse from the encoder 260 and obtains an encoder feedback signal; 252, an adder; 253, a unit that gives a speed loop gain; 254, a power converting unit that supplies power such that the servomotor M#2 (129) rotates at a desired velocity; and 255, a current detecting unit that detects a current value supplied to the servomotor M#2 (129) and feeds back the current value to the power converting unit 254.

Reference numeral 256 denotes a unit that gives a position loop gain. Reference numeral 257 denotes a signal switch (which is shown as a form of a mechanical switch but is actually constituted by an electronic circuit). The signal switch 257 switches a signal supplied to the power converting unit 254 from a "position instruction" signal to a "speed instruction" signal on the basis of a zero clamp signal (instruction).

Since an operation of the servo driver SD#2A shown in FIG. 17 is basically the same as that shown in FIG. 12, an explanation of the operation is omitted.

Note that, importantly, when the servomotor M#1 (35) is started under the control from the NC device 200 shown in FIG. 13, the linear scale (the position detector) 151 detects fall of the slider 50. A target position monitor signal (a target position monitor signal of the servomotor M#2 (129)) outputted from the position pattern generating unit 241 shown in FIG. 16 is also outputted under the control of the NC device 200. However, a target position of the servomotor M#2 should maintain the zero position until the signal switch 257 is switched according to the zero clamp signal (instruction). This shift of control is sequentially or collectively corrected during the zero clamp. Then, the servomotor M#2 is started correctly, so to speak, the zero position at a point when the signal switch 257 is switched to the speed instruction side.

Figure 4:
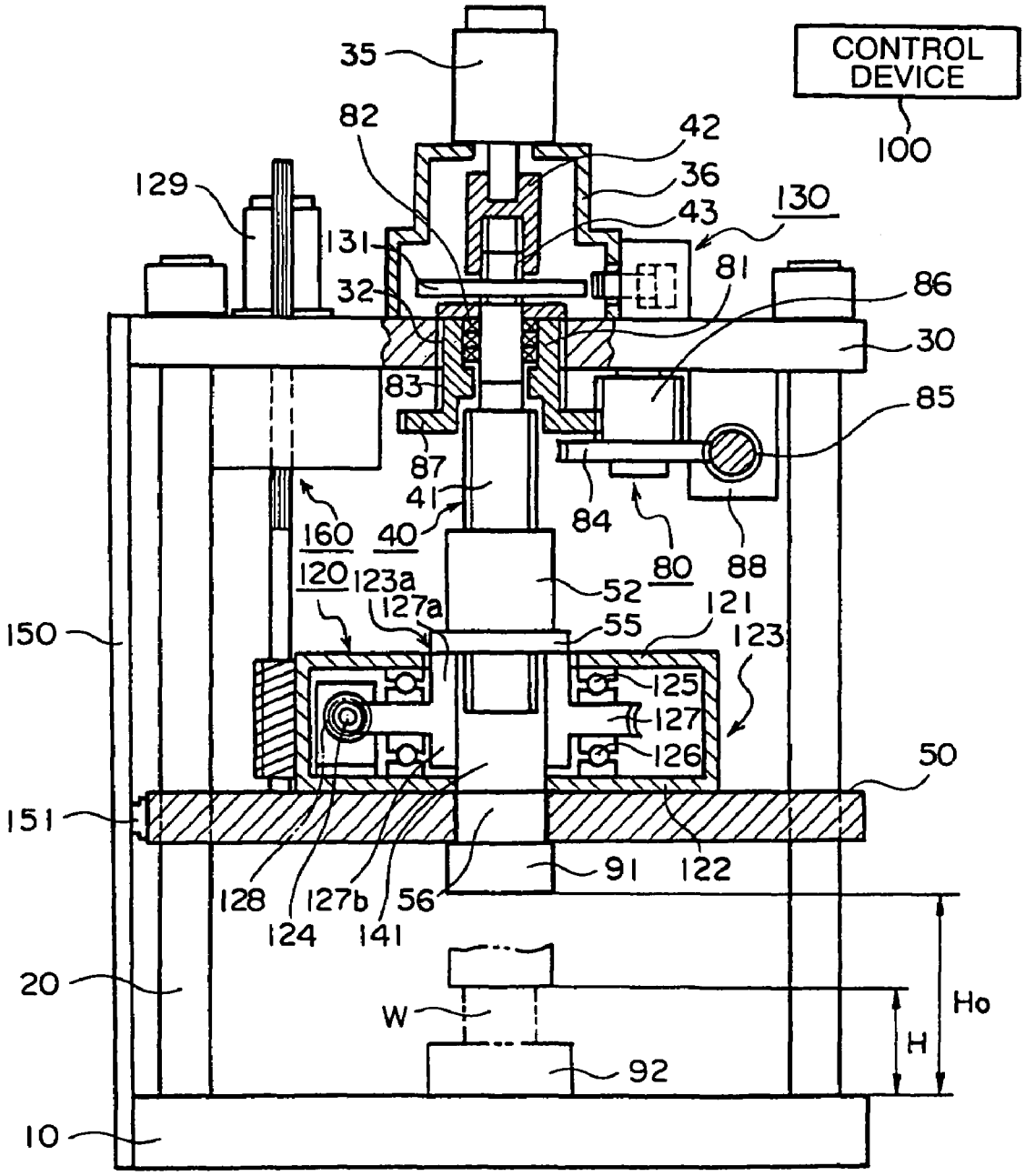
FIG. 4 is a front view of another embodiment in which a part of the main part of the pressing apparatus according to the invention is shown in section.

FIG. 4 is a front view of another embodiment of a part of a main part of the pressing apparatus according to the invention in section.

The pressing apparatus according to the invention shown in FIG. 4 has basically the same structure as that shown in FIG. 1.

The pressing apparatus shown in FIG. 4 is different from the pressing apparatus shown in FIG. 1 in the following two points. The servomotor for pressing 129 is arranged on the support plate 30. Since the servomotor for pressing 129 is arranged on the support plate 30, an axial direction of a rotation shaft of the servomotor for pressing 129 in a vertical direction with respect to the support plate 30 is set to an axial direction of the input shaft 124 of the slider moving mechanism 120. In addition, a axis changing mechanism 160, which transmits a rotation torque of the servomotor for pressing 129 to the input shaft 124 of the slider moving mechanism 120, is provided anew.

Since the structure and the operation of the pressing apparatus in FIG. 4 are the same as those in FIG. 1 except the two differences described above, explanations of the structure and the operation are omitted. Since the servomotor for pressing 129, which is heavy in the structure, is arranged on the support plate 30, a weight of the slider 50 is reduced and an inertia thereof is small compared with the case in which the servomotor for pressing 129 is arranged in the slider 50. Thus, when the slider 50 is moved to control a position of the slider 50, only a small torque is enough. Therefore, it is possible to stop and start the slider 50 rapidly and reduce time required for one cycle of press working. In other words, it is possible to improve efficiency of the pressing apparatus.

Figure 5:
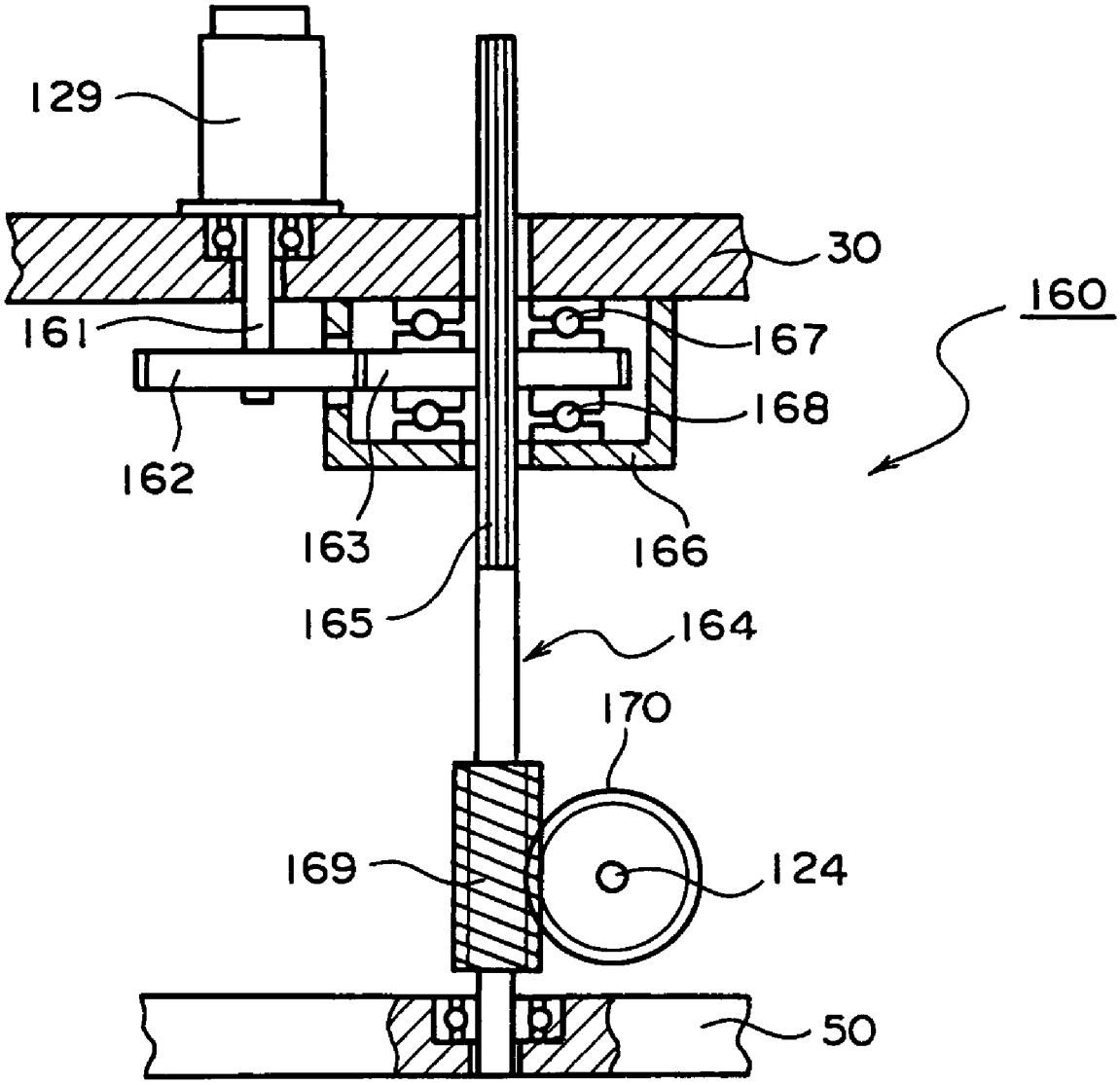
FIG. 5 is an explanatory view of a structure of an embodiment of a axis changing mechanism.

FIG. 5 is an explanatory view of a structure of an embodiment of the axis changing mechanism. Components identical with those in FIG. 4 are denoted by the identical reference numerals and signs.

In FIG. 5, the axis changing mechanism 160 has the following structure and transmits a rotation torque of the servomotor for pressing 129 arranged on the support plate 30 to the input shaft 124 of the slider moving mechanism 120.

A rotation shaft 161 of the servomotor for pressing 129 rotatably attached to the support plate 30 pierces through the support plate 30 and a gear 162 is fastened to the rotation shaft 161 piercing through the support plate 30. The gear 162 is meshed with a gear 163. The gear 163 is fitted in and engaged with a spline 165 cut in a direction changing shaft 164 and nipped by two thrust bearings 167 and 168, which are housed in a gear support case 166 fixed to the support plate 30, such that rotation of the gear 163 is transmitted to the direction changing shaft 164 and the direction changing shaft 164 can slide in the gear 163 freely according to spline engagement with spline grooves provided in the gear 163.

A worm gear 169 is fastened to the direction changing shaft 164. The worm gear 169 is meshed with a worm wheel 170 fit to the input shaft 124 of the slider moving mechanism 120.

Since the axis changing mechanism 160 is constituted as described above, even if the servomotor for pressing 129 is disposed on the support plate 30, a rotation torque of the servomotor for pressing 129 attached to the support plate 30 is transmitted to the input shaft 124 of the slider moving mechanism 120. Thus, the axis changing mechanism 160 shown in FIG. 5 can carry out completely the same function as the case in which the servomotor for pressing 129 is disposed in the slider moving mechanism 120 explained in FIG. 1.

In the axis changing mechanism 160 shown in FIG. 5, the rotation shaft 161, which is perpendicular to the support plate 30 of the servomotor for pressing 129 attached to the support plate 30, and the input shaft 124, which is at a level with the support plate 30 of the slider moving mechanism 120, are aligned by the worm gear 169 and the worm wheel 170. However, it is possible to change shafts using a combination of helical gears and the like or other various gears.

Figure 18:
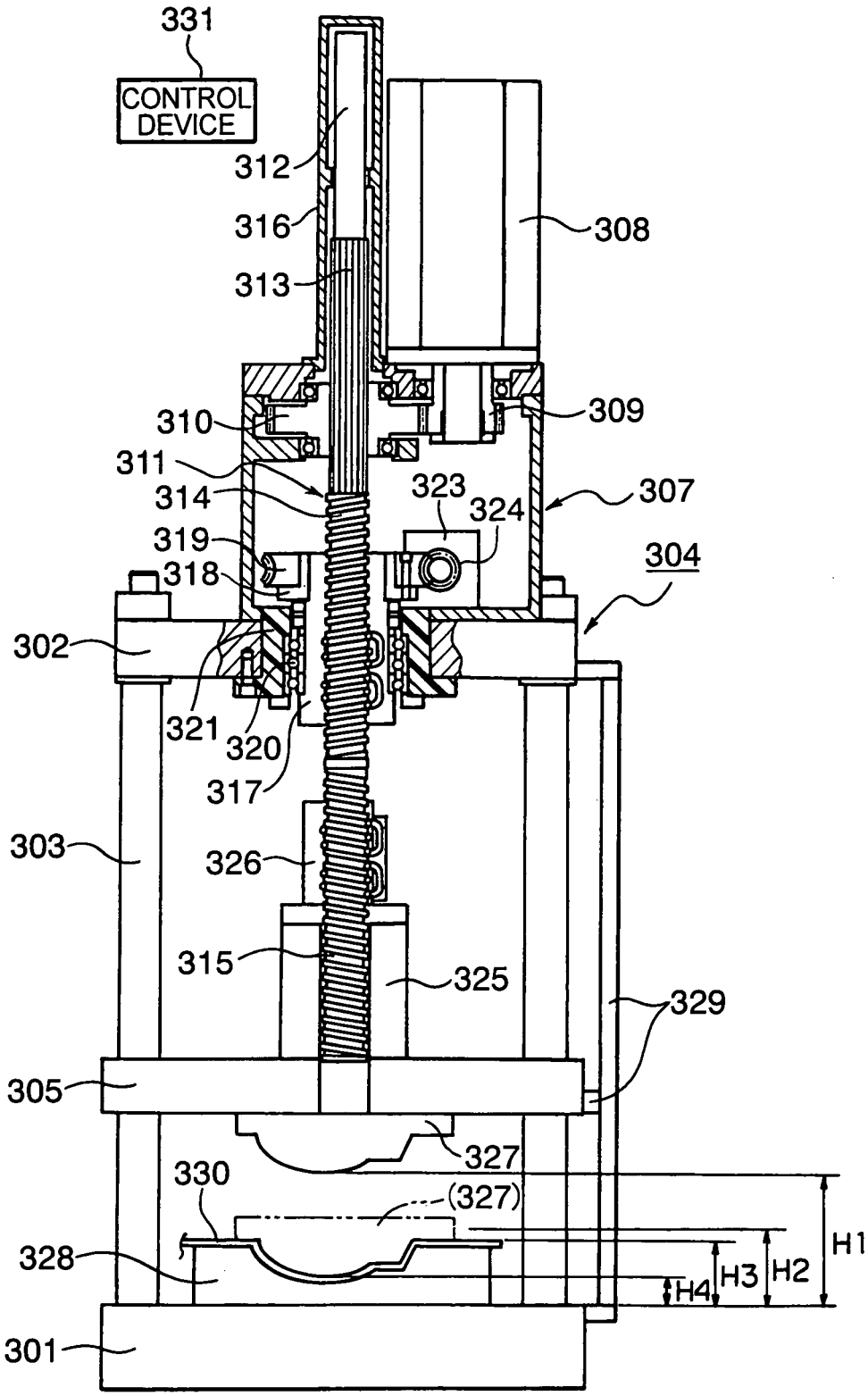
FIG. 18 is a schematic explanatory view of an embodiment of another form of an electric pressing machine.

FIG. 18 is a schematic explanatory view of an embodiment of another form of the electric pressing machine. In FIG. 18, a slider 305 is provided inside a frame 304 formed by a base 301, a support plate 302, and plural guide columns 303. Holes, which engage with the guide columns 303 and through which the slider 305 slides freely in an axial direction of the guide columns 303, are provided at four corners of the slider 305, respectively.

One or plural, for example, two, three, or four attachment stands 307 are provided on an upper surface of the support plate 302. Servomotors for fast feed 308 incorporating encoders are attached to the respective one or plural attachment stands 307.

Since structures and components related to the respective servomotors 308 attached to the one or plural attachment stands 307 explained below are completely the same, one of the servomotors 308 will be explained.

Explaining the embodiment shown in FIG. 18, a gear 310, which meshes with a gear 309 fastened to an output shaft of the servomotor for fast feed 308 in the inside of the attachment stand 307, is axially supported to rotate freely on the attachment stand 307 with a ball screw shaft 311 as an axis. The ball screw shaft 311 pierces through the attachment stand 307 and the support plate 302 in an up to down direction, respectively, and include a columnar section 312, a spline section 313 in which a spline is cut, an upper male screw section 314 of a right-hand thread having ball grooves, and a lower male screw section 315 of a left-hand thread having ball grooves in order from the top.

The columnar section 312 of the ball screw shaft 311 is supported to slide freely in the support case 316 provided in the attachment stand 307. The spline section 313 of the ball screw shaft 311 is spline-coupled to the gear 310 and the ball screw shaft 311 is rotated by the rotation of the gear 310. The ball screw shaft 311 itself is in a non-rotation state and can move to slide freely in an axial direction thereof under a non-rotation state of the gear 310. In other words, it is possible to control the rotation of the ball screw shaft 311 with rotate control of the servomotor for fast feed 308 according to both the meshing of the gears 309 and 310 and the spline coupling of the gear 310, the ball screw shaft 311, and the spline section 313.

The upper male screw section 314 of the ball screw shaft 311 screws with a ball screw mechanism 317 in which balls and a nut member are provided. A worm wheel 319 is fixed to an upper part of the ball screw mechanism 317 via a collar 318. The ball screw mechanism 317 is axially supported to rotate freely on the support plate 302 via a bearing 320 and a collar 321. A servomotor for pressing 323 incorporating an encoder is attached to the support plate 302 and a worm 324 fastened to an output shaft of the servomotor for pressing 323 is meshed with the worm wheel 319. Therefore, in a period in which the slider 305 is lowered only by rotation of the servomotor for pressing 323 to perform press working, the ball screw mechanism 317 rotates via the meshing of the worm 324 and the worm wheel 319 according to forward rotation and reverse rotation of the servomotor for pressing 323. Since the ball screw mechanism 317 is rotating according to this rotation, the ball screw shaft 311 is moved in a downward direction without rotating (the movement in the rotating direction the up to down direction of the ball screw shaft 311 may be associated with an operation of the servomotor for fast feed 308, which will be explained later).

A ball screw mechanism 326 including balls and a nut member is attached to an upper surface of the slider 305 via an attachment stand 325 having a hole, which is sufficient for rotating the ball screw shaft 311, in a central part. The lower male screw section 315 of the ball screw shaft 311 is screwed with the ball screw mechanism 326. Since rotation of the ball screw shaft 311 is controlled by rotation control of the servomotor for fast feed 308, it is possible to move the slider 305 reciprocatingly by screwing the lower male screw section 315 and the ball screw mechanism 326 of the ball screw shaft 311.

A upper die 327 is attached to a lower end face of the slider 305 and a lower die 328 is provided in a position corresponding to the upper die 327 on the base 301. A pulse scale 329, which detects a position of the slider 305, attached along the guide columns 303 between the base 301 and the support plate 302. A contact position of the upper die 327 and a work piece 330 mounted on the lower die 328 and an upper limit standby position and a lower limit falling position of the upper die 327 are detected by the pulse scale 329. A position of the upper die 327 is also detected by the pulse scale 329.

One or plural sets of the servomotor for fast feed 308 and the servomotor for pressing 323 are provided in association with the single slider 305. A control device 331, which controls the rotation of the servomotor for fast feed 308 and the rotation of the servomotor for pressing 323, is inputted with various setting values in advance and receives a position signal detected by the pulse scale. The control device 331 lowers the upper die rapidly via the rotation of the servomotor for fast feed 308 and, if necessary, the rotation of the servomotor for pressing 323 until a point immediately before the upper die 327 comes into contact with the work piece 330 mounted on the lower die 328. From the time immediately before the upper die 327 comes into contact with the work piece 330 until the upper die 327 falls to a lower limit falling position set in advance (an imaginary line position (327) of the upper die 327 in FIG. 18), the control device 331 lowers the upper die 327 in a torque application mode by the rotation of the servomotor for pressing 323 and causes the upper die 327 to press the work piece 330 mounted on the lower die 328. After the upper die 327 reaches the lower limit falling position, the control device 331 lifts the upper die rapidly via the rotation of the servomotor for fast feed 308 and the servomotor for pressing 323.

The rotating direction movement and the up to down direction movement of the ball screw shaft 311 according to the rotation of the servomotor for fast feed 308 and the servomotor for pressing 323 of the electric pressing machine constituted as described above will be explained.

When the servomotor for pressing 323 is OFF, that is, in the rotation stop state, the ball screw mechanism 317 and the support plate 302 are fixed by the coupling of the worm 324 and the worm wheel 319. In other words, the ball screw mechanism 317 is integrated with the support plate 302 via the coupling of the worm 324 and the worm wheel 319. Under such a state, when the servomotor for fast feed 308 rotates forward and the gear 309 rotates in a counterclockwise direction viewed from an upper side of a paper surface of FIG. 18 (in the following explanation, it is assumed that rotation is always viewed from the upper side on the paper surface), the ball screw shaft 311 rotates in a clockwise direction and the upper male screw section 314 of a right-hand thread screwing with the ball screw mechanism 317 fixed to the support plate 302, that is, the ball screw shaft 311 moves in a downward direction viewed from the frame 304 (in the following explanation, a moving direction of the ball screw shaft 311 is always viewed from the frame body 304 unless noted otherwise).

The lower male screw section 315 of a left-hand thread of the ball screw shaft 311 rotating in the clockwise direction is screwed with the ball screw mechanism 326 fixed to the slider 305 via the attachment stand 325. Thus, when the ball screw shaft 311 rotates in the clockwise direction, the ball screw mechanism 326 moves in the downward direction and the slider 305 also moves in the downward direction. Therefore, the slider 305, that is, the upper die 327 fastened to the lower surface of the slider 305 moves in the downward direction at high speed in a state in which the movement in the downward direction simultaneous with the rotation of the ball screw shaft 311 itself and the movement in the downward direction of the ball screw mechanism 326 associated with the rotation of the ball screw shaft 311 are added. A moving velocity of the upper die 327 at this point is set as V1.

When the servomotor for fast feed 308 rotates reversely and the gear 309 rotates in the clockwise direction, the ball screw shaft 311 rotates in the counterclockwise direction and the upper male screw section 314 of a right-hand thread screwing with the ball screw mechanism 317 fixed to the support plate 302, that is, the ball screw shaft 311 moves in the upward direction while rotating.

The lower male screw section 315 of a left-hand thread of the ball screw shaft 311 rotating in the counterclockwise direction is screwed with the ball screw mechanism 326 fixed to the slider 305 via the attachment stand 325. Thus, the ball screw mechanism 326 itself moves in the upward direction in association with the rotation of the ball screw shaft 311. Therefore, the slider 305, that is, the upper die 327 fastened to the lower surface of the slider 305 moves in the upward direction in a state in which the movement in the upward direction simultaneous with the rotation of the ball screw shaft 311 itself and the movement in the upward direction of the ball screw mechanism 326 associated with the rotation of the ball screw shaft 311 are added. A moving velocity of the upper die 327 at this point is set as V1 described above (forward rotation and reverse rotation of the servomotor for fast feed 308 is controlled in the identical manner).

When a pitch Pr of the right-hand thread of the upper male screw section 314 and a pitch Pl of the left-hand thread of the lower male screw section 315 are the same in this way, by providing two types of threads, the right-hand thread and the left-hand thread, in one ball screw shaft 311, it is possible to move the upper die 327 at a velocity twice as high as a velocity at the time when the right-hand thread or the left-hand thread is provided.

Even when an undesired force in a direction opposite to a present rotating direction is applied to the servomotor for fast feed 308, it is assumed that a drive force of a degree for preventing the rotation in the opposite direction is given to the servomotor for fast feed 308 such that the servomotor for fast feed 308 does not rotate in the rotating direction either (hereinafter referred to as rotation stop holding state). Under such a state, when the servomotor for pressing 323 rotates forward and the worm wheel 319 rotates in the counterclockwise direction via the worm 324 of the servomotor, the ball screw mechanism 317 fastening the worm wheel 319 also rotates in the counterclockwise direction. Consequently, the upper male screw section 314 of a right-hand thread screwing with the ball screw mechanism 317 rotating in the counterclockwise direction, that is, the ball screw shaft 311 moves in the downward direction. As a result, the slider 305 also moves in the downward direction. A moving velocity of the upper die 327 at this point is set as V2.

When the servomotor for pressing 323 rotates reversely and the worm wheel 319 rotates in the clockwise direction via the worm 324 of the servomotor, the ball screw mechanism 317 fastening the worm wheel 319 also rotates in the clockwise direction. Consequently, the upper male screw section 314 of a right-hand thread screwing with the ball screw mechanism 317 rotating in the clockwise direction, that is, the ball screw shaft 311 moves in the upward direction. As a result, the slider 305 also moves in the upward direction. A moving velocity of the upper die 327 at this point is V2 described above (forward rotation and reverse rotation of the servomotor for pressing 323 is controlled in the identical manner).

From the above explanation, when the servomotor for fast feed 308 and the servomotor for pressing 323 are rotating forward simultaneously, the upper die 327 fastened to the lower surface of the slider 305 moves in the downward direction at a velocity of a sum of the velocity V1 in the downward direction by the servomotor for fast feed 308 and the velocity V2 in the downward direction by the servomotor for pressing 323, V=V1+V2. When the servomotor for fast feed 308 and the servomotor for pressing 323 are rotating reversely simultaneously, the upper die 327 fastened to the lower surface of the slider 305 moves in the upward direction at a velocity of a sum of the velocity V1 in the upward direction by the servomotor for fast feed 308 and the velocity V2 in the upward direction by the servomotor for pressing 323, V=V1+V2.

Figure 19:
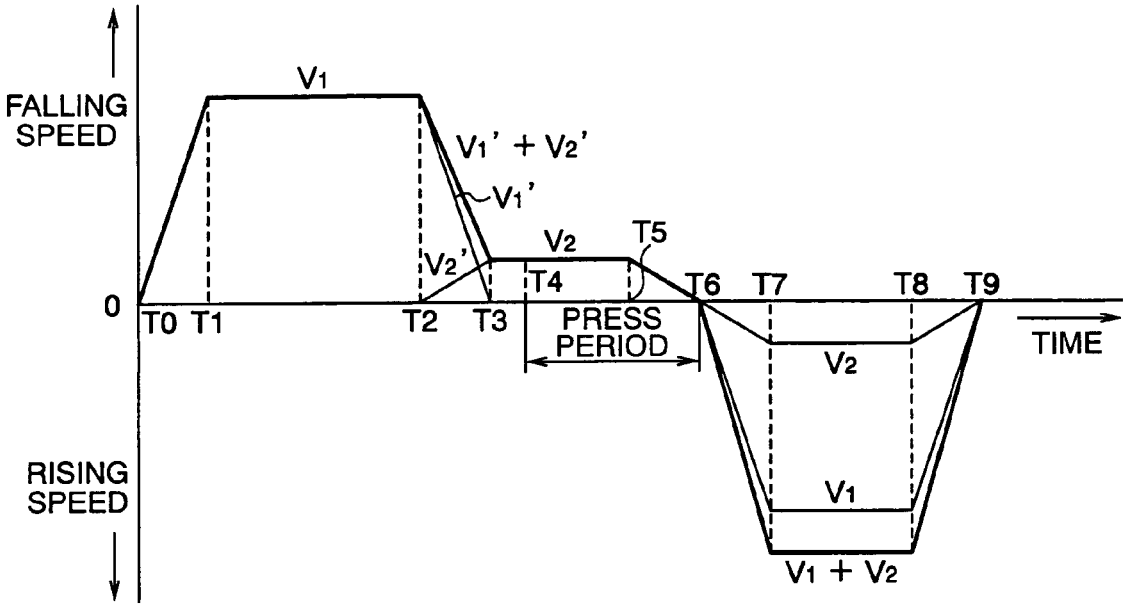
FIG. 19 is an explanatory view of an operation of an embodiment showing a control method of the electric pressing machine shown in FIG. 18.

FIG. 19 is an explanatory view of an operation of an embodiment showing a control method for the electric pressing machine shown in FIG. 18.

In FIG. 19, a vertical axis represents a velocity of the upper die 327 and a horizontal axis represents time. As shown in FIG. 18, for example, with the upper surface of the base 301 as a reference point 0, a top end position of the upper die 327 at the time when the upper die 327 is in a standby state, that is, in an upper limit rising position of the upper die 327 is set as H1, a position set in advance before the top end of the upper die 327 comes into contact with the work piece 330 mounted on the lower die 328 is set as H2, a position where the top end of the upper die 327 comes into contact with the work piece 330 mounted on the lower die 328 is set as H3, and a top end position of the upper die 327 at the time when the upper die 327 reaches a lower limit falling position is set as H4 (H4<H3<H2<H1).

From the position H1 where the upper die 327 is in the standby state to the position H2 set in advance before the upper die 327 comes into contact with the work piece 330, the fall of the slider 305, that is, the upper die 327 is subjected to acceleration control at time T0 to T1 and constant velocity control at time T1 to T2 by forward rotation of the servomotor for fast feed 308 based on position detection of the pulse scale 329. When the pulse scale 329 detects the position H2 set in advance before the upper die 327 comes into contact with the work piece 330, the upper die 327 is subjected to deceleration control at time T2 to T3 and the servomotor for fast feed 308 stops. The upper die 327 is lowered at a velocity of V1' at time T2 to T3 by the servomotor for fast feed 308.

On the other hand, in the detection of the position H2 set in advance before the upper die 327 comes into contact with the work piece 330, the servomotor for pressing 323 starts forward rotation and, at the time T2 to T3, performs acceleration follow-up inverse proportional to movement of the servomotor for fast feed 308 by the encoder of the servomotor for pressing 323. Consequently, at the time T2 to T3, the upper die 327 falls at a velocity V1'+V2' obtained by adding the falling speed V1' of the upper die 327 by the deceleration control of the servomotor for fast feed 308 and the falling speed V2' of the upper die 327 by the acceleration control of the servomotor for pressing 323. Thereafter, at the time T3 to T5, the upper die 327 falls in the torque application mode at the velocity of V2 according to the rotation control of the servomotor for pressing 323 based on the position detection of the pulse scale 329. The upper die 327 enters a press period for pressing the work piece 330 mounted on the lower die 328 according to the constant velocity control at the time T4 to T5 and the deceleration control at the time T5 to T6.

When the pulse scale 329 detects the lower limit falling position H4 of the upper die 327, both the servomotor for fast feed 308 and the servomotor for pressing 323 are rotated reversely. Thereafter, on the basis of the position detection of the pulse scale 329, the servomotor for fast feed 308 return the upper die 327 to the upper limit rising position, that is, the original standby position H1 through the acceleration control at the time T6 to T7, the constant velocity control at the time T7 to T8, and the deceleration control at the time T8 to T9. The servomotor for pressing 323 follows the movement of the servomotor for fast feed 308 with the encoder thereof. Here, one cycle of the press working ends.

Figure 20:
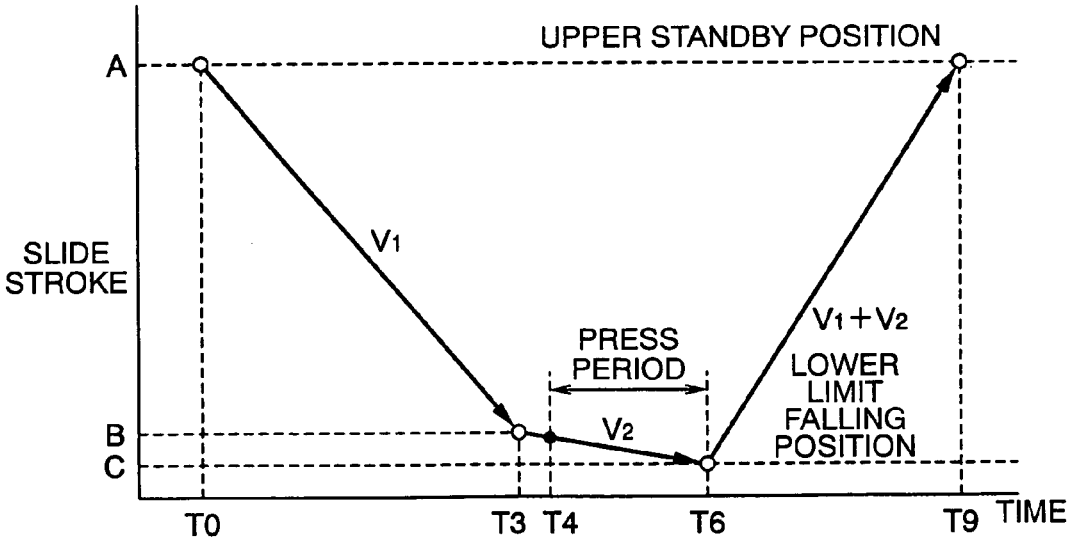
FIG. 20 is a upper die stroke diagram at the time of the control method shown in FIG. 19.

FIG. 20 is a stroke diagram of a upper die at the time of the control method shown in FIG. 19. Note that, in the figure, the acceleration state is neglected.

In FIG. 20, a stroke AB of the upper die 327 from an upper limit position (a standby position) A at time T0 when the servomotor for fast feed 308 starts to B at time T3 when the servomotor for fast feed 308 stops is far larger compared with a stroke BC in the torque application mode of the upper die 327 from B at the time T3 to C at time T6 when the servomotor for pressing 323 stops and the upper die 327 reaches a lower limit falling position. This represents that the upper die 327 falls rapidly until time immediately before the press period time T4.

A stroke CA of the upper die 327 from C at the time T6 after end of the press period to A at time T9 when the upper die 327 returns to the upper limit rising position (the standby position) by the servomotor for fast feed 308 and the servomotor for pressing 323 is far larger compared with the stroke BC in the torque application mode of the upper die 327. This represents that the upper die 327 rises rapidly even after the press period ends.

In other words, the stroke AB is secured at the velocity V1 based on the servomotor for fast feed 308, the stroke BC (BC<<AB) is secured at the velocity V2 (V2<<V1) based on the servomotor for pressing 323, and the stroke CA (CA>>BC) is secured at the velocity V1+V2 based on both the servomotor for fast feed 308 and the servomotor for pressing 323.

Figure 21:
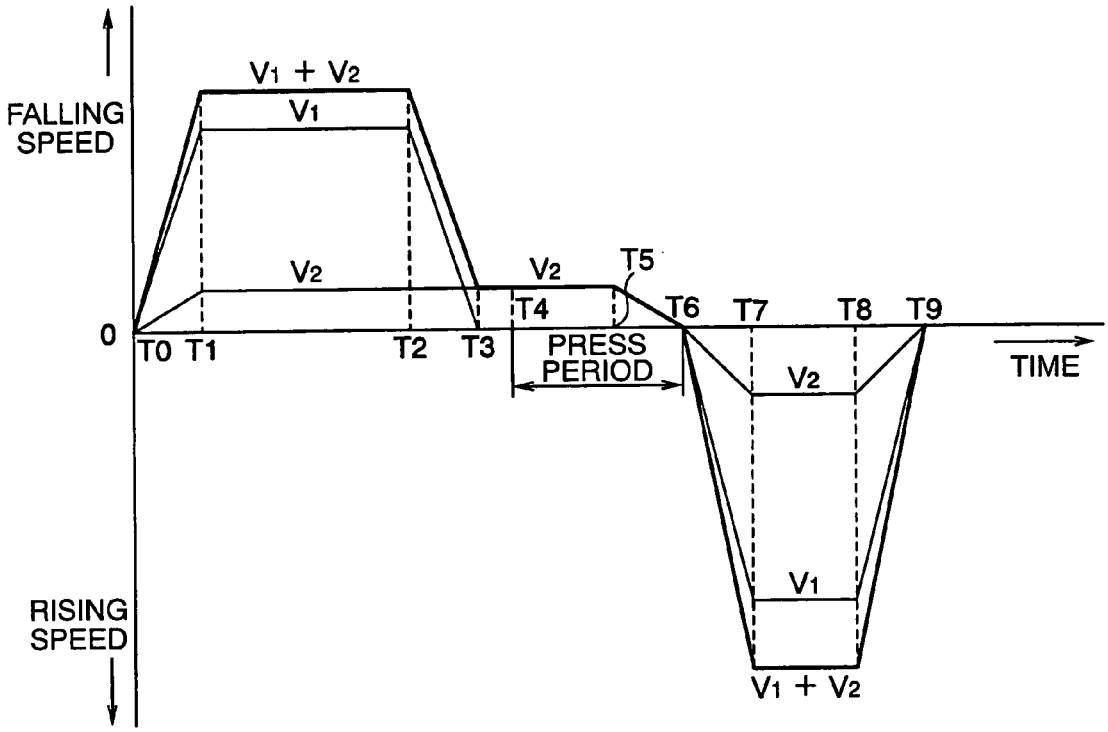
FIG. 21 is an explanatory view of an operation of another embodiment showing a control method.

FIG. 21 is an explanatory view of an operation of another embodiment showing a control method.

In FIG. 21, a vertical axis represents a velocity of the upper die 327 and a horizontal axis represents time. In FIG. 21, again, with the upper surface of the base 301 as a reference point 0, a top end position of the upper die 327 at the time when the upper die 327 is in a standby state, that is, in an upper limit rising position of the upper die 327 is set as H1, a position set in advance before the top end of the upper die 327 comes into contact with the work piece 330 mounted on the lower die 328 is set as H2, a position where the top end of the upper die 327 comes into contact with the work piece 330 mounted on the lower die 328 is set as H3, and a top end position of the upper die 327 at the time when the upper die 327 reaches a lower limit falling position is set as H4 (H4<H3<H2<H1).

From H1 where the upper die 327 is in the standby state to the position H2 set in advance before the upper die 327 comes into contact with the work piece 330, both the fall the slider 305, that is, the upper die 327 according to the forward rotation of the servomotor for fast feed 308 based on the position detection of the pulse scale 329 and the fall of the slider 305 according to the forward rotation of the servomotor 323 for pressing following the movement of the servomotor 308 by the encoder of the servomotor for pressing 323 are subjected to acceleration control at time T0 to T1 and constant velocity control at time T1 to T2. At the time T1 to T2, as explained above, the upper die 327 falls rapidly at the velocity V(=V1+V2) obtained by adding the velocity V1 of the upper die 327 based on the forward rotation of the servomotor 308 and the velocity V2 of the upper die 327 according to the forward rotation of the servomotor 323. When the pulse scale 329 detects the position H2 set in advance before the upper die 327 comes into contact with the work piece 330, the upper die 327 is subjected to the deceleration control at the time T2 to T3 and the servomotor for fast feed 308 returns to the rotation stop holding state described above.

On the other hand, with the detection of the position H2 set in advance before the upper die 327 comes into contact with the work piece 330 (time T1) as an opportunity, the servomotor for pressing 323 is subjected to the rotation control in the torque application mode based on the position detection of the pulse scale 329. At the time T3 to T5 after that, the upper die 327 falls in the torque application mode at the velocity V2 according to the rotation control only by the servomotor for pressing 323.

At the time T4, the top end of the upper die 327 falls to the position H3 where the upper die 327 comes into contact with the work piece 330 mounted on the lower die 328. Thereafter, the upper die 327 enters a press period for pressing the work piece 330 mounted on the lower die 328 according to the constant velocity control at the time T4 to T5 and the deceleration control at the time T5 to T6.

When the pulse scale 329 detects the lower limit falling position H4 of the upper die 327, both the servomotor for fast feed 308 and the servomotor for pressing 323 are rotated reversely. Thereafter, on the basis of the position detection of the pulse scale 329, the servomotor for fast feed 308 return the upper die 327 to the upper limit rising position, that is, the original standby position H1 through the acceleration control at the time T6 to T7, the constant velocity control at the time T7 to T8, and the deceleration control at the time T8 to T9. The servomotor for pressing 323 follows the movement of the servomotor for fast feed 308 with the encoder thereof. Here, one cycle of the press working ends.

Figure 22:
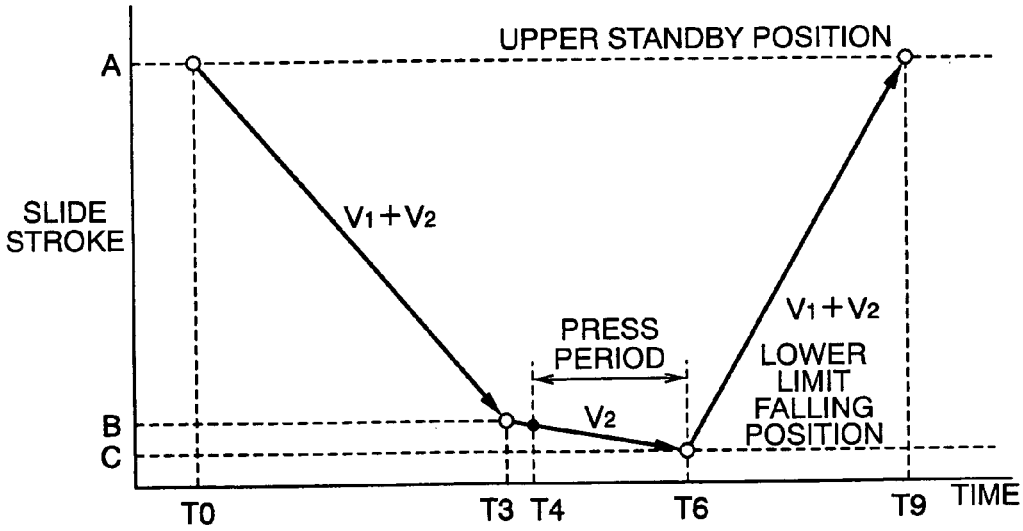
FIG. 22 is a upper die stroke diagram at the time of the control method shown in FIG. 21.

FIG. 22 is a stroke diagram of a upper die at the time of the control method shown in FIG. 21. Note that, in the figure, the acceleration state is neglected.

In FIG. 22, a stroke AB of the upper die 327 from an upper limit position (a standby position) A at time T0 when the servomotor for fast feed 308 and the servomotor for pressing 323 start to B at time T3 when the servomotor for fast feed 308 and the servomotor for pressing 323 stop is far larger compared with a stroke BC in the torque application mode of the upper die 327 from B at the time T3 to C at time T6 when the servomotor for pressing 323 stops and the upper die 327 reaches a lower limit falling position. This represents that the upper die 327 falls rapidly until time immediately before the press period time T4.

A stroke CA of the upper die 327 from C at the time T6 after end of the press period to A at time T9 when the upper die 327 returns to the upper limit rising position (the standby position) by the servomotor for fast feed 308 and the servomotor for pressing 323 is far larger compared with the stroke BC in the torque application mode of the upper die 327. This represents that the upper die 327 rises rapidly even after the press period ends.

In other words, the stroke AB is secured at the velocity V1+V2 based on both the servomotor for fast feed 308 and the servomotor for pressing 323, the stroke BC (BC<<AB) is secured at the velocity V2 (V2<<V1) based on the servomotor for pressing 323, and the stroke CA (CA>>BC) is secured at the velocity V1+V2 based on both the servomotor for fast feed 308 and the servomotor for pressing 323.

Figure 23:
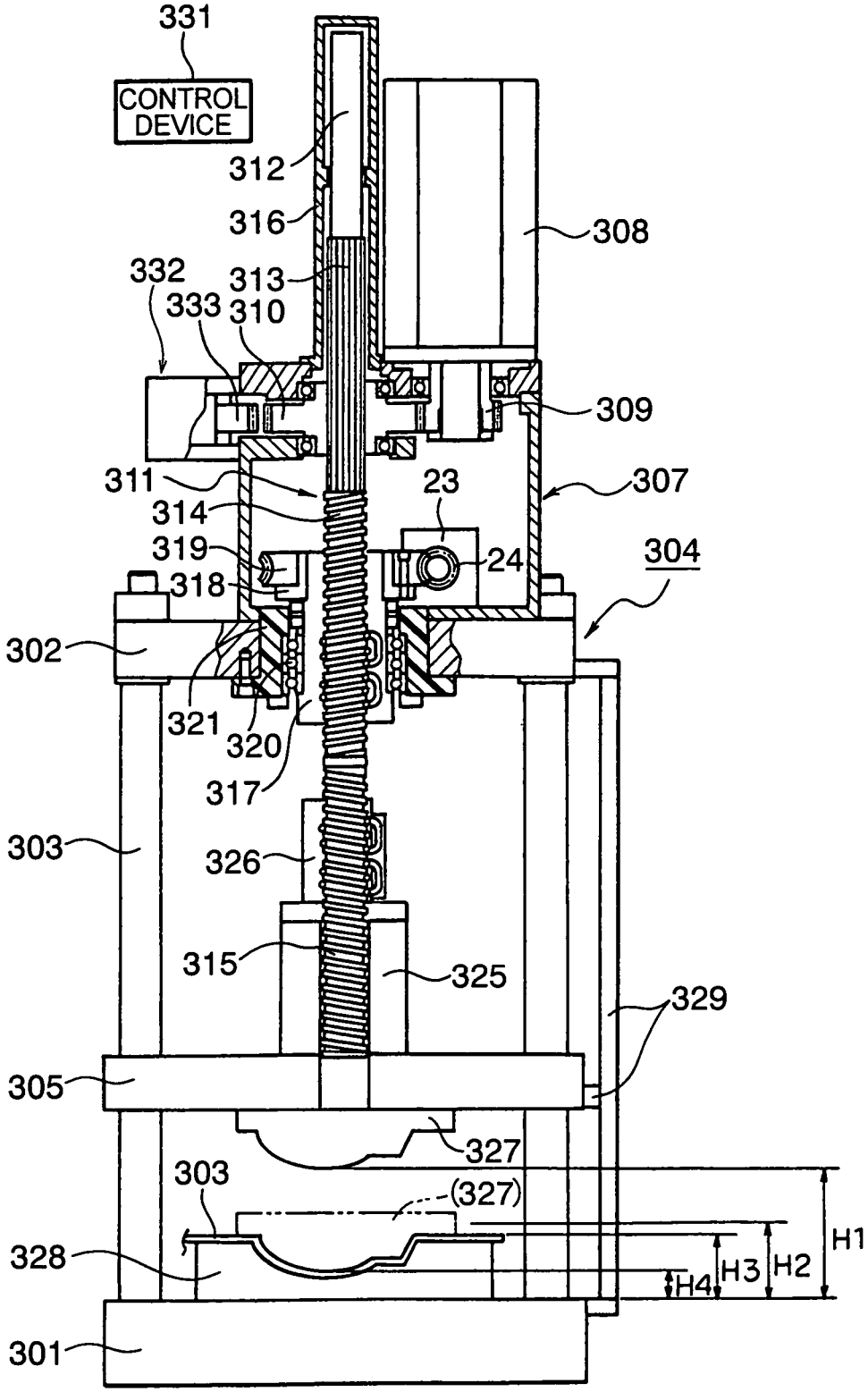
FIG. 23 is a schematic explanatory view of an embodiment of still another form of the electric pressing machine.

FIG. 23 is a schematic explanatory view of an embodiment of still another form of the electric pressing machine. In FIG. 23, components same as those in FIG. 18 are denoted by the identical reference numerals and signs. The electric pressing machine in FIG. 23 is different from that in FIG. 18 in that a lock mechanism 332 for locking rotation of the gear 310 is provided on the attachment stand 307. Since the other components are the same as those in FIG. 18, explanations of the components are omitted.

In FIG. 23, when the lock mechanism 332 operates, a clamp piece 333 of the lock mechanism 332 engages with the gear 310 to lock the rotation of the gear 310. In other words, since the gear 310 is fit in the spline section 313 of the ball screw shaft 311 so as to slide freely, the clamp piece 333 prevents rotation of the ball screw shaft 311 via the gear 310 according to the operation of the lock mechanism 332.

Consequently, even if a force for moving the slider 305 upward via the slider 305, the ball screw mechanism 326, the ball screw shaft 311, and the like because of a reaction that is generated when the upper die 327 presses the work piece 330 mounted on the lower die 328, under the operation of the lock mechanism 332 described above, the rotation of the ball screw shaft 311 is prevented. Thus, the upper die 327 can apply a predetermined press load to the work piece 330 efficiently. In this regard, the electric pressing machine has more excellent press efficiency than the electric pressing machine shown in FIG. 18.

The electric pressing machine shown in FIG. 23 including such a lock mechanism 332 is controlled by the control method shown in FIG. 19 or 21 in the same manner as the electric pressing machine shown in FIG. 18. The control device 331, which controls the rotation of one or plural servomotors for fast feed 308 and the rotation of one or plural servomotors for pressing 323 at this point, is inputted with various setting values in advance. In addition, on the basis of a position signal detected by the pulse scale 329, before the upper die 327 comes into contact with the work piece 329 mounted on the lower die 328, the control device 331 lowers the upper die 327 rapidly via at least the rotation of the servomotor for fast feed 308. From the time before the upper die 327 comes into contact with the work piece 330 until the time when the upper die 327 falls to a lower limit falling position set in advance (an imaginary line position (327) of the upper die 327 in FIG. 18), the control device 331 lowers and press the upper die 327 in the torque application mode according to the rotation of the servomotor for pressing 323. By the time immediately before the upper die 327 comes into contact with the work piece 330 mounted on the lower die 328, the control device 331 actuates the lock mechanism 332 for preventing the rotation of the ball screw shaft 311. After the upper die 327 reaches the lower limit falling position, the control device 331 lifts the upper die rapidly via the rotation of the servomotor for fast feed 308 and the servomotor for pressing 323 under release (an unlock state) of the lock mechanisms 332.

In other words, in FIGS. 19 and 21, the lock mechanism 332 locks the rotation of the operating ball screw shaft 311 during the time T3 to T4 and unlocks the lock of the rotation at the time T6. Even if a force for moving the slider 305 upward via the ball screw shaft 311 and the like because of a reaction that is generated when the upper die 327 presses the work piece 330 mounted on the lower die 328, with the operation of the lock mechanism 332, the ball screw shaft 311 does not rotate and the upper die 327 applies a predetermined press load to the work piece 330.

The lock mechanism 332 locks the bass screw shaft 311 in the position of the attachment stand 307 using the gear 310 that rotates the ball screw shaft 311. However, the lock mechanism 332 is not limited to this position and, for example, the lock mechanism may be arranged in the position of the support plate 302 and the position of the slider 305 to prevent the rotation of the bass screw shaft 311.

In the above explanation, the pitch Pr of the right-hand thread of the upper male screw section 314 and the pitch Pl of the left-hand thread of the lower male screw section 315 are set the same. However, the pitch Pr and the pitch Pl do not always have to be the same. If the pitch Pr of the upper male screw section 314 is larger than the pitch Pl of the lower male screw section 315, it is possible to lower and lift the upper die 327 faster. In the explanation, the upper male screw section 314 is the right-hand thread and the lower male screw section 315 is the left-hand thread. However, it is needless to mention that the same effect can be obtained when the upper male screw section 314 is the left-hand thread and the lower male screw section 315 is the right-hand thread.

As the position detector for detecting the upper limit standby position H1 of the upper die 327, the position H2 set in advance before the top end of the upper die 327 comes into contact with the work piece 330 mounted on the lower die 328, the contact position H3 of the upper die 327 and the work piece 330 mounted on the lower die 328, and the lower limit falling position H4, the pulse scale 329 is described. However, any other electronic or mechanical position detector can be used as long as the position detector can detects a position and transmit a detection signal to the control device 331.

Figure 24:
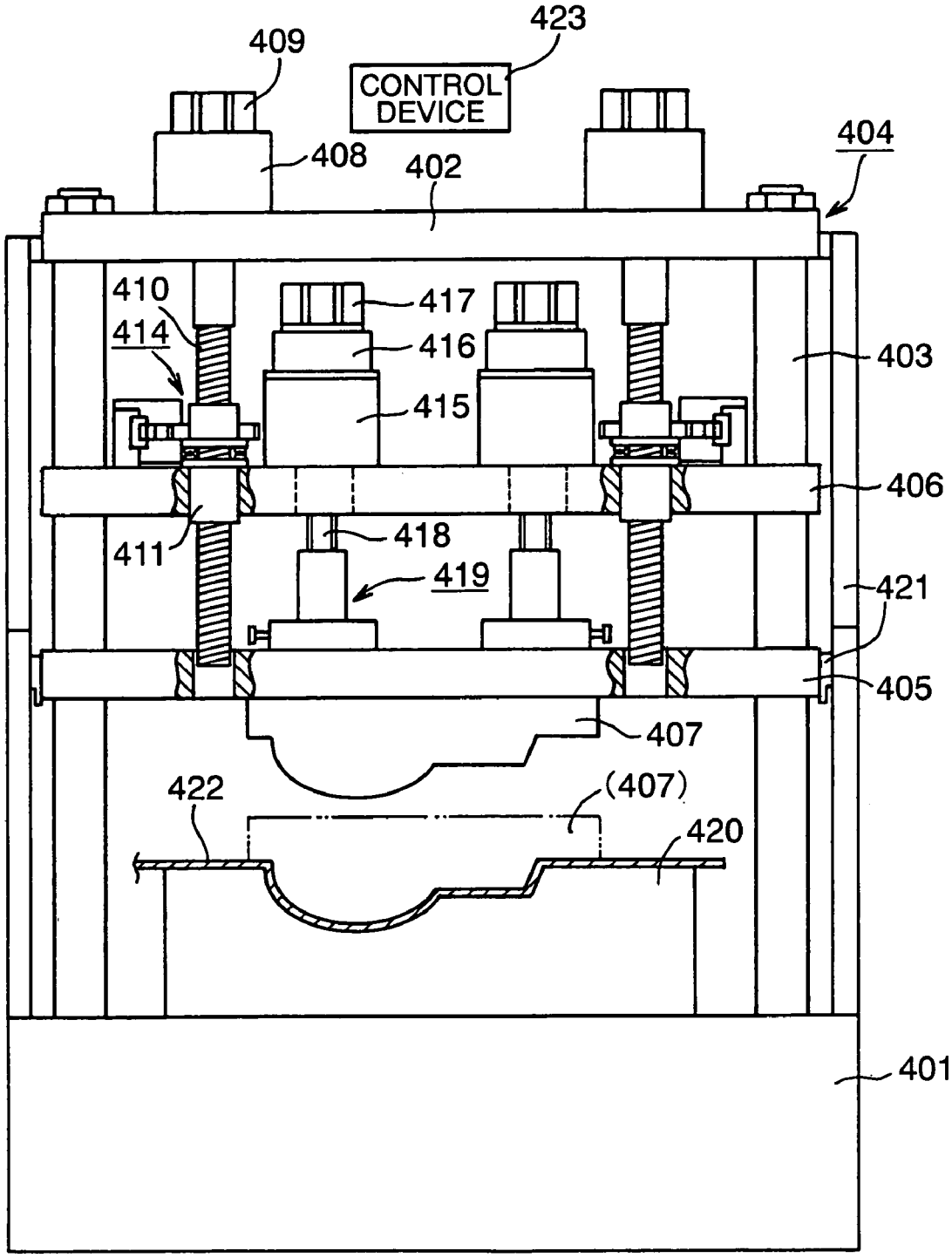
FIG. 24 is a schematic explanatory view of another embodiment of the electric pressing machine.

FIG. 24 is a schematic explanatory view of another embodiment of the electric pressing machine.

In FIG. 24, in a frame 404 formed by a base 401, a support plate 402, and plural guide columns 403, two sliders (a first slider 405 and a second slider 406) are provided. Slide holes, through which the sliders 405 and 406 engage with the guide columns 403 and slide freely in an axial direction of the guide columns 403, are provided at four corners of the sliders 405 and 406, respectively.

Plural, for example, four attachment stands 408 are provided on an upper surface of the support plate 402. Servomotors for fast feed 409 incorporating encoders are attached to the respective attachment stands 408.

Since structures and components related to the respective servomotors 409 attached to the four attachment stands 409 explained below are completely the same, one of the servomotors 409 will be explained.

A screw shaft for fast feed (a first screw shaft) 410, which is fastened to a shaft of the servomotor for fast feed 409 in the inside of the attachment stand 408, is axially supported by the support plate 402 to rotate freely and is screwed in a female screw feed nut 411 (a first coupling mechanism) fixed to the slider 406. The screw shaft for fast feed 410 is capable of projecting the slider 405 further provided below the slider 406. Therefore, the slider 406 rises or falls according to forward rotation and reverse rotation synchronizing with the four servomotors for fast feed 409. It is possible to move the slider 406 reciprocatingly according to rotation control of the servomotor for fast feed 409.

A double nut lock mechanism 414, which clamps or fixed the screw shaft 410 to the slider 406, is provided in the slider 406. When the lock mechanism 414 works, the screw shaft 410 is locked to the slider 406 and the screw shaft 410 and the slider 406 are integrated such that the screw shaft 410 and the slider 406 cannot move relatively to each other.

Plural, for example, two, three, or four attachment stands 415 are provided on an upper surface of the slider 406. Servomotors for pressing 417 with decelerators 416 including encoders are attached to the respective attachment stand 415. Since structures and components related to the respective servomotors for pressing 417 attached to the attachment stands 415 are completely the same, one of the servomotors for pressing 417 will be explained.

A ball screw shaft (a second screw shaft) 418, which is fastened to a shaft of the servomotor for pressing 417 in the inside of the attachment stand 415, is screwed with a ball screw mechanism with differential mechanism (a second coupling mechanism) 419 including balls and a nut member and is axially supported by the slider 406 to rotate freely. The two sliders 406 and 405 are coupled by the ball screw shaft 418 and the ball screw mechanism with differential mechanism 419 fixed to the upper surface of the slider 405. In other words, by rotating the plural servomotors for pressing 417 provided on the attachment stands 415 forward or reversely, the slider 405 rises or falls. Thus, it is possible to move the slider 405 reciprocatingly according to rotation control of the servomotors for pressing 417.

A upper die 407 is attached to a lower end surface of the slider 405 and a lower die 420 is provided in a position corresponding to the upper die 407 on the base 401. Pulse scales 421, which detect a position of the slider 405, are provided along four guide columns 403 between the base 401 and the support plate 402. The pulse scales 421 detect a contact position of the upper die 407 and a work piece 422 mounted on the lower die 420 and detect an upper limit standby position and a lower limit falling position of the upper die 407. Parallel control for the slider 405 and the like is performed with the four pulse scales 421 as a reference.

Various setting values are inputted to a control device (a first control device) 423, which controls rotation of the two to four servomotors for fast feed 409 and rotation of the two to four servomotors for pressing 417 and controls the lock mechanism 414, which locks the screw shaft 410 to the slider 406 or unlocks the screw shaft 410. In addition, the control device 423 receives a position signal that is detected by the pulse scales 421 for detecting a position of the slider 405, that is, a position of the upper die 407. Until a point when the upper die 407 in the upper limit standby position comes into contact with the work piece 422 mounted on the lower die 420 or a point immediately before the contact, the control device 423 lowers the upper die 407 rapidly via the slider 406 that falls according to the rotation of the screw shaft 410 by the servomotor for fast feed 409 and, if necessary, the slider 405 that falls according to the rotation of the servomotor for pressing 417. Immediately after the stop of the servomotor for fast feed 409, the control device 423 locks the lock mechanism 414. From the point when the upper die 407 comes into contact with the work piece 422 or the point immediately before the contact to a point when the upper die 407 falls to the lower limit falling position set in advance (the imaginary line position (407) of the upper die 407 in FIG. 24), the control device 423 lowers the upper die 407 with the servomotor for pressing 417. In other words, a velocity of the slider 405 is reduced compared with the raid fall velocity. In this case, the control device 423 sets the servomotor for pressing 417 to the torque application mode such that the upper die 407 presses the work piece 422 mounted on the lower die 420 into a predetermined shape. After the upper die 407 reaches the lower limit falling position, the control device 423 unlocks the lock mechanism 414 and lifts the upper die 407 rapidly using both the rise of the slider 405 by the servomotor for pressing 417 and the rise of the slider 406 by the servomotor for fast feed 409.

After the servomotor for fast feed 409 stops, the lock mechanism 414 is unlocked to lock the screw shaft 410 to the slider 406. This is because, even if a force for moving the slider 406 upward via the slider 405, the ball screw mechanism with differential mechanism 419, the ball screw shaft 418, and the like because of a reaction that is generated when the upper die 407 presses the work piece 422 mounted on the lower die 420, since the rotation of the screw shaft 410 is prevented by the integration of the screw shaft 410 and the slider 406 described above, the slider 406 does not move upward and keeps the stopped position. In other words, the upper die 407 can apply a predetermined press load to the work piece 422.

Figure 25:
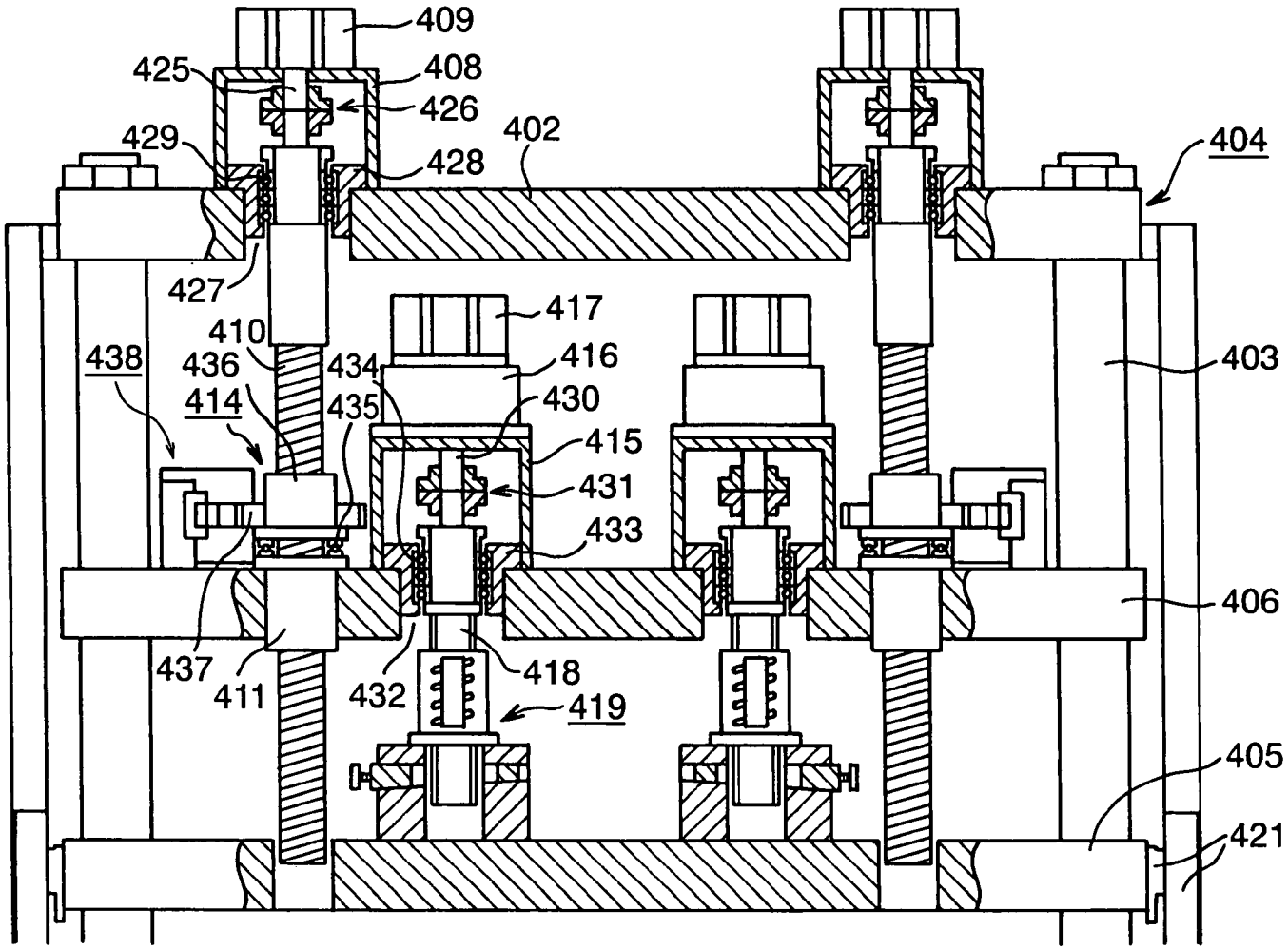
FIG. 25 is an enlarged explanatory view of a moving mechanism section for a upper die used in FIG. 24.

FIG. 25 is an enlarged explanatory view of a moving mechanism section for a upper die used in FIG. 24. Components identical with those in FIG. 24 are denoted by the identical reference numerals and signs.

In FIG. 25, an output shaft 425 of the servomotor for fast feed 409, which pierces through the attachment stand 408 attached to the upper surface of the support plate 402, is coupled to the top end of the screw shaft 410 via a coupling 426. A bearing 429 fit in the screw shaft 410 via a bearing holder 428 is attached to a hole 427 provided in the support plate 402. The screw shaft 410, which is driven by the servomotor for fast feed 409, is attached to the support plate 402 to rotate freely.

An output shaft 430, which pierces through the attachment stand 415 attached to the upper surface of the slider 406 via the decelerator 416 of the servomotor for pressing 417, is coupled to the top end of the ball screw shaft 418 via a coupling 431. A bearing 434, which is fit in the ball screw shaft 418 via a bearing holder 433, is attached to a hole 432 provided in the slider 406. The ball screw shaft 418, which is driven by the servomotor for pressing 417, is attached to the slider 406 to rotate freely.

The lock mechanism 414 attached to the slider 406 includes a bearing for thrust load 435, a lock nut 436, a clamp piece 437, and a lock nut relaxing mechanism 438. The lock mechanism 414 locks the screw shaft 410 (stops rotation of the screw shaft 410 relative to the lock nut 436) or unlocks the screw shaft 410 (free the rotation of the screw shaft 410 relative to the lock nut 436) with a double nut of the female feed nut 411 and the lock nut 436 that are arranged with the bearing 435 for facilitating relaxation in the middle. The lock and the unlock of the screw shaft 410 by the double nut of the female feed nut 411 and the lock nut 436 are performed by the lock nut relaxing mechanism 438 that slightly rotates the lock nut 436 forward and reversely via the clamp piece 437 fastened to the lock nut 436.

Figure 26:
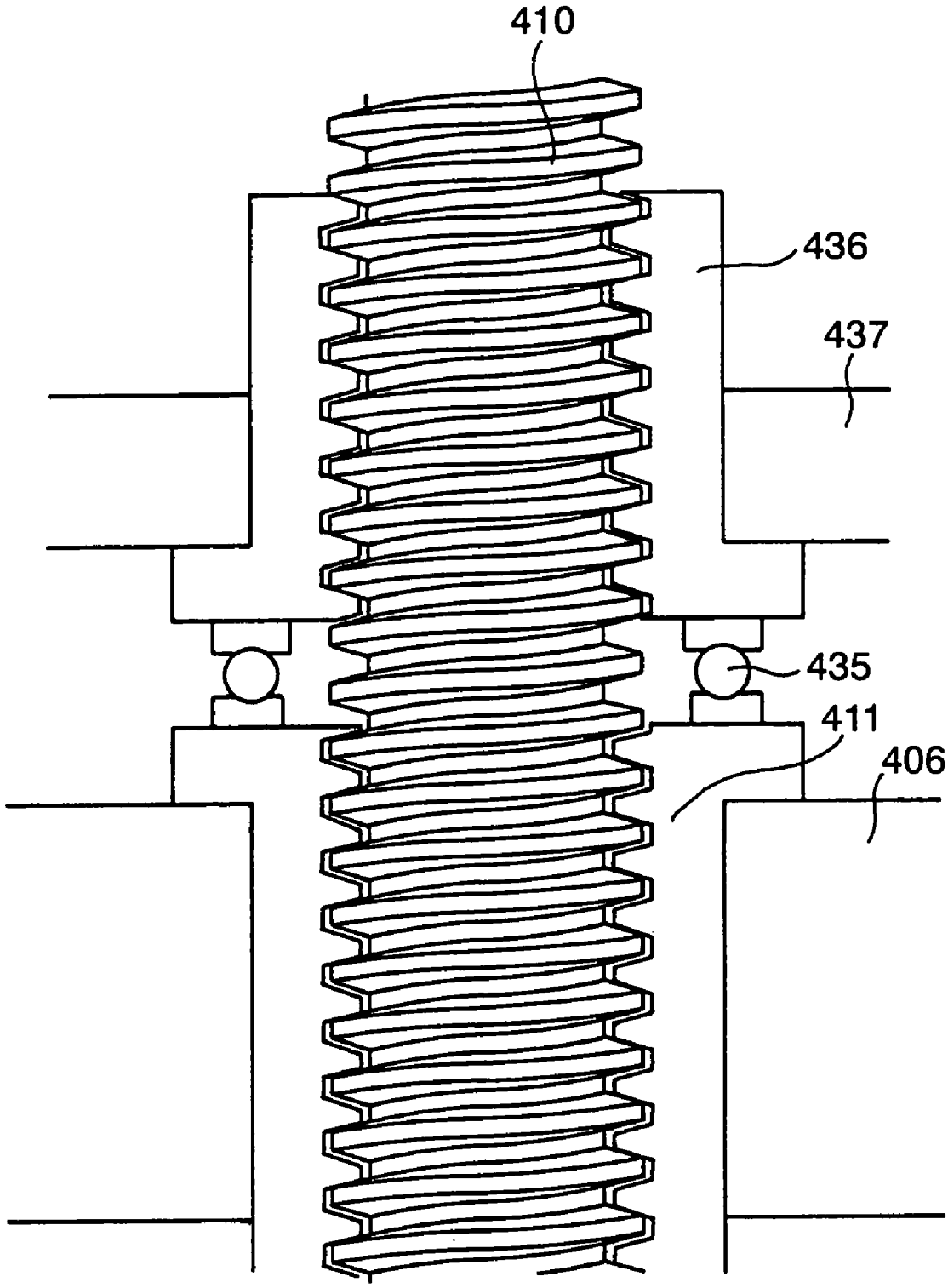
FIG. 26 is a partially enlarged view of an embodiment showing a relation between a female screw feed nut and a lock nut with respect to a screw shaft at the time when a double nut lock mechanism is in a lock state.

FIG. 26 is a partially enlarged view of an embodiment representing a relation of a female feed nut and a lock nut to a screw shaft at the time when a double nut lock mechanism is in a lock state.

In FIG. 26, the lock nut 436 is slightly rotated clockwise via the clamp piece 437 viewed from the upper side on the paper surface and the lock nut relaxing mechanism 438 is in a clamp state. At this point, a lower side of a thread groove of the lock nut 436 and a lower side of a screw ridge of the screw shaft 410 come into abutment against each other and an upper side of the thread groove of the female screw feed nut 411 and an upper side of the screw ridge of the screw shaft 410 come into abutment against each other, whereby the screw shaft 410 is fixed to the lock nut 436. Therefore, the screw shaft 410 is fixed to the slider 406 via the lock nut relaxing mechanism 438 that is fixed to the lock nut 436, the clamp piece 437, and the slider 406.

Figure 27:
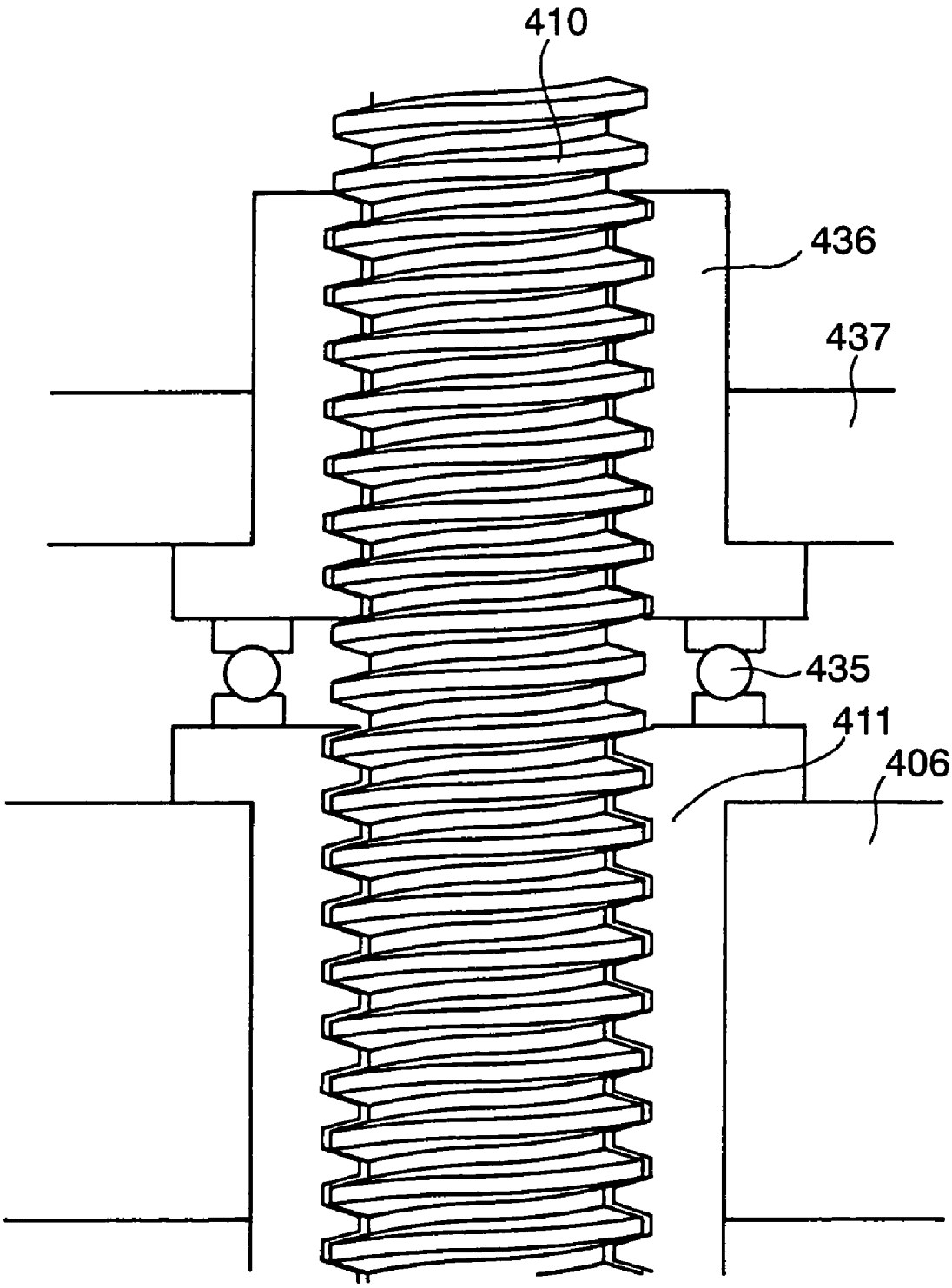
FIG. 27 is a partially enlarged view of an embodiment showing a relation between the female screw feed nut and the lock nut with respect to the screw shaft at the time when the double nut lock mechanism is in an unlock state and feeds a slider downward.

FIG. 27 is a partially enlarged view of an embodiment representing a relation of the female screw feed nut and the lock nut to the screw shaft at the time when the double nut lock mechanism comes into an unlock state to feed the slider 406 downward.

In FIG. 27, the lock nut 436 is slightly rotated counterclockwise via the clamp piece 437 viewed from the upper side on the paper surface and the lock nut relaxing mechanism 438 is in an unclamp state. At this point, the thread groove of the lock nut 436 and the thread ridge of the screw shaft 410 are placed in a neutral state. When the screw shaft 410 rotates clockwise view from the upper side on the paper surface, the lower side of the thread ridge of the screw shaft 410 feeds the slider 406 downward while coming into contact with the lower side of the thread groove of the female screw feed nut 411.

Figure 28:
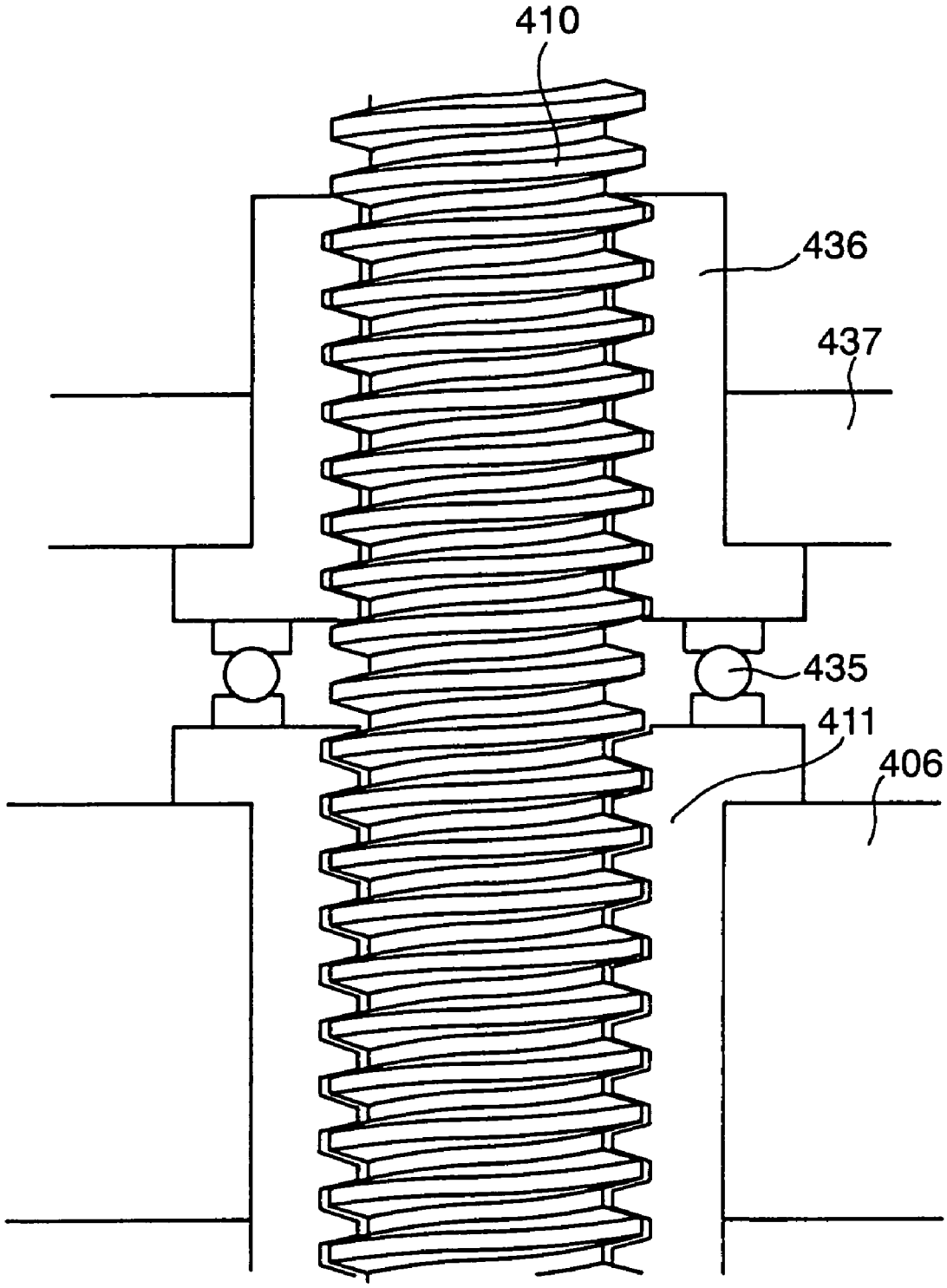
FIG. 28 is a partially enlarged view of an embodiment showing a relation of the female screw feed nut and the lock nut with respect to the screw shaft at the time when the double nut lock mechanism is in the unlock state and feeds the slider upward.

FIG. 28 is a partially enlarged view of an embodiment representing a relation of the female screw feed nut and the lock nut to the screw shaft at the time when the double nut lock mechanism comes into an unlock state to feed the slider 406 upward.

In FIG. 28, the lock nut 436 is slightly rotated counterclockwise via the clamp piece 437 viewed from the upper side on the paper surface and the lock nut relaxing mechanism 438 is in an unclamp state. At this point, the thread groove of the lock nut 436 and the thread ridge of the screw shaft 410 are placed in a neutral state. When the screw shaft 410 rotates counterclockwise viewed from the upper side on the paper surface, the upper side of the thread ridge of the screw shaft 410 feeds the slider 406 upward while coming into contact with the upper side of the thread groove of the female screw feed nut 411.

Figure 29:
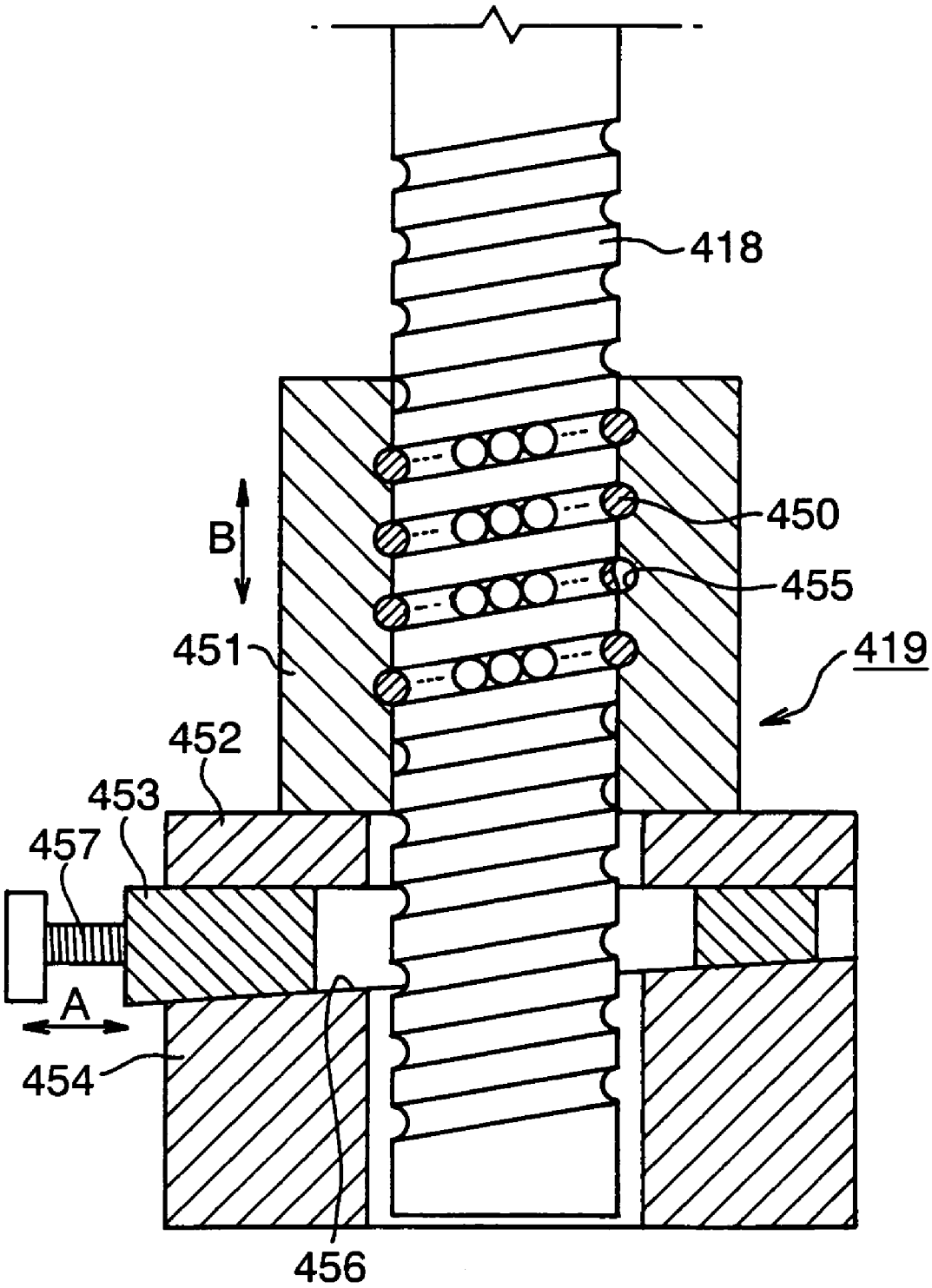
FIG. 29 is an explanatory sectional view of a structure of an embodiment of a ball screw mechanism with differential mechanism.

FIG. 29 is an explanatory sectional view of a structure of an embodiment of a ball screw mechanism with differential mechanism. Note that the ball screw mechanism with differential mechanism is disclosed in Japanese Patent Application Laid-Open No. 2002-144098 (Patent Document 2) filed by the applicant.

The ball screw mechanism with differential mechanism 419 used in FIG. 24 has a structure shown in FIG. 29. The ball screw mechanism with differential mechanism 419 includes the ball screw shaft 418 and a ball bearing consisting of plural balls 450 and a nut member 451 and further includes ball bearing position adjusting means having a movable member 452, a differential member 453, and a receiving member 454.

The nut member 451 has ball grooves 455 in a hole section thereof in order to engage with the ball screw shaft 418 in ball screw engagement via the balls 450. It is possible to perform accurate precise position control for the upper die 407 according to the ball screw engagement of the ball screw shaft 418 and the nut member 451.

The movable member 452 having a hole for causing the ball screw shaft 418 to pierce through in a central part thereof, which belongs to the ball bearing position adjusting means, is fixed at a lower end of the nut member 451. The differential member 453, which has a hole sufficient for allowing the ball screw shaft 418 to pierce through and allowing slide of the differential member 453 itself, is provided between the movable member 452 and the receiving member 454 that has a hole for causing the ball screw shaft 418 to pierce through in a central part and has an inclined surface 456 formed on an upper end surface. An inclined surface, a lower end surface of which has the same angle of inclination as and is oriented oppositely to the inclined surface formed in the receiving member 454, is formed in the differential member 453. The differential member 453 slides in a left to right direction in the figure (both directions of an arrow A in FIG. 29) and the nut member 451 moves only in a vertical direction (both directions of an arrow B in FIG. 29) via the movable member 452 (FIG. 29 does not show a constraining mechanism for moving the nut member 451 only in the vertical direction).

A screw section 457 for moving the differential member 453 in the left to right direction in the figure is rotated by a servomotor or manually to move the nut member 451 in the vertical direction by a very small distance. Consequently, in a ball screw that engages in line contact or point contact of the balls 450 and the ball grooves 455 constituting the ball screw, it is possible to prevent local wear of the balls 450 and the ball grooves 455 that is caused because the ball screw always engages in line contact or point contact in an identical position at the time when a load is applied.

A maximum load for further lowering the upper die 407 is generated at a point when the upper die 407 reaches a lowermost point. If the press working is continued using the same upper die 407, the same lower die 420, and the same work piece 422, in the ball screw shaft 418, the balls 450, and the ball grooves 455 of the nut member 451, the ball screw shaft 418 and the balls 450 come into contact with each other locally under the same fixed positional relation and wear occurs in this contact section locally. If the ball screw mechanism with differential mechanism 419 is used to insert or remove the differential member 453 in the both direction of the arrow A every time the press working is performed or every time the press working is performed for a predetermined number of times (e.g., five times), the positional relation of the ball screw shaft 418, the balls 450, and the ball grooves 455 of the nut member 451 at the maximum load slightly shift. Thus, the wear is prevented. A state of inserting and removing the differential member 453, when the differential member 453 is inserted once, the contact section shifts about 2 μm on a large diameter of the balls 450 with a diameter of 10 mm. In this way, the contact point moves around the large diameter of the balls 450 once when the differential member 453 is inserted about 15,700 times.

Note that, in the case shown in FIG. 24, the two sliders 405 and 406 are provided. Thus, it is possible to changes the positional relation of the ball screw shaft 418, the balls 450, and the ball grooves 455 of the nut member 451 by very slightly changing an interval between the slider 405 and the slider 406 at the time when the slider 406 is in the stopped position, that is, the upper die 407 is in the upper limit standby position. A machining start position of the ball grooves 455 of the nut member 451 is changed when a load is applied at the time of the press working and durability of the nut member 451 is secured. However, the ball bearing position adjusting means is not always required.

Figure 30:
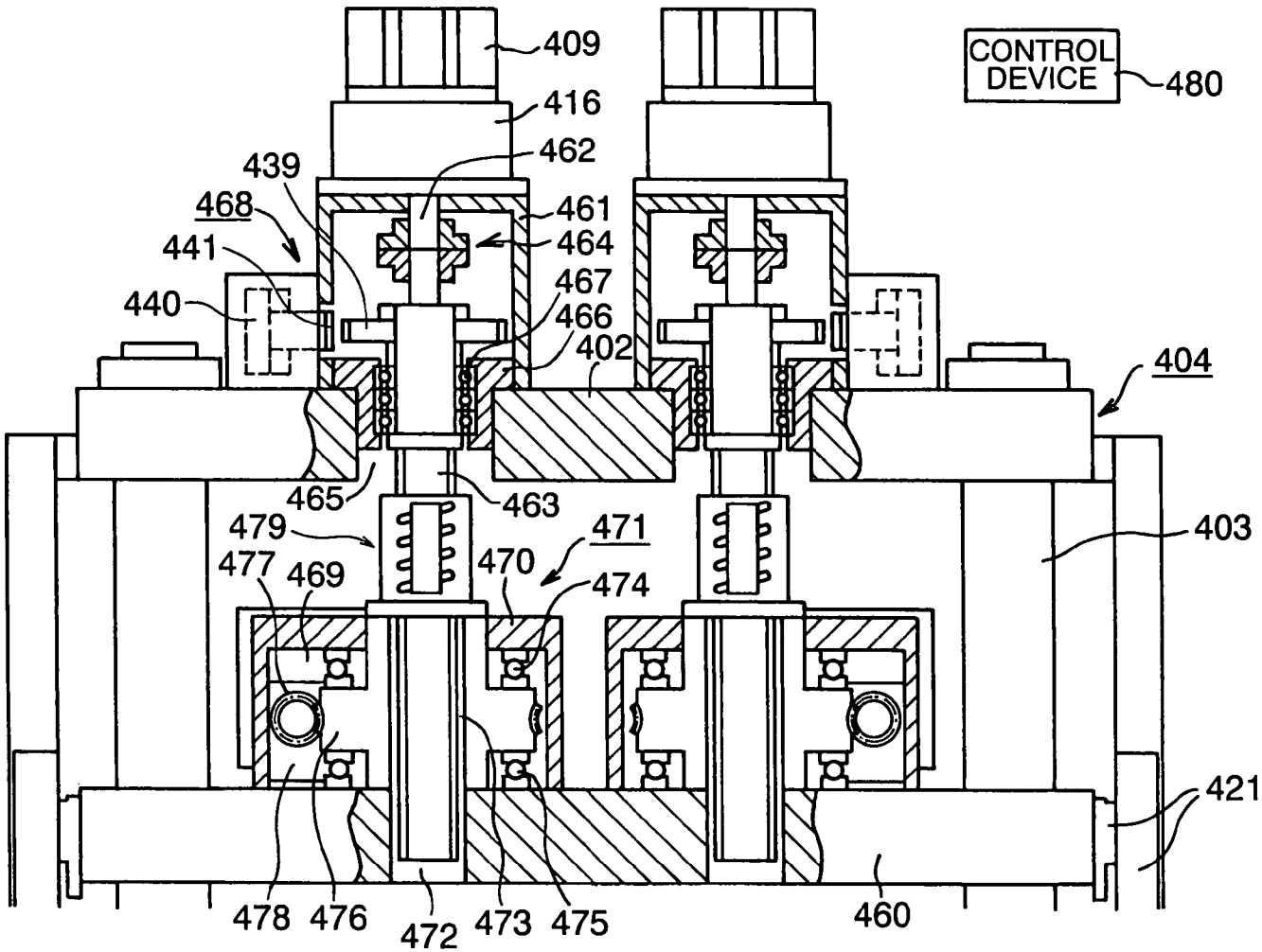
FIG. 30 is an enlarge explanatory view of an embodiment of a moving mechanism section for a upper die in a modification of an electric pressing machine corresponding to FIG. 24.

FIG. 30 is an enlarged explanatory view of an embodiment of a moving mechanism section for a upper die in a modification of the electric pressing machine corresponding to FIG. 24. Components same as those in FIGS. 24 and 25 are denoted by the identical reference numerals and signs.

In FIG. 30, a slider 460 is provided in the inside of the frame 404 formed by a not-shown base, the support plate 402, and the plural guide columns 403. Slide holes, through which the sliders 460 engage with the guide columns 403 and slide freely in an axial direction of the guide columns 403, are provided at four corners of the sliders 460, respectively.

Plural, for example, two or four attachment stands 461 are provided on an upper surface of the support plate 402. The servomotors for fast feed 409 incorporating encoders are attached to the respective attachment stands 461 via the decelerator 416 (the decelerator 416 does not always have to be provided).

Since structures and components related to the respective servomotors 409 attached to the plural attachment stands 461 explained below are completely the same, one of the servomotors 409 will be explained.

An output shaft 462 of the servomotor for fast feed 409, which pierces through the attachment stand 461 attached to the upper surface of the support plate 460, is coupled to a top end of a ball screw shaft (a third screw shaft) 463 via a coupling 464. A bearing 467 fit in the ball screw shaft 463 via a bearing holder 466 is attached to a hole 465 provided in the support plate 402. The ball screw shaft 463, which is driven by the servomotor for fast feed 409, is attached to the support plate 402 to rotate freely.

A lock mechanism 468 is provided in the support plate 402. This lock mechanism 468 has the same structure as the lock mechanism shown in FIG. 3 and includes a gear 439 fixed to the ball screw shaft 463 and a solenoid 440 having a gear piece 441 meshing with the gear 439. When this lock mechanism 468 works, the gear piece 441 meshes with teeth of the gear 439, the ball screw shaft 463 is fixed to the support plate 402 and the ball screw shaft 463 and the support plate 402 are integrated such that the ball screw shaft 4163 cannot rotate.

A support body 470 having a hollow 469 inside is fastened to an upper surface of the slider 460. In the hollow 469 of the support body 470, a worm wheel 476, which has a hole 473 sufficient for rotating the ball screw shaft 463 freely in conjunction with a hole 472 provided in the slider 460 and is provided to rotate freely with upper and lower two bearings for thrust load 474 and 475 with the ball screw shaft 463 as a central shaft, and a servomotor for pressing 478 incorporating an encoder, to which a worm 477 meshing with the worm wheel 476 is fixed, are provided. A ball screw mechanism 479 including balls and a nut member, which screws with the ball screw shaft 463, is fixed to an upper part of the worm wheel 476 to rotate freely in a form projecting to a ceiling portion of the support body 470.

When the servomotor for pressing 478 is stopped, the ball screw mechanism 479 fixed to the upper part of the worm wheel 476 is integrated with the slider 460 according to meshing of the worm 477 fixed to an output shaft of the servomotor for pressing 478 and the worm wheel 476. Thus, the ball screw shaft 463 is driven by forward rotation and reverse rotation of the servomotor for fast feed 409, the slider 460 rises or falls via a coupling mechanism (a third coupling mechanism) 471 including the ball screw mechanism 479 screwed with the ball screw shaft 463, the worm wheel 476, the two bearings 474 and 475, and the support body 470. Thus, it is possible to move the slider 460 reciprocatingly according to rotation control of the servomotor for fast feed 409.

When the lock mechanism 468 operates and the servomotor for pressing 478 rotates forward and reversely in a state in which the ball screw shaft 463 is integrated with the support plate 402, a rotating section constituted by the worm wheel 476 and the ball screw mechanism 479 rotates via the ball screw shaft 463 in a stationary state to lift or lower the slider 460. In other words, it is possible to move the slider 460 reciprocatingly according to the rotation control of the servomotor for pressing 478.

The lock mechanism 468 is locked to fix the ball screw shaft 463 to the support plate 402 after the servomotor for fast feed 409 stops. This is because, although it is attempted to rotate the ball screw shaft 463 according to an action of moving the slider 460 upward with a reaction that is generated when the upper die 407 presses the work piece 422 mounted on the lower die 420, since the rotation of the ball screw shaft 463 is prevented by the integration of the ball screw shaft 463 and the support plate 402, the slider 460 is prevented from moving upward. In other words, the upper die 407 can apply a predetermined press load to the work piece 422.

Although not shown in the figure, the upper die 407 (see FIG. 24) is attached to a lower end surface of the slider 460 and the lower die 420 (see FIG. 24) is provided on the base 401 (see FIG. 24) in a position corresponding to the upper die 407. The pulse scales 421, which detect a position of the slider 460, are provided along the four guide columns 403 between the base 401 and the support plate 402. The pulse scales 421 detect a contact position of the upper die 407 and the work piece 422 (see FIG. 24) mounted on the lower die 420 and detect an upper limit standby position and a lower limit falling position of the upper die 407.

Various setting values are inputted to a control device (a second control device) 480, which controls rotation of the respective servomotors for fast feed 409 and rotation of the respective servomotors for pressing 478 and controls the lock mechanism 468, which locks the ball screw shaft 463 to the support plate 402 or unlocks the ball screw shaft 463. In addition, the control device 480 receives a position signal that is detected by the pulse scales 421 for detecting a position of the slider 405, that is, a position of the upper die 407. Until a point immediately before the upper die 407 in the upper limit standby position comes into contact with the work piece 422 mounted on the lower die 420, the control device 480 lowers the upper die 407 rapidly via the rotation of the rotating section of the coupling mechanism 471 by the servomotor for pressing 478 according to the rotation of the ball screw shaft 463 by the servomotor for fast feed 409 and as required. Immediately after the stop of the servomotor for fast feed 409, the control device 480 locks the lock mechanism 468 to lock the support plate 402 and the ball screw shaft 463. From the point when the upper die 407 comes into contact with the work piece 422 or the point immediately before the contact to a point when the upper die 407 falls to the lower limit falling position set in advance (the imaginary line position (407) of the upper die 407 in FIG. 24), the control device 480 lowers the upper die 407 at a velocity lower than the rapid fall velocity via the slider 460 according to the rotation of the rotating section of the coupling mechanism 471 under the locking of the support plate 402 and the ball screw shaft 463. In this case, the control device 480 sets the servomotor for pressing 478 to the torque application mode under the lock of the support plate 402 and the ball screw shaft 463 such that the upper die 407 presses the work piece 422 mounted on the lower die 420 into a predetermined shape. After the upper die 407 reaches the lower limit falling position, the control device 480 unlocks the lock mechanism 468 and lifts the upper die 407 rapidly to the original upper limit standby position via the slider 460 using both the servomotor for fast feed 409 and the servomotor for pressing 478 under the unlock of the support plate 402 and the ball screw shaft 463.

Note that, since the ball screw mechanism 479 does not include the ball bearing position adjusting means of the ball screw mechanism 419 with differential mechanism 419 explained in FIG. 29, an explanation of the ball bearing position adjusting means is omitted. The ball screw mechanism 479 not including the ball bearing position adjusting means is used because it is possible to change a meshing positional relation of the ball screw shaft 463 and the ball screw mechanism 479 by rotating the worm wheel 476 slightly according to the rotation of the servomotor for pressing 478 in a state in which the lock mechanism 468 is locked to lock the support plate 402 and the ball screw shaft 463. Naturally, it is also possible to use a mechanism, which has the same function as the ball screw mechanism 419 with differential mechanism including the ball bearing position adjusting means explained in FIG. 29, instead of the ball screw mechanism 479. This will be explained with reference to FIG. 31 later.

Figure 31:
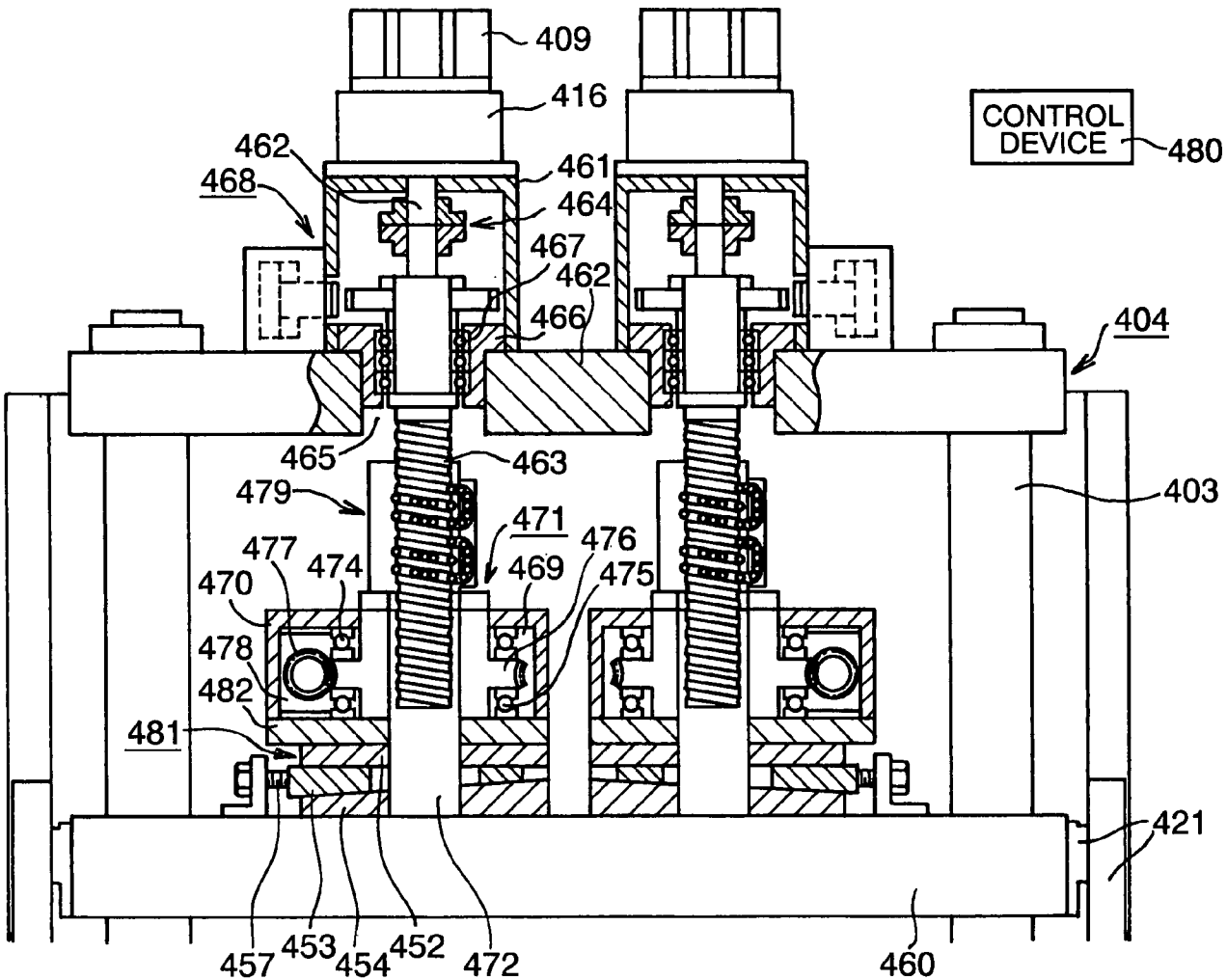
FIG. 31 is an enlarged explanatory view of another embodiment of the upper type moving mechanism section of the electric pressing machine.

FIG. 31 is an enlarged explanatory view of another embodiment of the moving mechanism section for a upper die of the electric pressing machine.

In FIG. 31, components same as those in FIG. 30 are denoted by the identical reference numerals and signs. The moving mechanism section in FIG. 31 is basically the same as that shown in FIG. 30. The moving mechanism section in FIG. 31 is different from that shown in FIG. 30 in that the ball screw mechanism with differential mechanism 419 explained in FIG. 29 is divided into a ball screw mechanism 479 and a ball bearing position adjusting means 481 and the ball bearing position adjusting means 481 is provided between the slider 460 and a base board 482 and also different in an internal structure of a nut member (see the nut member 451 in FIG. 29) of the ball screw mechanism 479.

In the internal structure of the nut member of the ball screw mechanism 479 in FIG. 31, as shown in FIG. 31, the balls arranged in the ball grooves of the ball screw shaft 463 are circulated from a lower ball groove to an upper ball groove according to the rotation of the ball screw shaft 463 and the ball screw mechanism 479. Local concentrated wear of the balls is prevented by the circulation of the balls.

Since the ball bearing position adjusting means 481 is provided between the slider 460 and the base board 482, the differential member 453 is move in the left to right direction in the figure by turning the screw section 457. Therefore, the nut member of the ball screw mechanism 479 moves by a very small distance in the vertical direction via the base board 482 to which the support body 470 is attached. Consequently, positions of abutment of the ball grooves in the nut member of the ball screw mechanism 479 against the balls arranged in the ball grooves of the ball screw shaft 463 change at the time when a load is applied in the press working. In other word, positions of abutment of the ball grooves in the nut member of the ball screw mechanism 479 against the balls at the time when a load is applied in the press working change. Thus, durability the nut member of the ball screw mechanism 479 is secured compared with the nut member in FIG. 30 in which the balls always come into abutment against the ball grooves in identical positions.

Figure 32:
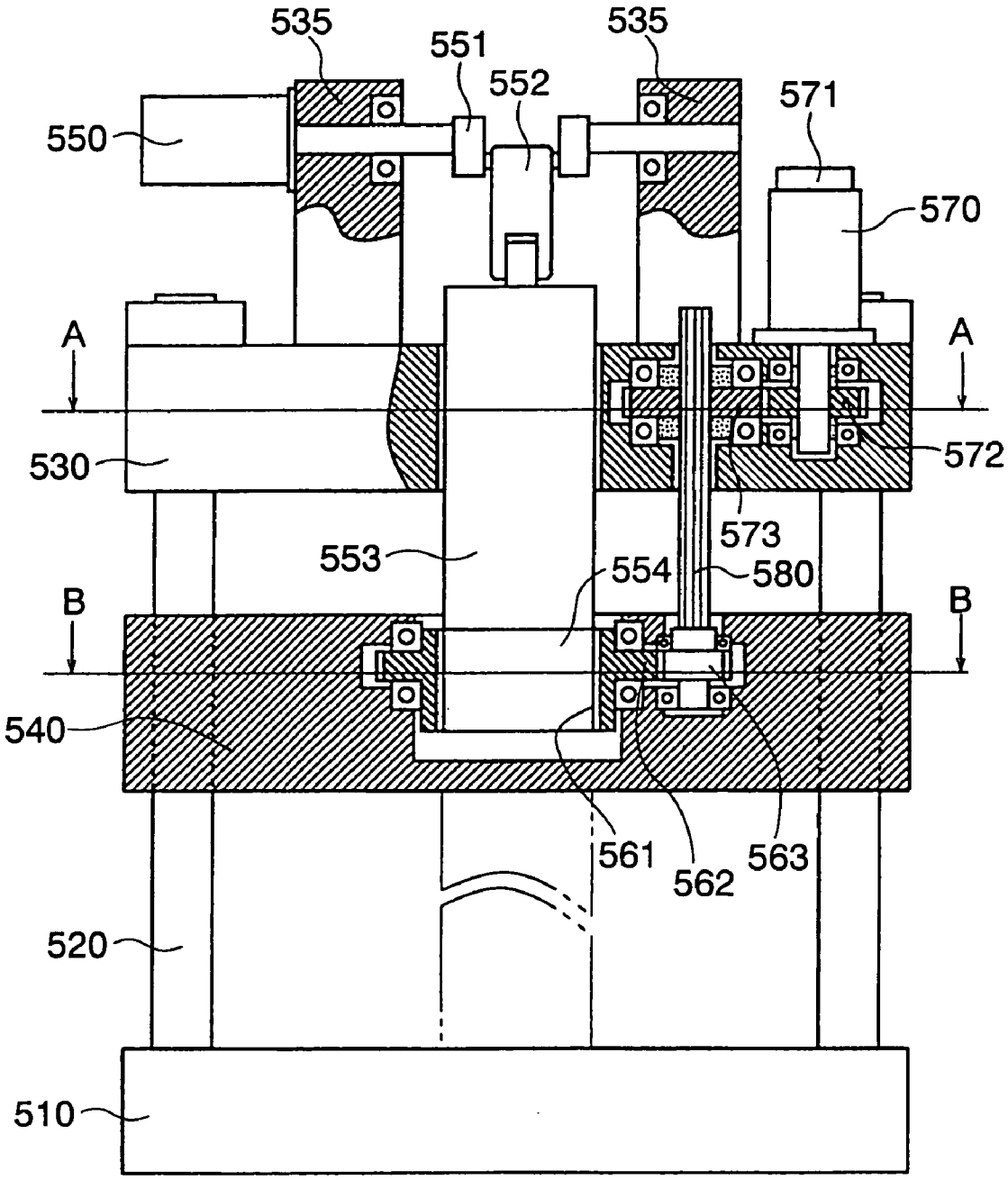
FIG. 32 is a main part sectional front view showing a pressing apparatus according to an embodiment of the invention.

Still another embodiment of the invention will be explained with reference to the drawings. FIG. 32 is a main part sectional front view of a pressing apparatus according to an embodiment of the invention. In the figure, a base 510 is fixed on a floor and a support plate 530 is held by guide columns 520 erected vertically on the base 510. A slider 540, which can move reciprocatingly along the guide columns 520, is provided between the base 510 and the support plate 530. There is a molding space between the slider 540 and the base 510. In this molding space, a fixed mold (a lower die) for molding is attached on the base and a movable mold (a upper die) corresponding to the fixed mold is attached to a lower surface of the slider. For example, a plate to be molded is placed between both the molds and molded.

The slider 540 is moved reciprocatingly along the guide columns 520 between the base 510 and the support plate 530 by reciprocating driving means that can be driven relatively to the support plate 530 by the drive motor (a servomotor for fast feed) 550 attached to the support plate. A crankshaft 551 is provided rotatably via a bearing between a pair of support members 535, 535 erected on the support plate 530. The crankshaft 551 is connected to a quill 553, which is provided to pierce through the support plate 530, via a connecting rod 552. The drive motor 550 is attached to one of the support members 535 such that rotation of the drive motor 550 is transmitted to the crankshaft 551 via a decelerator. A first screw (since the first screw is a male screw in this embodiment, the first screw will be hereinafter referred to as "male screw") 554 is provided at a lower end of the quill 553. A wheel 562, which has a second screw (since the second screw is a female screw in this embodiment, the second screw will be hereinafter referred to as "female screw") 561 screwing with the male screw 554 on an inner peripheral surface thereof, is rotatably held by a bearing in the slider 540. The wheel 562 rotates relatively to the slider 540 only around a central axis thereof and does not move in an axial direction thereof. Thus, when the crankshaft 551 is rotated by the drive motor 550, the slider 540 moves reciprocatingly along the guide columns 520.

In the slider 540, another gear ("pinion") engaging with the wheel 562 having the female screw 561 is supported by bearing and provided rotatably. It is preferable that the pinion 563 has a smaller number of teeth than the wheel 562 such that rotation of the pinion 563 is decelerated to be transmitted to the wheel 562.

A drive motor (a servomotor for pressing) 570 is attached to the support plate 530 separately from the drive motor 550 for rotating the crankshaft 551 and rotates a pinion 572 attached to a drive shaft of the drive motor 570. A wheel 573 engaging with this pinion 572 is attached to the support plate 530 to rotate freely. Rotation of the drive motor 570 is decelerated to be transmitted from the pinion 572 to the wheel 573. This wheel 573 is located coaxially with the pinion 563 provided in the slider 540 such that rotation is transmitted from the wheel 573 to the pinion 563 of the slider 540 by a rotation shaft 580 suspended between these gears. In this way, the rotation transmitting mechanism is constituted between the drive motor 570 and the wheel 562 provided in the slider 540 or between the drive motor 570 and the female screw 561 provided in the slider 540.

The pinion 563 provided in the slider 540 is fixed to the rotation shaft 580 to rotate together with the rotation shaft 580. However, the rotation shaft 580 is attached to the wheel 573 provided in the support plate 530 by a spline or a sliding key to rotate together with the wheel 573 but can move freely relatively to the wheel 573 in the axial direction. The slider 540 moves up and down between the base 510 and the support plate 530 according to rotation of the crankshaft 551 or rotation of the wheel 562 provided in the slider. Thus, an interval between the pinion 563 attached to the slider 540 and the wheel 573 attached to the support plate 530 changes according to the movement. Since the part between the wheel 573 provided in the support plate 530 and the rotation axis 580 can move in the axial direction freely, even if the slider 540 moves up and down relatively to the support plate 530, it is possible to transmit the rotation of the drive motor 570 to the pinion 563 of the slider 540.

The pinion 572 rotates according to the rotation of the drive motor 570 attached to the support plate 530 and the rotation of the pinion 572 is transmitted to the wheel 562 attached to the slider 540 via the rotation shaft 580. The female screw 561 attached to an inner periphery of the wheel moves up and down relatively to the quill 553 according to the rotation of the wheel 562 and the slider 540 moves up and down. Since a reducing ratio is large between the drive motor 570 and the wheel 562 of the slider 540, the rotation of the drive motor 570 is decelerated significantly to move the slider 540 up and down. Therefore, a force for moving the slider up and down can be increased to be an inverse time of the reducing ration as large to increase a pressing force applied to a work significantly. As a result, it is possible to reduce a capacity of the drive motor (the servomotor for pressing).

Figure 33:
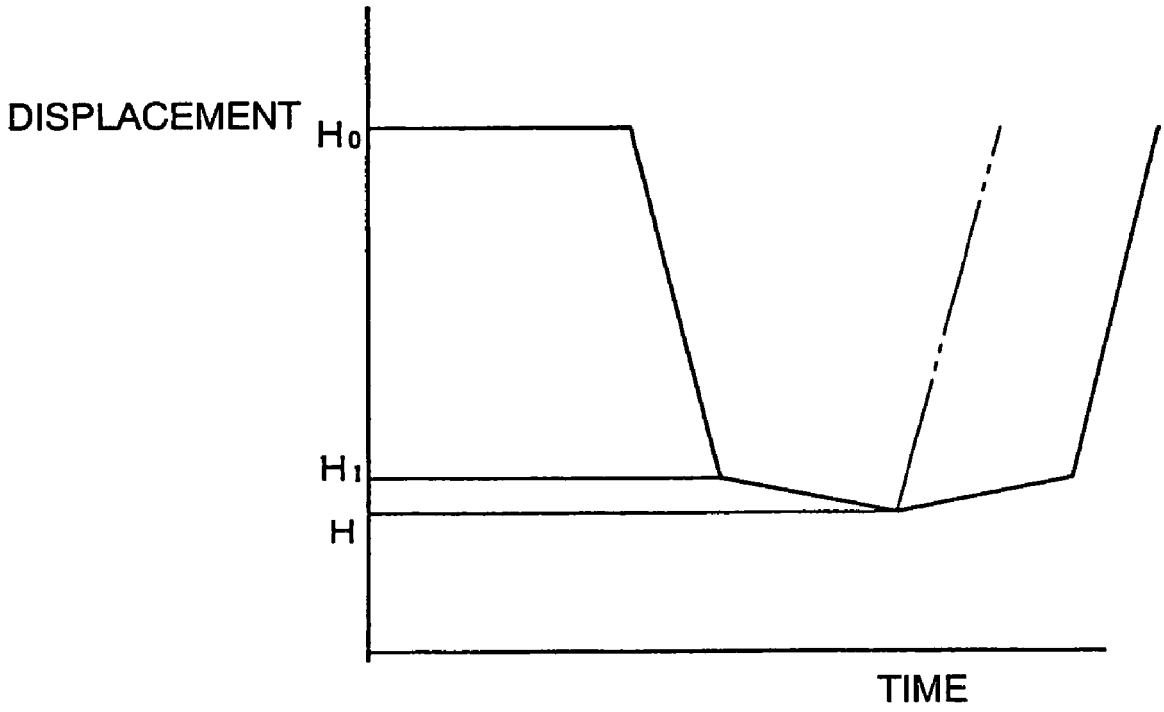
FIG. 33 is a graph showing a relation between displacement of a slider in the pressing apparatus and time.

When a predetermined drive signal is supplied from a not-shown drive control device to the drive motor 550 to rotate the crankshaft 551, the slider 540 falls from an initial height H0 (a upper stop point) shown in FIG. 33 to a height H1 (a lower stop point) near a fixed-stroke press operation height H. When the predetermined drive signal is supplied to the drive motor 550 to rotate the wheel 562 of the slider 540 relatively to the quill 553 in this position, the slider 540 falls from the height H1 to the fixed-stroke press operation height H to come into abutment against the work. Consequently, fixed-stroke press operation is applied to the work with a pressing force set in advance via a mold.

After the fall ends, first, the drive motor 570 is rotated reversely to lift the slider 540 from the fixed-stroke press operation height H to the height H1 and lift the slider 540 to the upper stop point according to the rotation of the drive motor 550. Alternatively, it is also possible to, first, rotate the drive motor 550 to move the slider 540 as indicated by a chain line in FIG. 33.

In order to lower the slider 540 from the height H1 to the fixed-stroke press operation height H at the time of machining and, after the fall ends, lift the slider 540 from the fixed-stroke press operation height H to the height H1, the drive motor 570 is rotated a predetermined number of times or a predetermined angle. To control the rotation of the drive motor 570 accurately, it is desirable to attach a rotary encoder 571 to the drive motor 570 and control an amount of rotation of the drive motor 570 while measuring the number of times of rotation or a rotation angle thereof.

In the embodiment, a reciprocating driving device moves the slider up and down according to rotation of the crankshaft. However, a toggle mechanism and the like can be used instead of the crankshaft.

INDUSTRIAL APPLICABILITY

As described above, in the pressing apparatus of the invention, it is possible to control the servomotor for fast feed (the first motor) and the servomotor for pressing (the second motor) while using a signal from the only one position detector that is provided for the set of the first motor and the second motor.

The differential mechanism for changing a machining stroke of the slider is provided in the fixed support plate. Moreover, in moving the slider reciprocatingly up and down, when the pushing member rises at least from a time after completion of press molding of a work piece until a time when the pushing member returns to an original position before the fall, the two motors, the first motor and the second motor, for driving the slider are driven cooperatively in a form of driving the motors in parallel and the slider is moved reciprocatingly up and down. In addition, in the pressing apparatus in which the second motor is arranged on the support plate, an inertia of the slider due to a reduction in weight of the slider is reduced. Thus, it is possible to control up and down movements of the slider quickly, time required for one cycle of the press machining is reduced, and the pressing apparatus with high efficiency is obtained.

The invention claimed is:

1. A pressing apparatus characterized by comprising:

a base;

a support plate that is held in parallel to the base via plural guide columns vertically provided on the base;

a slider that can slide on the guide columns to move up and down between the base and the support plate;

a first motor for fast feed that is attached to the support plate and drives the slider up and down fast; and a second motor for pressing that moves the slider up and down to press a work piece, and in that:

the pressing apparatus includes: an encoder for the first motor that detects rotation of the first motor; an encoder for the second motor that detects rotation of the second motor; and a single position detector, which measures movement of the slider, provided for a set of the first motor and the second motor, a servo module for controlling the first motor, and servo module for the first motor calculates an instruction based on position information giving a position where the first motor should be placed according to elapse of driving time of the first motor; a servo driver for the first motor controls the first motor, and the servo driver for the first motor drives the first motor according to an instruction from the servo module for the first motor and a signal from the encoder for the first motor, a servo module for controlling the second motor, and the servo module for the second motor calculates an instruction based on position information giving a position where the second motor should be placed according to elapse of driving time of the second motor; a servo driver for the second motor controls the second motor, and the servo driver for the second motor drives the second motor according to an instruction from the servo module for the second motor and a signal from the encoder for the second motor, and in the position detector, information giving a position of the slider, which is obtained from a signal from the single position detector during a period from start of the first motor until start of a press stroke period by the second motor, is reset and information giving a position of the slider at the time of start of the press stroke period by the second motor is set as a starting point value.

2. The pressing apparatus according to claim 1, characterized in that the servo module for the second motor obtains a positional deviation between present position information giving a position where the second motor should be placed according to the elapse of drive time of the second motor and a signal from the position detector and outputs the speed instruction on the basis of the positional deviation.

3. The pressing apparatus according to claim 1, characterized in that the servo module for the second motor calculates present position information giving a position where the second motor should be placed according to the elapse of drive time of the second motor and issues a movement instruction, and the servo driver for the second motor drives the second motor according to a speed instruction, which is calculated on the basis of the movement instruction from the servo module for the second motor, and a signal from the encoder for the second motor.

4. The pressing apparatus according to claim 3, characterized in that the servo module for the second motor is constituted to hold positional deviation information, which is obtained by comparing the respective pieces of positional information giving a position where the second motor should be placed according to the elapse of drive time of the second motor and the signal from the position detector, in a teaching period in a pre-stage of real press working and is constituted to calculate present positional information, which is obtained by adding the positional deviation information to the respective pieces of positional information, in the real press working stage.

5. The pressing apparatus according to claim 4, characterized in that, in the real press working stage, the present position information calculated by the servo module for the second motor and actual present position information from the position detector are compared and error information is outputted when a result of the comparison exceeds a threshold value.

6. The pressing apparatus according to claim 1, characterized in that the first motor and the second motor are subjected to drive control independently from one another and move the slider up and down in cooperation with one another.

7. The pressing apparatus according to claim 1, characterized in that the pressing apparatus includes:

a screw shaft that is attached to a rotation shaft of the first motor and drives the slider relatively to the base according to rotation of the first motor; and a differential mechanism that moves the screw shaft up and down relatively to the support plate according to drive by a drive source, and further including:

a ball screw nut that is screwed with a ball screw section provided in the screw shaft;

a lock device that integrates the screw shaft and the support plate;

a slider moving mechanism that includes an input shaft and makes the ball screw nut reversibly rotatable relatively to the screw shaft at a rotation torque inputted from the input shaft when the screw shaft and the support plate are fixed by the lock device and makes the ball screw nut fixable to the slider;

the second motor being capable of rotating forward and reversely that gives a rotation torque to the slider moving mechanism via the input shaft.

8. The pressing apparatus according to claim 7, characterized by comprising a control device that gives respective control signals to the first motor, the second motor, the drive source, and the lock device on the basis of a position detection signal of the position detector to control fall of the slider until a point when an pushing member attached to a lower surface of the slider comes into contact with a work piece mounted on the base or a point immediately before the contact, fall at the time of press molding, rise to an original position before the fall, and locking and unlocking of the lock device, such that the work piece is pressed by the pushing member attached to the lower surface of the slider.

9. The pressing apparatus according to claim 8, characterized in that the control device performs control for, in one cycle of press working, at least in the rise of the pushing member returning to the original position before the fall from a point after completion of the press molding of the work piece, causing the first motor and the second motor to cooperatively drive in parallel to each other to move the slider up and down.

10. The pressing apparatus according to claim 7, characterized in that the second motor is provided in the slider and a rotation shaft of the second motor and the input shaft of the slider moving mechanism are coupled.

11. The pressing apparatus according to claim 7, characterized in that the second motor is provided on the support plate and axis changing means, which changes an axial direction of the rotation shaft of the second motor to an axial direction of the input shaft of the slider moving mechanism, is provided between the second motor and the slider moving mechanism.

12. The pressing apparatus according to claim 7, characterized in that the slider moving mechanism has a top plate and a bottom plate and includes a support frame that has a hole formed in central parts of the top plate and the bottom plate and is fastened to the slider and, in the support frame, the slider moving mechanism includes two thrust bearings fastened to the top plate and the bottom plate, respectively; a worm wheel that is nipped by the two bearings, includes a through hole, which is enough for freely rotating and moving up and down the ball screw section, in a central part thereof, has cylindrical axial sections formed in an upper part and a lower part, respectively, and is fastened to the ball screw nut and fit in the hole section; a worm gear that meshes with the worm wheel; and an input shaft that fastens the worm gear.

13. The pressing apparatus according to claim 7, characterized in that the differential mechanism includes:

a differential cylinder that has a first screw on an outer peripheral surface and has a through hole, which holds the screw shaft to rotate freely, coaxially with the first screw;

a second screw that is provided on the support plate and screws with the first screw of the differential cylinder to hold the differential cylinder; and the drive source is attached to the support plate and rotates the differential cylinder relatively to the support plate and the screw shaft.

14. The pressing apparatus according to claim 7, characterized in that the differential mechanism includes a gear integral with the differential cylinder, a worm gear attached to a rotation shaft of the drive source, and means that transmits power between the worm gear and the gear of the differential cylinder.

15. The pressing apparatus according to claim 1, characterized in that the pressing apparatus includes:

a coupling mechanism screwing with a lower male screw section that moves the slider up and down according to rotation of the first motor for fast feed provided on the support plate via a screw shaft having an upper male screw section of one of a left-hand thread and a right-hand thread and a lower male screw of the other of the left-hand thread and the right-hand thread;

a screw mechanism that screws with the upper male screw section of the screw shaft and is axially supported on the support plate to rotate freely;

a worm wheel fastened to the screw mechanism;

the second motor for pressing is provided on the support plate that includes a worm meshing with the worm wheel and rotates the screw mechanism screwed with the upper male screw section to thereby moves the screw shaft up and down;

a lower die set on a base in a position corresponding to the upper die;

a position detector that detects a position of the upper die; and a control device that, on the basis of a position signal detected by the position detector, until a point when the upper die comes into contact with a work piece mounted on the lower die or a point immediately before the contact, lowers the upper die rapidly via at least rotation of the first motor for fast feed, from the point when the upper die comes into contact with the work piece or the point immediately before the contact to a point when the upper die falls to a lower limit falling position set in advance, lowers and presses the upper die in a torque application mode according to rotation of the second motor, and after the upper die reaches the lower limit falling position, lifts the upper die rapidly via the rotation of the first motor for fast feed and the rotation of the second motor for pressing.

16. The pressing apparatus according to claim 1, characterized in that the pressing apparatus includes:

a coupling mechanism screwing with the lower male screw section that moves the slider up and down according to rotation of the first motor for fast feed provided on the support plate via a screw shaft having an upper male screw section of one of a left-hand thread and a right-hand thread and a lower male screw of the other of the left-hand thread and the right-hand thread;

a screw mechanism that screws with the upper male screw section of the screw shaft and is axially supported on the support plate to rotate freely;

a worm wheel fastened to the screw mechanism;

the second motor for pressing is provided on the support plate that includes a worm meshing with the worm wheel and rotates the screw mechanism screwed with the upper male screw section to thereby moves the screw shaft up and down;

a lock mechanism that prevents rotation of the screw shaft;

a lower die set on a base in a position corresponding to the upper die;

a position detector that detects a position of the upper die; and a control device that, on the basis of a position signal detected by the position detector, until a point when the upper die comes into contact with a work piece mounted on the lower die or a point immediately before the contact, lowers the upper die rapidly via at least rotation of the first motor for fast feed, from the point when the upper die comes into contact with the work piece or the point immediately before the contact to a point when the upper die falls to a lower limit falling position set in advance, lowers and presses the upper die in a torque application mode according to rotation of the second motor, until a point immediately before the upper die comes into contact with the work piece mounted on the lower die, actuates the lock mechanism for preventing the rotation of the screw shaft, and after the upper die reaches the lower limit falling position, lifts the upper die rapidly via the rotation of the first motor for fast feed and the rotation of the second motor for pressing under unlock of the lock mechanism.

17. The pressing apparatus according to claim 1, characterized in that the pressing apparatus includes:

an upper die attached to a lower end surface of said slider and slides on the guide columns freely;

another slider that is provided between the support plate and the slider and slides on the guide columns freely;

a first coupling mechanism that moves the another slider up and down via a first screw shaft for fast feed that is driven to rotate forward and reversely by the first motor provided on the support plate;

a second coupling mechanism that moves the slider up and down via a second screw shaft that is driven to rotate forward and reversely by the second motor provided in the second slider;

a lock mechanism that locks the another slider and the first screw shaft;

a lower die set on a base in a position corresponding to the upper die;

a first control device that, on the basis of a position signal detected by the position detector, until a point when the upper die comes into contact with a work piece mounted on the lower die or a point immediately before the contact, lowers the upper die rapidly via at least the another slider, at the point when the upper die comes into contact with the work piece or the point immediately before the contact, fixes the another slider and the first screw shaft via the lock mechanism, from the point when the upper die comes into contact with the work piece or the point immediately before the contact to a point when the upper die falls to a lower limit falling position set in advance, decelerates the fall of the upper die via the slider and causes the upper die to press the work piece mounted on the lower die in a torque application mode of the second motor, and after the upper die reaches the lower limit falling position, lifts the upper die rapidly via the slider and the another slider.

18. The pressing apparatus according to claim 1, characterized in that the pressing apparatus includes:

a coupling mechanism including a rotating section on the slider that moves the slider up and down via a screw shaft that is driven to rotate forward and reversely by the first motor provided on the support plate;

a lock mechanism that locks the support plate and the screw shaft;

the second motor for pressing is provided in the slider, rotates the rotating section of the coupling mechanism forward and reversely, moves the slider up and down via the forward rotation and the reverse rotation of the rotating section of the coupling mechanism, and can be fixed to the slider and the rotating section of the coupling mechanism;

a lower die set on a base in a position corresponding to the upper die;

a position detector that detects a contact position of the upper die and a work piece mounted on the lower die and detects an upper limit standby position and a lower limit falling position of the upper die; and a second control device that, on the basis of a position signal detected by the position detector, until a point when the upper die comes into contact with a work piece mounted on the lower die or a point immediately before the contact, lowers the upper die rapidly via at least rotation of the screw shaft by the first motor, locks the support plate and the screw shaft via the lock mechanism immediately after the first motor stops, from the point when the upper die comes into contact with the work piece or the point immediately before the contact to a point when the upper die falls to a lower limit falling position set in advance, decelerates the fall of the upper die via the slider according to rotation of the coupling mechanism under the lock of the support plate and the screw shaft, and causes the upper die to press the work piece mounted on the lower die in a torque application mode of the second motor under the lock of the support plate and the screw shaft, and after the upper die reaches the lower limit falling position, lifts the upper die rapidly via the slider under unlock of the slider and the screw shaft.

19. A pressing apparatus characterized by comprising:

a base;

a support plate that is held in parallel to the base via plural guide columns vertically provided on the base;

a slider that can slide on the guide columns to move up and down between the base and the support plate, the slider including a first screw;

reciprocating driving means for fast feed that is attached to the support plate and drives the slider up and down fast, the reciprocating driving means including a second screw engaged with the first screw; and a motor for pressing attached to the support plate, the motor moving the slider up and down to press a work piece; an encoder for the motor that detects rotation of the motor for pressing; and a position detector that measures movement of the slider, a servo module for controlling the motor for pressing, and the servo module for the motor for pressing calculates a speed instruction from position information; a servo driver for the motor for pressing controls the motor for pressing, and the servo driver for the motor for pressing drives the motor according to a speed instruction from the servo module for the motor and a signal from the encoder for the motor, concerning the motor for pressing, information giving a position of the slider obtained from a signal from the position detector during a period after the reciprocating driving means is started until the motor for pressing is started, is reset and information giving a position of the slider at a point of start of the motor for pressing is set as a starting point value, a rotation transmitting mechanism that connects the motor for pressing and the first screw and transmits rotation of the motor for pressing to the first screw, and a control device moves the slider to the vicinity of a moving end point of the reciprocating driving means with the reciprocating driving means and operates the motor to rotate the second screw relatively to the first screw to thereby generate a pressing force between the slider and the base.

20. A pressing apparatus comprising:

a base;

a support plate that is held in parallel to the base via plural guide columns vertically provided on the base;

a slider that can slide on the guide columns to move up and down between the base and the support plate;

a plurality of first motors for fast feed that are attached to the support plate and drive the slider up and down fast; and a plurality of second motors for pressing that move the slider up and down to press a work piece, the plurality of first motors and the plurality of second motors are controlled independently from one another and move the slider up and down in cooperation with one another, and in that:

the pressing apparatus includes: an encoder for the plurality of first motors that detects rotation of the first motors; an encoder for the plurality of second motors that detects rotation of the second motors; and a single position detector, which measures movement of the slider, provided for the plurality of first motors and the second motors, a servo module for controlling the first motors, and the servo module for the first motors calculates an instruction based on position information giving a position where the first motors should be placed according to elapse of driving time of the first motors; a servo driver for the first motors controls the first motors, and the servo driver for the first motor, drives the first motors according to an instruction from the servo module for the first motors and a signal from the encoder for the first motors, a servo module for controlling the second motors, and the servo module for the second motors calculates an instruction based on position information giving a position where the second motors should be placed according to elapse of driving time of the second motors; a servo driver for the second motors controls the second motors, and the servo driver for the second motors drives the second motors according to an instruction from the servo module for the second motors and a signal from the encoder for the second motors, and in the position detector, information giving a position of the slider, which is obtained from a signal from the single position detector during a period from start of the first motors until start of a press stroke period by the second motors, is reset and information giving a position of the slider at the time of start of the press stroke period by the second motors is set as a starting point value.

* * * * *